US009759220B2

(12) United States Patent
Tadokoro et al.

(10) Patent No.: US 9,759,220 B2
(45) Date of Patent: Sep. 12, 2017

(54) CROSS FLOW FAN AND INDOOR UNIT OF AIR-CONDITIONING APPARATUS

(75) Inventors: Takahide Tadokoro, Tokyo (JP); Takashi Ikeda, Tokyo (JP); Shingo Hamada, Tokyo (JP); Mitsuhiro Shirota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1091 days.

(21) Appl. No.: 13/993,392

(22) PCT Filed: Dec. 12, 2011

(86) PCT No.: PCT/JP2011/006924

§ 371 (c)(1),
(2), (4) Date: Jun. 12, 2013

(87) PCT Pub. No.: WO2012/086147

PCT Pub. Date: Jun. 28, 2012

(65) Prior Publication Data

US 2013/0259669 A1 Oct. 3, 2013

(30) Foreign Application Priority Data

Dec. 24, 2010 (JP) ..... 2010-287844

(51) Int. Cl.
*F04D 19/00* (2006.01)
*F04D 17/04* (2006.01)
(Continued)

(52) U.S. Cl.
CPC ..... *F04D 19/002* (2013.01); *F04D 17/04* (2013.01); *F04D 29/283* (2013.01); *F04D 29/30* (2013.01); *F04D 29/665* (2013.01); *F24F 1/0018* (2013.01); *F24F 1/0025* (2013.01)

(58) Field of Classification Search
CPC ..... F04D 29/283; F04D 29/30; F04D 29/327; F04D 29/666; F04D 29/282; F04D 17/04; F04D 19/002; F24F 1/0025; F24F 1/0018
See application file for complete search history.

(56) References Cited

U.S. PATENT DOCUMENTS 7,815,419 B2 * 10/2010 Teraoka ..... F04D 29/283 416/178
2009/0104017 A1 * 4/2009 Park ..... F04D 29/666 415/53.1
2012/0263573 A1 10/2012 Tadokoro et al.

FOREIGN PATENT DOCUMENTS

CN 102686887 A 9/2012
JP 10-252689 A 9/1998
(Continued)

OTHER PUBLICATIONS

Office Action dated Nov. 30, 2015 issued in corresponding CN patent application No. 201180062267.8 (and English translation).
(Continued)

*Primary Examiner* — Dwayne J White
*Assistant Examiner* — Adam W Brown
(74) *Attorney, Agent, or Firm* — Posz Law Group, PLC

(57) ABSTRACT

An impeller element includes a plurality of blades disposed along an outer circumference of a circular support plate. Each blade is divided into a plurality of blade sections in a rotational axis direction. At least one of the divided blade sections as a long-chord blade section is configured such that a chord as a line segment connecting a blade outer-circumferential edge and a blade inner-circumferential edge of the blade in a cross section perpendicular to a rotational axis of the blade has a greater length than a chord of another one of the blade sections as a short-chord blade section. The blade inner-circumferential edge of the at least one long-chord blade section having the longer chord protrudes toward the inner circumferential side, relative to the blade inner-circumferential edge of the at least other one of the blade sections as the short-chord blade section having the shorter chord.

14 Claims, 38 Drawing Sheets

(51) Int. Cl.

| | |
|---|---|
| ***F24F 1/00*** | (2011.01) |
| ***F04D 29/28*** | (2006.01) |
| ***F04D 29/30*** | (2006.01) |
| ***F04D 29/66*** | (2006.01) |

(56) References Cited

FOREIGN PATENT DOCUMENTS

| | | | |
|---|---|---|---|
| JP | 2004-332588 | A | 11/2004 |
| JP | 2006-125390 | A | 5/2006 |
| JP | 2006-329099 | A | 12/2006 |
| JP | 2011-099408 | A | 5/2011 |
| JP | 2011-122522 | A | 6/2011 |
| WO | 2006-035933 | A1 | 4/2006 |
| WO | 2011/036848 | A1 | 3/2011 |

OTHER PUBLICATIONS

Office Action mailed Apr. 15, 2015 in the corresponding CN application No. 2011800622678 (with English translation).
Office Action mailed Mar. 4, 2014 for the corresponding JP application No. 2013-056704 (with English translation).
International Search Report of the International Searching Authority mailed Mar. 13, 2012 for the corresponding international application No. PCT/JP2011/006924 (with English translation).
Notice of Reasons for Rejection issued from the Japanese Patent Office mailed Jan. 22, 2013 for the priority Japanese patent application No. 2010-287844 (with English translation).

* cited by examiner (a)

(b)

(a)

(b)

(a)

(b)

(a)

(b)

(a)

(b)

(a)

(b)

θ1:OUTLET ANGLE OF LONG-CHORD BLADE SECTION
θ2:OUTLET ANGLE OF SHORT-CHORD BLADE SECTION

CROSS FLOW FAN AND INDOOR UNIT OF AIR-CONDITIONING APPARATUS

CROSS-REFERENCE TO RELATED APLLICATIONS

This application is a U.S. national stage application of International Application No. PCT/JP2011/006924 filed on Dec. 12, 2011, and claims priority to, and incorporates by reference, Japanese Patent Application No. 2010-287844 filed on Dec. 24, 2010.

TECHNICAL FIELD

The present invention relates to a cross flow fan, and an indoor unit of an air-conditioning apparatus provided with the cross flow fan.

BACKGROUND ART

Indoor units of air-conditioning apparatuses are installed in rooms (rooms in houses and offices) to be air conditioned. Such an indoor unit is configured to exchange heat between the indoor air suctioned through an air inlet and the refrigerant circulating in a refrigeration cycle with use of a heat exchanger, heats the indoor air in the case of a heating operation, cools the indoor air in the case of a cooling operation, and blows the air back to the room through an air outlet. A blower fan and the heat exchanger are therefore accommodated inside the main body of the indoor unit.

There are various types of indoor units of air-conditioning apparatuses. It is well known that wall type air-conditioning apparatuses having an elongated air outlet and ceiling concealed type air-conditioning apparatuses configured to blow the air in a single direction use a cross flow fan (also referred to as a transverse fan or a transverse flow fan) as a blower fan. For an airflow flowing from the air inlet to the air outlet of an indoor unit of an air-conditioning apparatus, a heat exchanger is disposed at the upstream side of the cross flow fan. That is, a heat exchanger is disposed between the air inlet and the cross flow fan. The air outlet is located at the downstream side of the cross flow fan.

The cross flow fan includes a plurality of impeller elements connected to each other in the rotational axis direction. Each impeller element includes a plurality of blades each having a substantially arcuate shape in the horizontal cross section. The blades are inclined at a predetermined angle and are fixed concentrically to a support plate as a circular (ring-shaped) flat plate having an outer diameter and an inner diameter. A circular end plate to which a rotating shaft supported by a bearing of an indoor unit main body is attached is fixed to a blade end of the impeller element at an end in the rotational axis direction. An impeller element at the other end has a boss-attached side plate that is different from side plates disposed at other portions. The boss-attached side plate includes, at the center thereof, a boss portion to which a motor rotating shaft of a drive motor is attached and fixed. When the drive motor rotates, the cross flow fan rotates about a rotational axis at the center of the rotating shaft. The blade is inclined such that an outer-circumferential edge thereof is located at the front side in the rotational direction.

With the rotation of the cross flow fan, indoor air is suctioned through the air inlet into the indoor unit main body. When passing through the heat exchanger, the air becomes conditioned air whose temperature is adjusted as described above. After flowing through the cross flow fan, the air passes through a flow path leading to the air outlet, and is blown out into the room from the air outlet formed at a lower part of the indoor unit main body.

In this way, the airflow passes between blades twice, in an inlet region at the inlet side of the cross flow fan and in an outlet region at the outlet side. The blade of the cross flow fan has a blade pressure surface at the rotational direction side on which pressure is made greater by the rotation of the cross flow fan than that during rest, a blade pressure suction surface in a counter-rotational direction on which pressure is made less by the rotation of the cross flow fan than that during rest, and two edges connecting the blade pressure surface and the blade pressure suction surface at the outer circumferential side and the inner circumferential side, respectively. An edge located on a far side with respect to the rotational axis of the cross flow fan is a blade outer-circumferential edge, and an edge located on a near side of the rotational axis is a blade inner-circumferential edge. In the inlet region of the cross flow fan, the air flows from the blade outer-circumferential edge toward the blade inner-circumferential edge. In the outlet region, the air flows from the blade inner-circumferential edge toward the blade-outer circumferential edge.

In recent years, air-conditioning apparatuses have been required to have greater capacity so as to be effective for larger rooms, and therefore the cross flow fans have been required to achieve greater air volume. Further, the air-conditioning apparatuses have also been required to provide energy-saving performance and comfort. Accordingly, cross flow fans of high air volume, low energy consumption by a drive motor, and low noise level are in demand.

In order to reduce the level of noise, a conventional cross flow fan has a plurality of V-shaped notches that are open at the blade inner-circumferential edge along the longitudinal direction of the blade, and prevents occurrence of separation on the blade pressure suction surface in an outlet region using a vertical vortex generated at the notches, and thereby reduces the noise level (for example, see Patent Literature 1).

CITATION LIST

Patent Literature

Patent Literature 1: Japanese Unexamined Patent Application Publication No. 10-252689 (columns 0014 through 0022, FIGS. 2 through 4, 7, and 8, etc.)

SUMMARY OF INVENTION

Technical Problem

An inlet region and an outlet region of an impeller of a cross flow fan have a predetermined angle range in a circumferential direction of the cross flow fan, with an internal vortex therebetween which is generated in the vicinity of a tongue portion formed in an indoor unit main body. However, an airflow blown out from the outlet region does not have a uniform air velocity distribution in the angle range. That is, the distribution is formed such that the air velocity is the highest between specific blades, and such that the air velocity decreases from the position of these blades as the center toward the opposite ends of the outlet region. Further, the distribution tends to be formed such that the air velocity in the area including the blades between which the air velocity is the highest and some blades in the vicinity thereof at the opposite sides is significantly greater than the air velocity between blades in the other area. In other words, an air velocity distribution is limited to a specific area.

The generation of such air velocity distribution may be due to the relationship between the flow of air that flows through the cross flow fan toward the outlet region and the orientation of the blade inner-circumferential edge (a portion in the vicinity of the inner circumferential edge). The blade inner-circumferential edges of the blades of the cross flow fan have the same shape, and the shape is generally determined in accordance with the average flow direction of the air flowing inside the cross flow fan. However, not all the airflows inside the cross flow fan flow in the same direction. In the outlet region, the air smoothly flows into between the blades where the direction which the blade inner-circumferential edges at the airflow inlet side are facing substantially matches the direction of the airflow which is to flow into between the blades, that is, where these directions are close to parallel to each other, without any trouble such as a collision between the airflow and the blade inner-circumferential edges. Thus, a great amount of airflow flows into between the blades into which the airflow can smoothly flow. Since the airflow is concentrated between the blades with a low airflow resistance when the air flows into between the blades in the outlet region, the airflow having passed through the blades is locally concentrated in the outlet flow path.

Such a local high-speed flow in the outlet region described above causes noise and leads to an energy loss in the outlet flow path that is formed in accordance with an apparatus in which the cross flow fan is installed. Typically, the energy loss due to passage between the blades is proportional to the square of the air velocity, and the noise level is proportional to the sixth power of the air velocity. Therefore, an increase in the maximum air velocity due to drift or the like results in a reduction in input of the fan and an increase in the noise level. For example, in the case where a cross flow fan is installed in an indoor unit of an air-conditioning apparatus, if the air velocity of the airflow passing through an airflow control vane at the air outlet, which adjusts the direction of the airflow to be blown out, is high, the energy loss due to a collision with the airflow control vane is increased. Further, when the airflow is blown out from the air outlet into the room, the flow path suddenly becomes large. Therefore, if the air velocity is high at this portion, a vortex or a turbulence is generated at the end of the air outlet, so that the energy loss is increased.

In Patent Literature 1 described above, the notches are provided at the blade inner-circumferential edge at the airflow inlet side in the outlet region. Thus, part of the airflow flowed into between the blades from the blade inner-circumferential edges passes from the blade pressure surface toward the blade pressure suction surface through the notches so as to reduce the turbulence of the airflow to be blown out. In this blade with the notches, in the outlet region, there is a difference in the direction which the blade inner-circumferential edge at the airflow inlet side is facing and the direction which the bottom of the notch is facing. Accordingly, in the outlet region where the air from the inner circumferential side flows into between the blades, the directions of the airflows which are to flow into between the blades of these two portions are different. However, in the case of the bottom of the notch, since the bottom of the V-shaped notch is substantially a point, the width thereof is small. Therefore, although the airflows in different directions flow into at the blade inner-circumferential edge where no notch is provided and at the bottom of the notch, the airflows affect each other and are mixed while flowing between the blades, pass over the blade outer-circumferential edge from between the blades, and flow to the outlet flow path. That is, in the case of the notch having the shape disclosed in Patent Literature 1, since the airflow flows from the blade pressure surface toward the blade pressure suction surface through the notch, the turbulence of the air to be blown out is reduced. However, there is little difference in the directions of the airflows flowing into between the blades. Even if a notch having another shape is provided, for example, a notch having a rectangular shape is provided, since the width of the notch is small, the airflow is concentrated and flows locally between the blades where the airflow resistance is small, as in the case described above. Since the airflow flows locally between the blades in a specific area in the outlet region, the maximum velocity is increased when attempting to obtain a predetermined air volume. This results in an energy loss and an increased noise level.

The present invention has been made to overcome the above problems, and aims to provide a cross flow fan which is configured such that, in an outlet region of an impeller, an airflow is blown out from between blades in a wide range in the circumferential direction so as to be widely dispersed while preventing the airflow from being locally concentrated, and which is thus capable of reducing the energy loss and the noise level.

Further, the present invention aims to provide an indoor unit of an air-conditioning apparatus using a cross flow fan which is capable of making uniform the air velocity distribution of an airflow across an outlet flow path at a downstream side of the cross flow fan and is capable of reducing the energy loss and the noise level.

Solution to Problem

A cross flow fan according to the present invention includes an impeller that includes a plurality of impeller elements each including a plurality of blades disposed along an outer circumference of a circular support plate, the plurality of impeller elements being fixed to each other in a direction of a rotational axis passing through a center of the support plate, wherein each of the blades is divided into a plurality of blade sections in the rotational axis direction; at least one of the divided blade sections is a long-chord blade section whose chord has a length greater than a length of a chord of at least another one of the blade sections, the chord being a line segment connecting a blade outer-circumferential edge and a blade inner-circumferential edge of each of the blades in a cross section perpendicular to the rotational axis of the blades; and the blade inner-circumferential edge of the long-chord blade section protrudes toward an inner circumferential side, relative to the blade inner-circumferential edge of the at least another one of the blade sections as a short-chord blade section having the shorter chord.

Further, an indoor unit of an air-conditioning apparatus according to the present invention includes a cross flow fan which includes an impeller that includes a plurality of impeller elements each including a plurality of blades disposed along an outer circumference of a circular support plate, the plurality of impeller elements being fixed to each other in a direction of a rotational axis passing through a center of the support plate, wherein each of the blades is divided into a plurality of blade sections in the rotational axis direction; at least one of the divided blade sections is a long-chord blade section whose chord has a length greater than a length of a chord of at least another one of the blade sections, the chord being a line segment connecting a blade outer-circumferential edge and a blade inner-circumferential edge of the blade in a cross section perpendicular to the rotational axis of the blade; and the blade inner-circumferential edge of the long-chord blade section protrudes toward an inner circumferential side, relative to the blade inner-circumferential edge of the at least another one of the blade sections as a short-chord blade section having the shorter chord.

Advantageous Effects of Invention

According to the present invention, when an airflow flows into between the blades in the outlet region, the airflow flows into a wide range in the circumferential direction and is blown out from between the blades. Thus, the area of a high-speed flow region of the airflow having passed over the blades and flowing through an outlet flow path is expanded. Thus, the air velocity distribution is made uniform, and the maximum air velocity is reduced when compared at a predetermined air volume. Accordingly, it is possible to obtain a cross flow fan capable of reducing the energy loss and the noise level.

When this cross flow fan is installed, the area of a high-speed flow region of an airflow blown out from between the blades of the cross flow fan is expanded between a front guide and a rear guide of an outlet flow path in which the front guide is disposed at a front side of the airflow and a rear guide is disposed at a rear side. Thus, the air velocity distribution is made uniform, and the maximum air velocity is reduced when compared at a predetermined air volume. Accordingly, it is possible to obtain an indoor unit of an air-conditioning apparatus capable of reducing the energy loss and the noise level.

DESCRIPTION OF EMBODIMENTS

Embodiment 1

Figure 1:
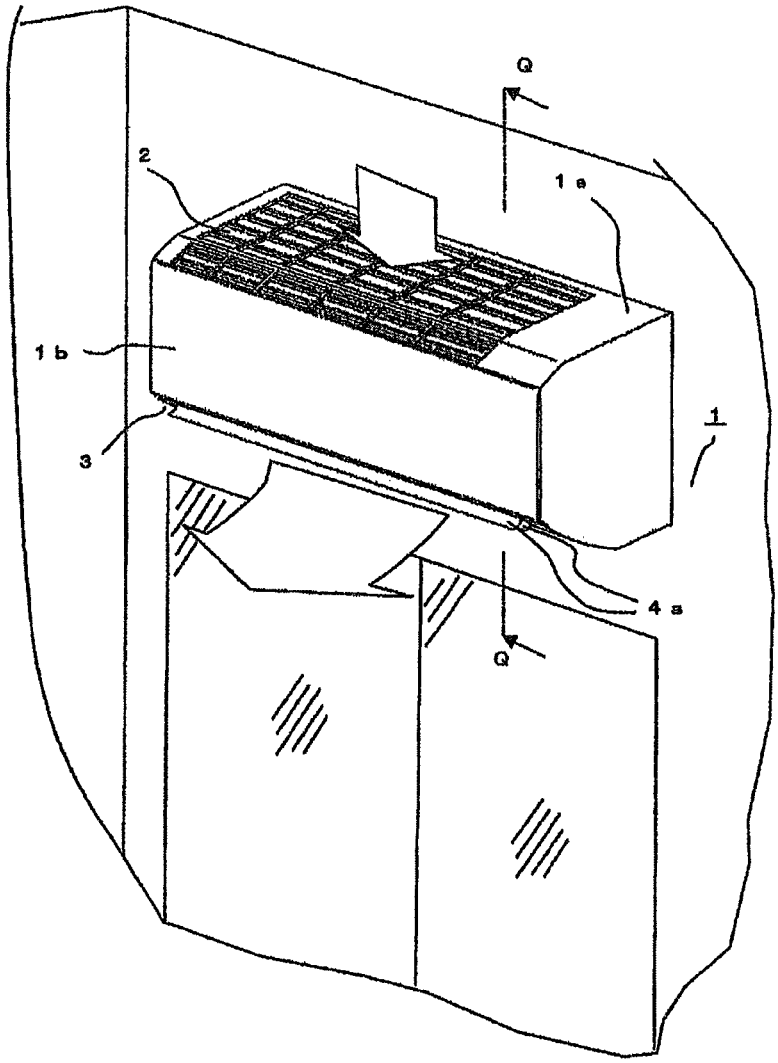
FIG. 1 is an external perspective view illustrating an indoor unit of an air-conditioning apparatus provided with a cross flow fan according to Embodiment 1 of the present invention.
Figure 2:
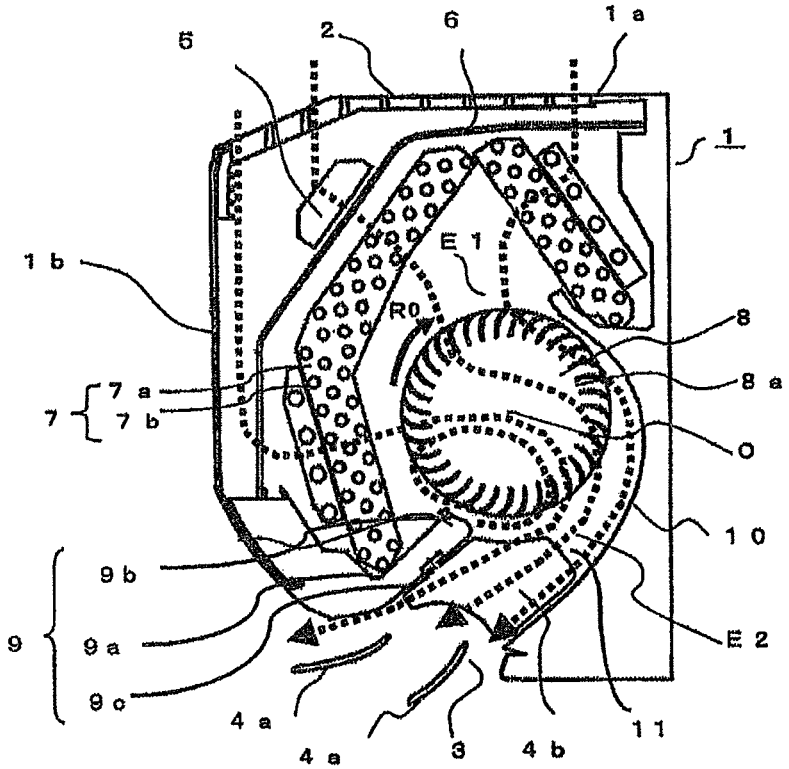
FIG. 2 is a vertical cross-sectional view taken along line Q-Q of FIG. 1 according to Embodiment 1 of the present invention.

Embodiment 1 of the present invention will be described with reference to the drawings. FIG. 1 is an external perspective view illustrating an indoor unit 1 of an air-conditioning apparatus provided with a cross flow fan according to Embodiment 1 of the present invention. FIG. 2 is a vertical cross-sectional view taken along line Q-Q of FIG. 1. The flow of air is indicated by the white arrows in FIG. 1, and by the dotted arrows in FIG. 2. As illustrated in FIGS. 1 and 2, the indoor unit 1 of an air-conditioning apparatus is installed on a wall of the room. An inlet grille 2 serving as an inlet for indoor air, an electrostatic precipitator 5 that collects dust by applying static electricity thereto, and a mesh filter 6 that removes dust are provided at an upper portion 1*a* of the indoor unit. Further, a heat exchanger 7 in which a pipe 7*b* extends through a plurality of aluminum fins 7*a* is disposed at the front side and the upper side of an impeller 8*a* so as to surround the impeller 8*a*. A front side 1*b* of the indoor unit is covered with a front panel, and an air outlet 3 is formed therebelow. A cross flow fan 8 serving as an air-sending device includes a stabilizer 9 and a rear guide 10 that separate an inlet region E1 from an outlet region E2 relative to the impeller 8*a*. The stabilizer 9 includes a drain pan 9*a* that temporarily stores water droplets dripped from the heat exchanger 7, a tongue portion 9*b* facing the impeller 8*a*, and a front guide 9*c* that defines the front surface of an outlet flow path 11. The rear guide 10 has a helical shape, for example, and defines the rear surface of the outlet flow path 11. Vertical wind direction vanes 4*a* and horizontal wind direction vanes 4*b* are rotatably attached to the air outlet 3 so as to change the direction of air to be sent into the room. In FIG. 2, reference character O indicates the rotational center of the impeller 8*a*; E1 indicates the inlet region of the impeller 8*a*; and E2 indicates the outlet region of the impeller 8*a* located at the opposite side of the inlet region E1 with respect to the rotational center O. The inlet region E1 and the outlet region E2 are separated from each other at the tongue portion 9*b* of the stabilizer 9 and an airflow upstream end of the rear guide 10. Further, RO indicates the rotational direction of the impeller 8*a*.

In the indoor unit 1 of the air-conditioning apparatus having the configuration described above, when a controller having a power board applies a current to a motor that rotates the impeller 8*a*, the impeller 8*a* rotates in the RO direction. Thus, the air in the room is suctioned through the air inlet grille 2 provided at the upper portion 1*a* of the indoor unit, and dust is removed from the air by the electrostatic precipitator 5 and the filter 6. Subsequently, the air undergoes a heating operation, a cooling operation, or a dehumidifying operation by being heated, cooled, or dehumidified, respectively, by the heat exchanger 7, and is suctioned from the inlet region E1 into the impeller 8*a* of the cross flow fan 8. The airflow flows through the inside of the impeller 8*a*, is blown out from the impeller 8*a* into the outlet region E2, is guided to the air outlet 3 by the outlet flow path 11 defined by the rear guide 10 located at the rear side, the front guide 9*c* located at the front side, and the opposite side surfaces of the casing of the indoor unit 1, and is blown out into the room so as to condition the air in the room. The wind direction of the air to be blown out is controlled in the vertical and horizontal directions by the vertical wind direction vanes 4*a* and the horizontal wind direction vanes 4*b*, respectively.

Figure 3:
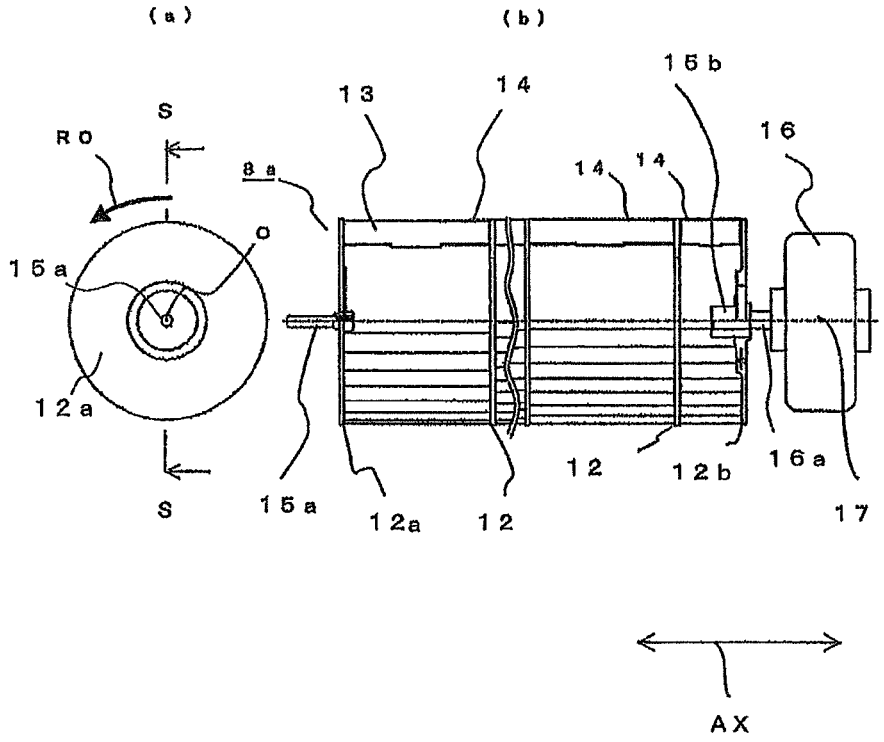
FIG. 3 is a schematic diagram illustrating an impeller of the cross flow fan according to Embodiment 1 of the present invention, wherein FIG. 3(*a*) is a side view of the cross flow fan, and FIG. 3(*b*) is a cross-sectional view taken along line S-S of FIG. 3(*a*).
Figure 4:
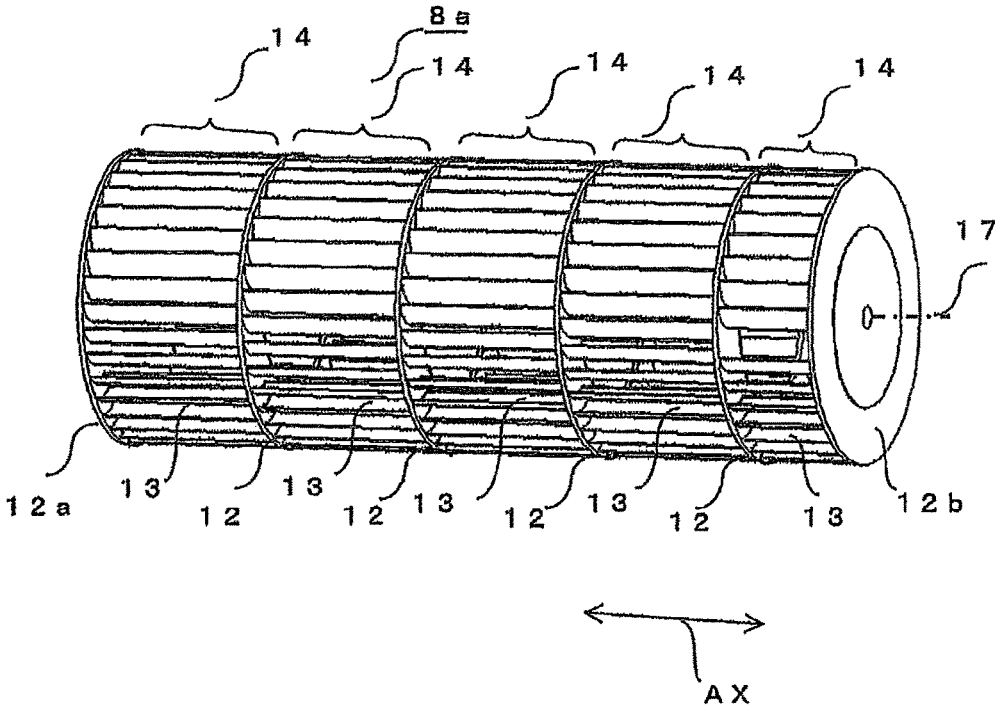
FIG. 4 illustrates Embodiment 1 of the present invention, in which an enlarged perspective view (FIG. 4(*a*)) illustrates the impeller including five impeller elements fixed to each other in a rotational axis direction, and an illustrative diagram (FIG. 4(*b*)) shows a support plate.
Figure 4:
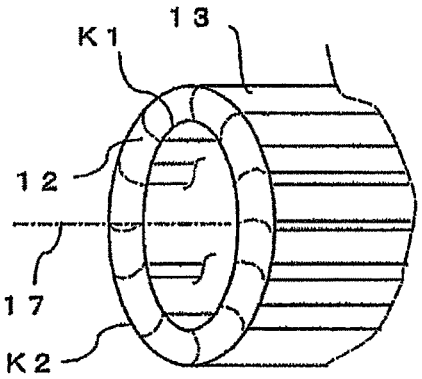
Figure 14:
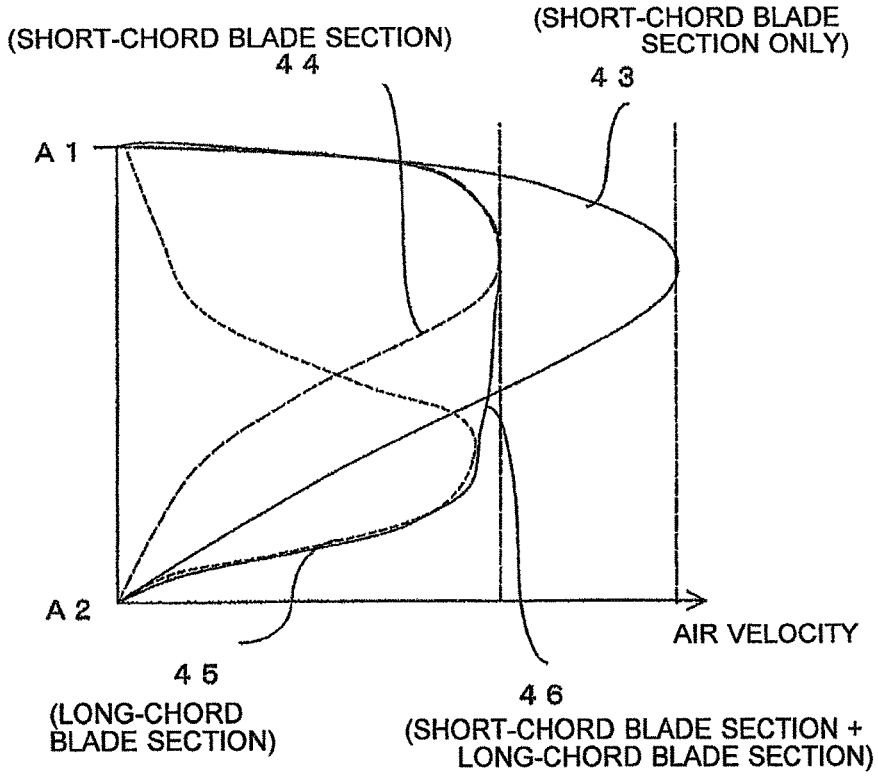
FIG. 14 is a characteristic graph showing the air velocity at the air outlet according to Embodiment 1 of the present invention, in which the horizontal axis represents the air velocity and the vertical axis represents the positions of upper side (A1) and the lower side (A2).

FIG. 3 is a schematic diagram illustrating the impeller 8*a* of the cross flow fan 8 according to Embodiment 1. More specifically, FIG. 3(*a*) is a side view of the cross flow fan 8, and FIG. 3(*b*) is a cross-sectional view taken along line S-S of FIG. 3(*a*). The lower half of FIG. 3(*b*) shows a plurality of blades on the far side, whereas the upper half shows one blade 13. FIG. 4(*a*) is an enlarged perspective view illustrating the impeller 8*a* including five impeller elements 14 fixed to each other in a rotational axis direction AX, and FIG. 4(*b*) is an illustrative diagram showing a support plate. In FIG. 4, a motor 16 and a motor shaft 16*a* are not shown. The number of the impeller elements 14 of the impeller 8*a* is not limited to the number illustrated in the drawings, and may be any number. Further, the number of the blades 13 of each impeller element 14 is not limited to the number illustrated in the drawings, and may be any number. In FIG. 14(*b*), only some of the blades 13 are shown for ease of explanation.

As illustrated in FIGS. 3 and 4, the impeller 8*a* of the cross flow fan 8 includes a plurality of, for example, five, impeller elements 14 in the rotational axis direction AX (a longitudinal direction of the cross flow fan). The circular support plate 12 is fixed to an end of each impeller element 14, and the plurality of blades 13 extending in the rotational axis direction AX are disposed along the outer circumference of the support plate 12. The plurality of impeller elements 14 formed of, for example, thermoplastic resin such as AS resin and ABS resin are provided in the rotational axis direction AX, and the ends of the blades 13 are joined to the support plate 12 of the adjacent impeller element 14 by, for example, ultrasonic welding. An end plate 12*b* disposed at the other end is a circular plate, on which no blade 13 is provided. A fan shaft 15*a* is provided at the center of a support plate 12*a* disposed at one end in the rotational axis direction AX. A fan boss 15*b* is provided at the center of the end plate 12*b* disposed at the other end. The fan boss 15*b* and the motor shaft 16*a* of the motor 16 are fixed to each other by a screw or the like. That is, the support plate 12*a* and the end plate 12*b* disposed at the opposite ends of the impeller 8*a* in the rotational axis direction AX have the shape of a circular plate, and the fan shaft 15*a* and the fan boss 15*b* are formed at the center where the rotational axis 17 is located. The support plates 12, excluding those at the opposite ends, have a circular shape with a hollow center portion where the rotational axis 17 as the rotational center is located, and have an inner diameter K1 and an outer diameter K2 as illustrated in FIG. 4(*b*). In FIG. 4(*b*), not all blades are shown, and only twelve blades are illustrated. In FIG. 3(*b*) and FIG. 4(*b*), the one-dot chain line is an imaginary rotational axis connecting the motor shaft 16*a* to the fan shaft 15*a* and indicating a rotational center O, and is defined as the rotational axis 17.

Figure 5:
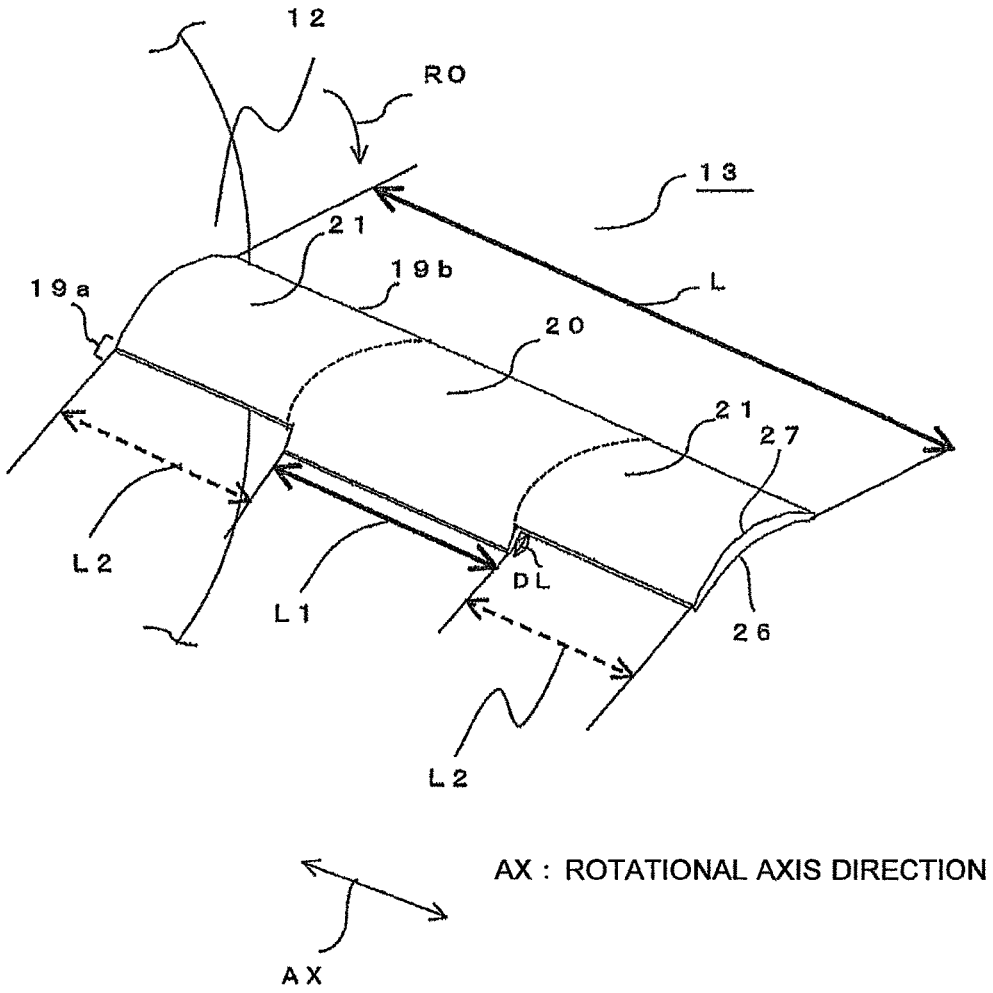
FIG. 5 is a perspective view illustrating a blade attached to an impeller element according to Embodiment 1 of the present invention.

Next, the shape of the blades 13 according to Embodiment 1 will be described in detail. FIG. 5 is a perspective view illustrating the blade 13 attached to the impeller element 14 of the cross flow fan 8. The blade 13 is fixed at opposite ends in the rotational axis direction AX to the support plates 12 by welding. In FIG. 5, a part of the support plate 12 on one side is shown. The surface of the blade 13 facing the rotational direction which receives pressure during rotation is a blade pressure surface 26, and the surface on the opposite side of the blade pressure surface 26 which becomes a negative pressure state during rotation is a blade pressure suction surface 27. Further, the edge located at the inner circumferential side of the support plate 12 is a blade inner-circumferential edge 19*a*, and the edge located at the outer circumferential side of the support plate 12 is a blade outer-circumferential edge 19*b*.

Further, the blade 13 does not have a uniform shape in the rotational axis direction AX (longitudinal direction), and is divided into three sections, which are a long-chord blade section 20 at the center, and short-chord blade sections 21 at the opposite ends. The long-chord blade section 20 has a chord having a length greater than a length of chords of the short-chord blade sections 21 and protrudes toward the inner circumferential side at the blade inner-circumferential edge 19*a*. In Embodiment 1, for example, L1=L2, in which L is the length of the blade 13 of the impeller element 14 in the rotational axis direction AX; L1 is the length of the long-chord blade section 20 in the rotational axis direction AX; and L2 is the length of the short-chord blade section 21 in the rotational axis direction AX. That is, the long-chord blade section 20 is disposed at the center of the blade 13 in the rotational axis direction AX and has a length of ⅓ of the entire length.

Figure 6:
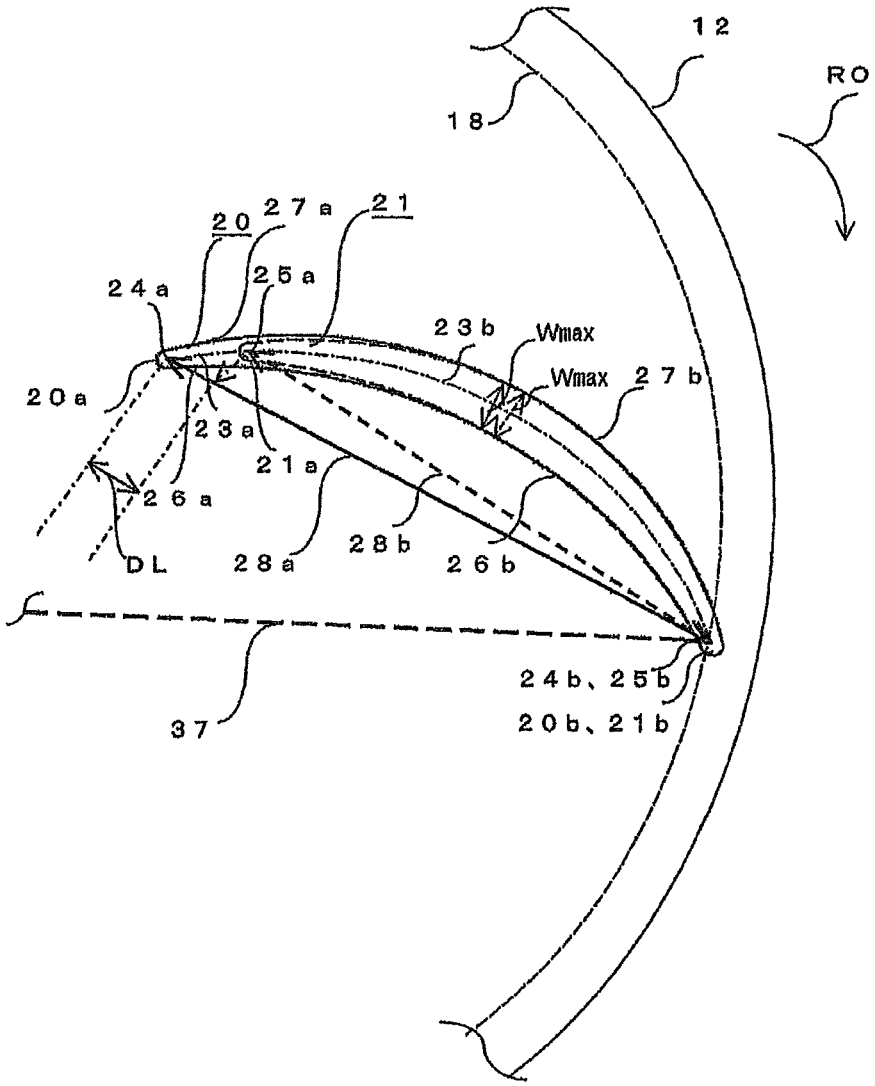
FIG. 6 is an illustrative diagram showing the cross sections of a long-chord blade section and a short-chord blade section perpendicular to a rotational axis in a superimposed manner according to Embodiment 1 of the present invention.

FIG. 6 illustrates cross-sectional shapes of the long-chord blade section 20 and the short-chord blade section 21 of the blade 13. FIG. 6 is an illustrative diagram showing the cross sections of the long-chord blade section 20 and the short-chord blade section 21 perpendicular to the rotational axis 17 in a superimposed manner. In the cross sections of the long-chord blade section 20 and the short-chord blade sections 21, the center line between the blade pressure surface 26 and the blade pressure suction surface 27 is a camber line 23. This camber line 23 has an arcuate shape, for example. A camber line 23*a* of the long-chord blade section 20 is formed by extending a camber line 23*b* of the short-chord blade section 21 toward the inner circumferential side while maintaining the arcuate shape thereof. Blade inner-circumferential edges 20*a* and 21*a* and blade outer-circumferential edges 20*b* and 21*b* of the long-chord blade section 20 and the short-chord blade sections 21 have the shape of substantial arcs of circles having centers at points 24*a*, 25*a*, 24*b*, and 25*b*, respectively, on the camber lines 23*a* and 23*b*. The blade inner-circumferential edge 19*a* in FIG. 5 indicates the blade inner-circumferential edges 20*a* and 21*a* in FIG. 6, and the blade outer-circumferential edge 19*b* in FIG. 5 indicates the blade outer-circumferential edges 20*b* and 21*b* in FIG. 6. The blade inner-circumferential edge 19*a* and the blade outer-circumferential edge 19*b* are referred to when describing the blade 13 having a plurality of blades, and the blade inner-circumferential edges 20*a* and 21*a* and the blade outer-circumferential edges 20*b* and 21*b* are referred to when describing the long-chord blade section 20 and the short-chord blade sections 21, respectively. The long-chord blade section 20 includes a blade pressure surface 26*a* and a blade pressure suction surface 27*a*, and the short-chord blade section 21 includes a blade pressure surface 26*b* and a blade pressure suction surface 27*b*. Since the blade outer-circumferential edges 20*b* and 21*b* have the same shape, the centers 24*b* and 25*b* are located at the same position. The blade inner-circumferential edges 20*a* and 21*a* have the shape of arcs of circles of the same radius having the centers 24*a* and 25*a*, respectively. The long-chord blade section 20 has the same maximum width as a maximum width (hereinafter referred to as a blade thickness) Wmax of the short-chord blade section 21 between the blade pressure surface 26*b* and the blade pressure suction surface 27*b*. The arcuate camber line 23*a* is formed between the center 24*b* of the blade outer-circumferential edge 20*b* and the center 24*a* of the blade inner-circumferential edge 20*a* such that the blade pressure surface 26*a* and the blade pressure suction surface 27*a* become smooth. A chord is a line segment connecting a blade outer-circumferential edge and a blade inner-circumferential edge. A chord 28*a* of the long-chord blade section 20 is a line segment connecting the center 24*b* of the arc of the blade outer-circumferential edge 20*b* and the center 24*a* of the arc of the blade inner-circumferential edge 20*a*. Similarly, a chord 28*b* of the short-chord blade section 21 is a line segment connecting the center 25*b* of the arc of the blade outer-circumferential edge 21*b* and the center 25*a* of the arc of the blade inner-circumferential edge 21*a*. In FIG. 6, the chord 28*a* of the long-chord blade section 20 is indicated by the solid straight line, and the chord 28*b* of the short-chord blade section 21 is indicated by the dotted straight line. The length of the chord 28*a* of the long-chord blade section 20 is greater than the length of the chord 28*b* of the short-chord blade section 21, and this difference in length is DL. More specifically, the difference DL is the difference DL from the chord 28*a* of the long-chord blade section 20 when the chord 28*b* of the short-chord blade section 21 is rotated about the center 25*b* as indicated by the arrow. In the plurality of blades 13 of the impeller element 14, in the cross section perpendicular to the rotational axis 17, the circumference of the circle of the same diameter having the center at the rotational center O of the impeller 8*a*, that is, at the position of the rotational axis 17 and connecting the centers 24*b* and 25*b* of the arcs of the blade outer-circumferential edges 20*b* and 21*b*, respectively, is defined as an outer diameter line 18, and is indicated by the dotted line. In Embodiment 1, in the plurality of blades 13 of the impeller element 14, the blade outer-circumferential edges 20*b* and 21*b* have the same shape, and the outer diameter line 18 passing the centers 24*b* and 25*b* thereof form a single circle. A dotted line 37 is a line connecting the rotational center O of the impeller 8*a* and the centers 24*b* and the 25*b* of the arcs of the blade outer-circumferential edges 20*b* and 21*b*, respectively. Since the blade inner-circumferential edge 20*a* of the long-chord blade section 20 is formed by extending the blade inner-circumferential edge 21*a* of the short-chord blade section 21 toward the dotted line 37, the chord 28*a* of the long-chord blade section 20 is longer than the chord 28*b* of the short-chord blade section 21 by DL, and is closer to the dotted line 37.

An example of each length of the blade used in Embodiment 1 will be described below.

The outer diameter of the circular support plate 12 is fixed with the plurality of blades 13 at the end of the impeller element 14 is Φ110 mm, and the inner diameter is ϕ60 mm, and a plurality of, for example, thirty five, blades 13 are fixed on the circumferential surface of the support plate 12. In each blade 13, the chord 28*a* of the long-chord blade section 20 is longer by DL=2 mm than the chord 28*b* of the short-chord blade section 21 so as to protrude toward the inner circumference. Further, in the rotational axis direction AX, the length L of the blade of the impeller element 14=90 mm; the length L1 of the long-chord blade section 20=30 mm; and the length L2 of the short-chord blade section 21=30 mm, for example.

Figure 7:
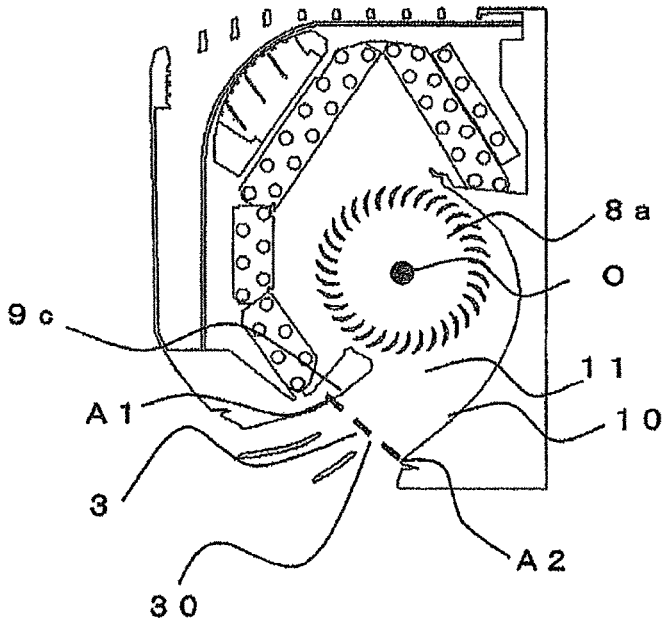
FIG. 7 is an illustrative diagram showing an air outlet according to Embodiment 1 of the present invention, in which FIG. 7(*a*) shows a vertical cross section of an indoor unit, and FIG. 7(*b*) shows the air outlet with respect to one impeller element.
Figure 7:
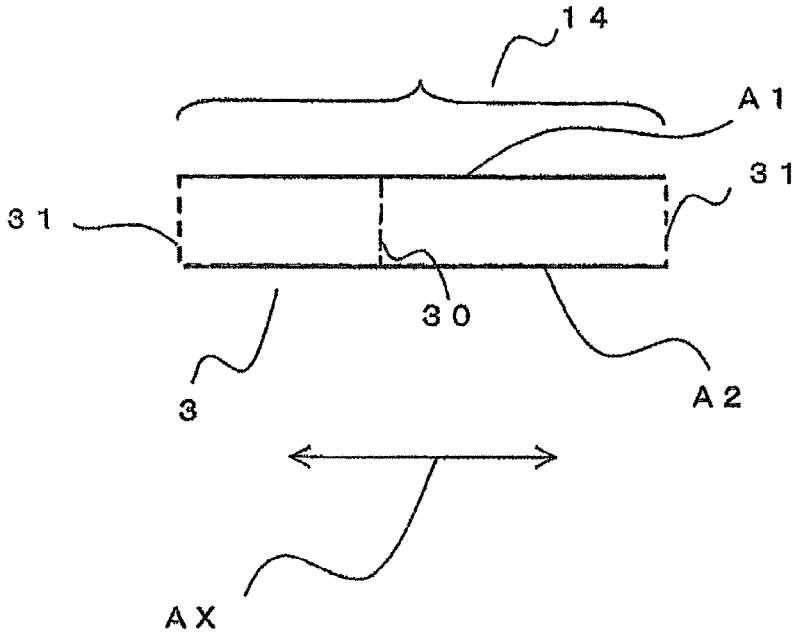

In the following, the operations of the blades 13 according to Embodiment 1 will be described in detail. In Embodiment 1, the shape of the blade inner-circumferential edge 21*a* of the short-chord blade section 21 is set on the basis of the average flow of the air that is expected in advance in accordance with the configuration of the inlet side in the outlet region E2 of the cross flow fan 8 and the shape of the outlet flow path 11. FIG. 7 is an illustrative diagram showing the air outlet 3, in which FIG. 7(*a*) shows a vertical cross section of the indoor unit 1, and FIG. 7(*b*) shows the air outlet 3 with respect to one of the impeller elements 14. In reality, in the case where the impeller 8*a* includes five impeller elements 14, the length in the rotational axis direction AX is approximately five times the length shown in FIG. 7(*b*). As illustrated in FIG. 7(*a*), a straight line 30 is drawn from an end A2 of the rear guide 10 at the downstream side of the airflow toward the front guide 9*c* in a direction perpendicular to the inclination of the position of the end A2. The point at which the straight line 30 intersects the front guide 9*c* is indicated by A1. When the indoor unit 1 of the air-conditioning apparatus is viewed from obliquely downward in front, the air outlet 3 has a substantially rectangular shape as illustrated in FIG. 7(*b*), in which the upper side is located at A1; the lower side is located at A2; and opposite vertical sides 31 are located at the positions of two of the support plates 12, the support plate 12*a*, and the end plate 12*b* that are located at the opposite ends of the impeller element 14. The vertical length is the length of the straight line 30, that is, the distance between A1 and A2. The lateral length is the length in the rotational axis direction AX (longitudinal direction) of the impeller element 14.

Figure 8:
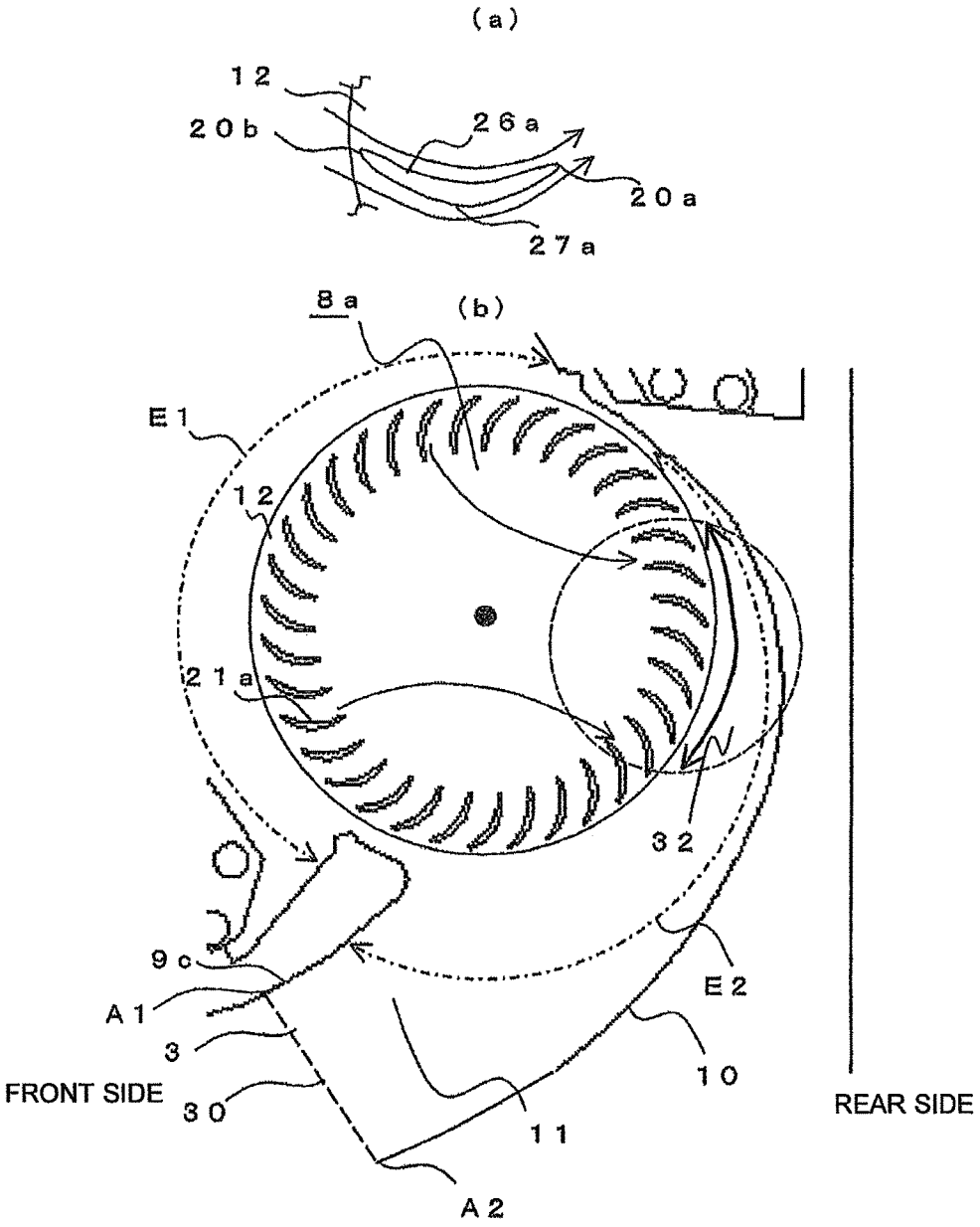
FIG. 8 is an illustrative diagram showing an airflow over a long-chord blade section according to Embodiment 1 of the present invention.

As illustrated in FIG. 2, the airflow having been air-conditioned by the heat exchanger 7 passes between the blades of the impeller 8*a* in the inlet region E1, passes through the inside of the impeller 8*a*, passes between the blades in the outlet region E2 at the opposite side with respect to the rotational center O, and passes through the outlet flow path 11 toward the air outlet 3. The flow of air inside the impeller 8*a* greatly depends on the shape of the blade inner-circumferential edges 20*a* and 21*a*. More specifically, the shape of the blade inner-circumferential edges 20*a* and 21*a* determines the direction in which the airflow heads toward the blades in the outlet region E2. The difference between the airflow over the long-chord blade section 20 and the airflow over the short-chord blade section 21 will now be described with reference to the drawings. FIG. 8(*a*) is an illustrative diagram showing the airflow passing between blades of the long-chord blade sections 20 in the inlet region E1 and flowing into the inside of the impeller 8*a*. FIG. 8(*b*) is an illustrative diagram showing the airflow inside the impeller 8*a*. As illustrated in FIG. 8(*a*), the airflow flows from the blade outer-circumferential edge 20*b* of the long-chord blade section 20, flows along the blade pressure surface 26*a* and the blade pressure suction surface 27*a* of the long-chord blade section 20, and flows in a direction of the solid arrows in accordance with the shape of the blade inner-circumferential edge 20*a*. Then, as indicated by the solid line in FIG. 8(*b*), the airflow passes between the blades at the outlet side, and is blown out from the vicinity of a region 32 of the outlet region E2 into the outlet flow path 11.

Figure 9:
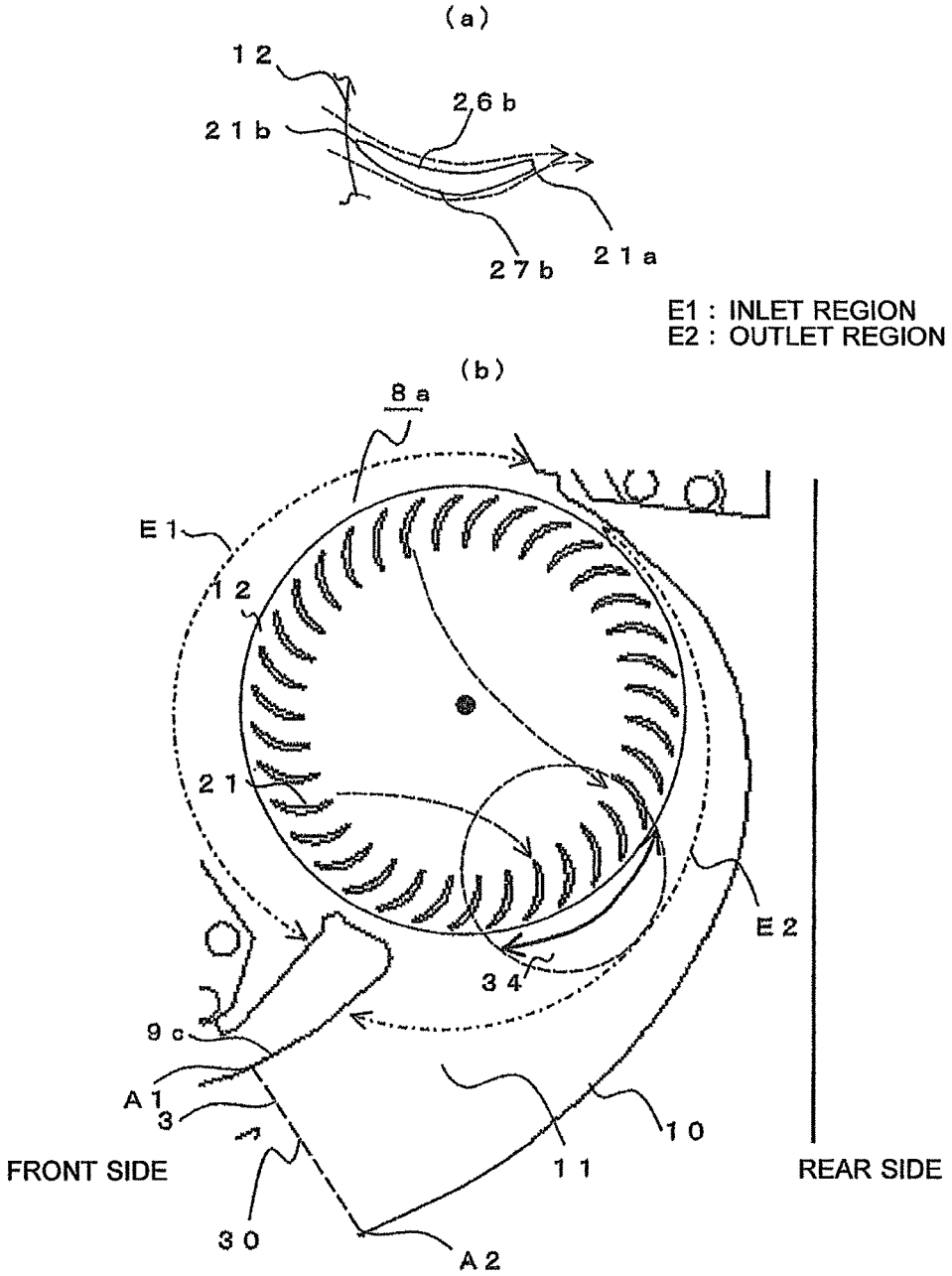
FIG. 9 is an illustrative diagram showing an airflow over a short-chord blade section according to Embodiment 1 of the present invention.

FIG. 9(*a*) is an illustrative diagram showing the airflow passing between blades of the short-chord blade sections 21 in the inlet region E1 and flowing into the inside of the impeller 8*a*. FIG. 9(*b*) is an illustrative diagram showing the airflow inside the impeller 8*a*. As illustrated in FIG. 9(*a*), the airflow flows from the blade outer-circumferential edge 21*b* of the short-chord blade section 21, flows along the blade pressure surface 26*b* and the blade pressure suction surface 27*b* of the short-chord blade section 21, and flows in a direction of the dotted arrows in accordance with the shape of the blade inner-circumferential edge 21*a*. Then, as indicated by the dotted line in FIG. 9(*b*), the airflow passes between the blades at the outlet side, and is blown out from the vicinity of a region 34 of the outlet region E2 into the outlet flow path 11.

In the following, a comparison will be made between the flow over the long-chord blade section 20 (FIG. 8) and the flow over the short-chord blade section 21 (FIG. 9). On the long-chord blade section 20, the airflow is directed in the upper right direction in FIG. 8(*a*) by the blade inner-circumferential edge 20*a*, and flows toward between the blades at the outlet side. On the other hand, compared with the airflow over the long-chord blade section 20, the airflow over the short-chord blade section 21 is directed only slightly upward by the blade inner-circumferential edge 21*a*, flows in the lower right direction, and then flows toward between the blades at the outlet side. Therefore, the airflow over the long-chord blade section 20 mainly flows into between the blades in the region 32 at the rear side of the outlet region E2, and then flows from between the blades to the outlet flow path 11. The airflow blown out from the region 32 flows along the rear guide 10 at the rear side, and is blown out from the area below the center of the air outlet 3. On the other hand, the airflow over the short-chord blade section 21 mainly flows into between the blades in a region 34 at the front side of the outlet region E2, and then flows from between the blades to the front side of the outlet flow path 11. The airflow blown out from the region 34 flows through the center portion between the rear guide 10 and the front guide 9*c* of the outlet flow path 11, and is blown out from the area slightly above the center of the air outlet 3. That is, the direction of the airflow heading toward the blades at the outlet side varies in accordance with the shape of the blade inner-circumferential edges 20*a* and 21*a*. Therefore, the position from which the airflow having reached the air outlet 3 is blown out varies. That is, the airflow from the long-chord blade section 20 mainly flows to the lower side, while the airflow from the short-chord blade section 21 mainly flows to the upper side.

Figure 10:
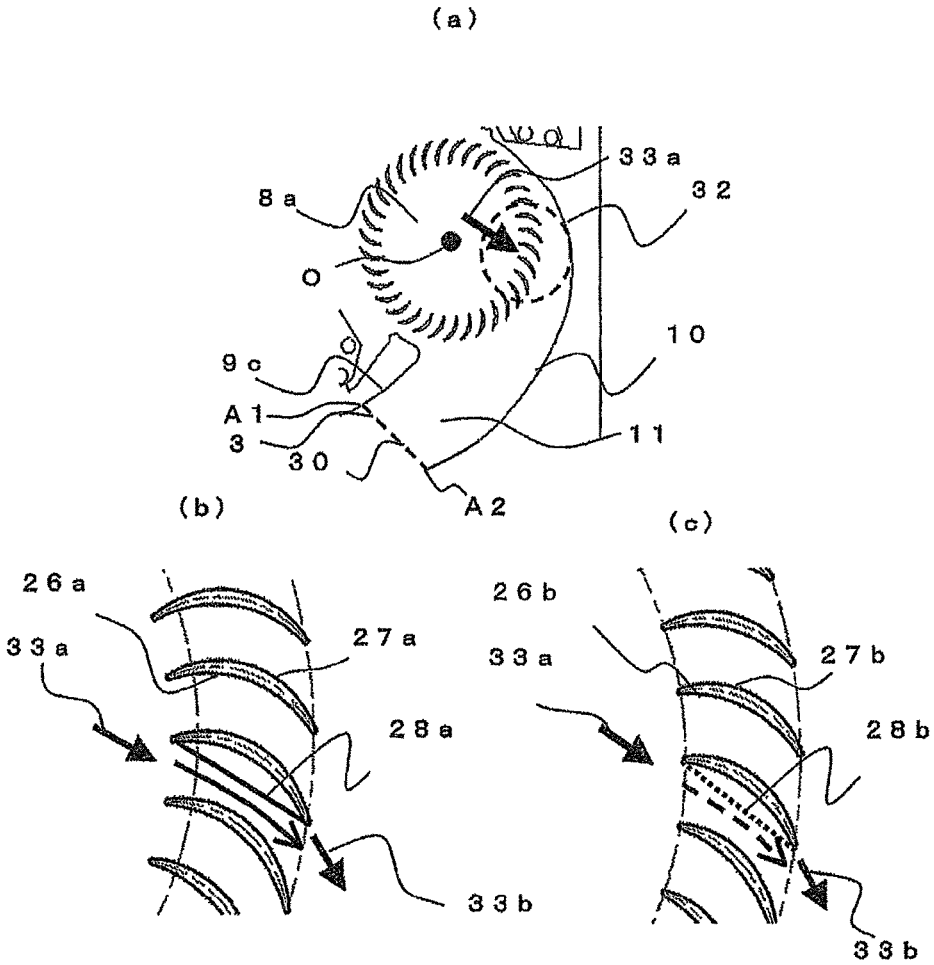
FIG. 10 is an illustrative diagram showing an airflow in the vicinity of a region 32 according to Embodiment 1 of the present invention.

The flow of air between blades in the vicinity of the region 32 will now be further described with reference to FIG. 10. FIG. 10 is an illustrative diagram showing the flow of air flowing into between blades in the outlet region E2. As illustrated in FIG. 10(*a*), in the vicinity of the region 32, the airflow suctioned from the inlet region E1 into the impeller 8*a* flows in a direction of an arrow 33*a*. FIG. 10(*b*) illustrates an airflow vector (arrow 33*a*) flowing into between the blades of the long-chord blade sections 20, and an airflow vector (arrow 33*b*) flowing out from between the blades thereof. FIG. 10(*c*) illustrates an airflow vector (arrow 33*a*) flowing into the short-chord blade sections 21, and an airflow vector (arrow 33*b*) flowing out from between the blades thereof. This airflow vector (arrow 33*a*) indicates the relative velocity in a coordinate system of the rotating blades. In both cases of the long-chord blade section 20 and the short-chord blade section 21, the airflow vector (arrow 33*a*) flowing into between the blades has a flow characteristics that the flow is substantially parallel to the chords 28*a* and 28*b*, respectively. That is, the difference in the direction between the airflow vector direction 33*a* flowing into between the blades and the airflow vector direction 33*b* flowing out therefrom is small, and the airflow resistance between the blades at the long-chord blade sections 20 and the airflow resistance between the blades at the short-chord blade sections 21 are substantially the same. However, the long-chord blade section 20 has a greater total blade area of the blade pressure surface 26*a* and the blade pressure suction surface 27*a* than the short-chord blade section 21, and therefore imparts greater energy to the airflow that is to be blown out. Thus, the outlet air velocity of the long-chord blade section 20 becomes higher. That is, in the region 32, as illustrated in FIG. 8, because the airflow having passed through between the blades of the long-chord blade sections 20 and been directed upward mainly flows, and also because the long-chord blade section 20 has a greater blade area, the air velocity is further increased.

Figure 11:
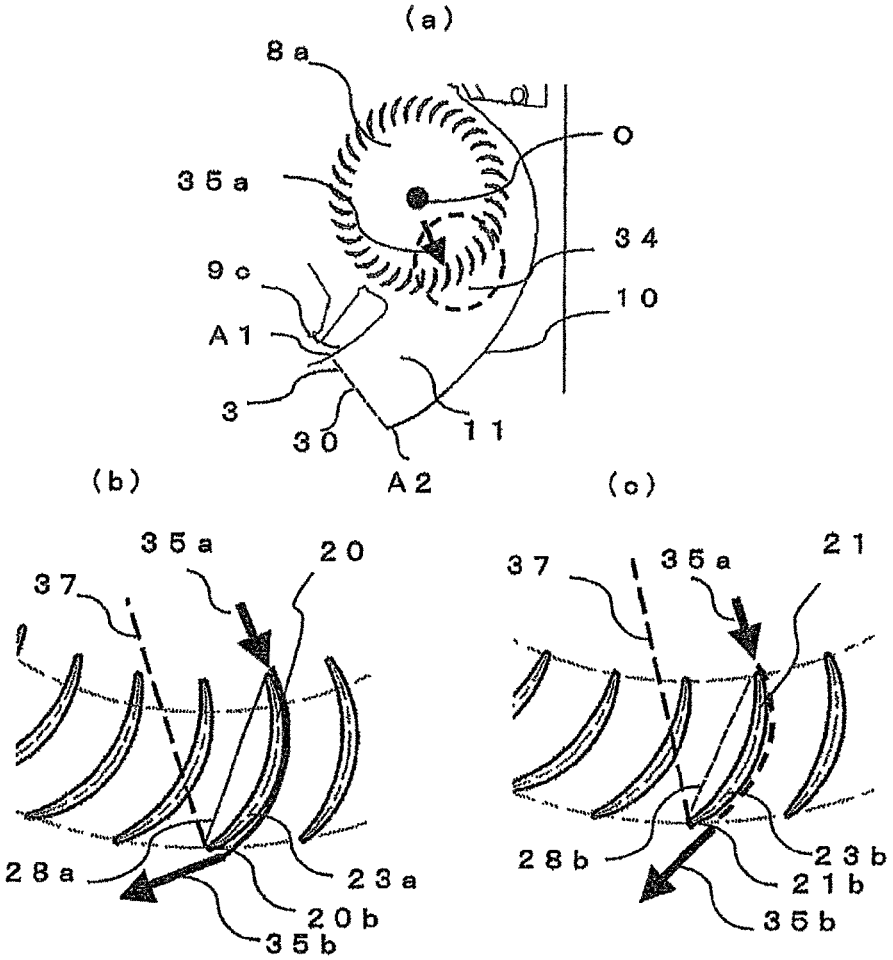
FIG. 11 is an illustrative diagram showing an airflow in the vicinity of a region 34 according to Embodiment 1 of the present invention.

Next, the flow of air between blades in the vicinity of the region 34 will be described with reference to FIG. 11. FIG. 11 is an illustrative diagram showing the flow of air flowing into between blades in the outlet region E2. As illustrated in FIG. 11(*a*), in the vicinity of the region 34, the airflow suctioned from the inlet region E1 into the impeller 8*a* flows in a direction of an arrow 35*a*. FIG. 11(*b*) illustrates an airflow vector (arrow 35*a*) flowing into between the blades of the long-chord blade sections 20, and an airflow vector (arrow 35*b*) flowing out from between the blades thereof. FIG. 11(*c*) illustrates an airflow vector (arrow 35*a*) flowing into the short-chord blade sections 21, and an airflow vector (arrow 35*b*) flowing out from between the blades thereof. The airflow vector (arrow 35*a*) flowing into between the blades is substantially parallel to the line segment 37 connecting the rotational center O and the blade outer-circumferential edges 20*b* and 21*b*.

As illustrated in FIGS. 11(*b*) and (*c*), the airflow vector (arrow 35*a*, the relative velocity in a coordinated system of the rotating blades) flowing into between the blades has characteristics that the flow is along the camber lines 23*a* and 23*b* of the blades. That is, if the long-chord blade section 20 is compared with the short-chord blade section 21, the long-chord blade section 20 has the longer camber line 23*a*, and therefore has a greater deflection angle of the airflow from the airflow vector (arrow 35*a*) to the airflow vector (arrow 35*b*) upon passage between the blades. Accordingly, the airflow resistance between the blades is greater at the long-chord blade sections 20 than at the short-chord blade sections 21. As a result, the outlet air velocity of the short-chord blade section 21 becomes higher. That is, in the region 34, as illustrated in FIG. 9, because the airflow having passed through between the blades of the short-chord blade sections 21 mainly flows, and also because the airflow resistance between the blades is less at the short-chord blade sections 21 than at the long-chord blade sections 20, the air velocity is further increased.

Figure 12:
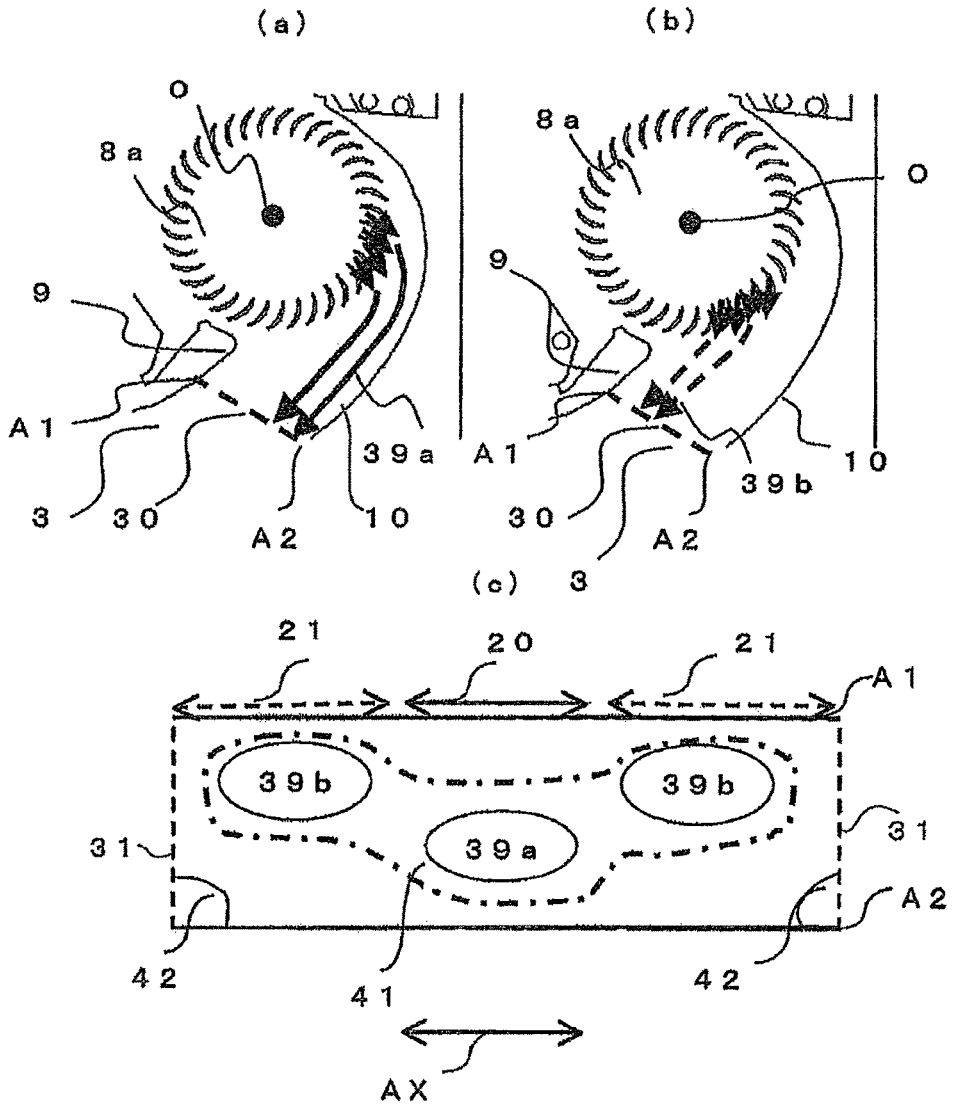
FIG. 12 is an illustrative diagram showing an airflow at an air outlet in an impeller element according to Embodiment 1 of the present invention.

On the basis of the above description, the airflow at the air outlet 3 in the impeller element 14 will be described with reference to FIG. 12. FIG. 12(*a*) illustrates an airflow flowing between the long-chord blade sections 20. An airflow 39*a* flows near the rear guide 10, and is blown out from a portion close to A2 of the air outlet 3. FIG. 12(*c*) illustrates the distribution of the airflow blown out from the air outlet 3, in which the lateral length of the rectangular air outlet 3 is corresponds to the length of the impeller element 14 in the rotational axis direction AX. In the center portion (indicated by the solid line) where the long-chord blade section 20 is formed, the airflow 39*a* is blown out from the area below the center between A1 and A2 in the vertical direction. FIG. 12(*b*) illustrates an airflow flowing between the short-chord blade sections 21. An airflow 39*b* flows through a portion close to A1 than the center between A1 and A2 and is blown out from the air outlet 3. As illustrated in opposite ends (indicated by the dotted lines) where the short-chord blade sections 21 are formed in FIG. 12(*c*), the airflow 39*b* is blown out from the area above the center between A1 and A2 in the vertical direction.

As described above, since the blade 13 includes the long-chord blade section 20 and the short-chord blade sections 21 having chords of different lengths, it is possible to vary the outlet direction of the airflow in the vertical direction in the outlet flow path 11 and thus to obtain the airflow that is widely spread across the air outlet 3. In this description, "the airflow is dispersed by the long-chord blade section 20 and the short-chord blade sections 21 having chords of different lengths" indicates that the airflow having flowed between the blades in the inlet region E1 flows into between the blades of different portions in the outlet region E2 and is blown out into the outlet flow path 11.

The airflows 39*a* and 39*b* illustrated in FIG. 12(*c*) indicate the area of the airflow with a velocity close to the maximum velocity of the airflow blown out of the impeller 8*a*, for example, with a velocity of (the maximum velocity −5%).

The region indicated by the one-dot chain line indicates the area of the airflow with a velocity higher than the average air velocity of the airflow blown out from the impeller 8*a* as a high-speed flow region 41. The area with a very low velocity that is, for example, 10% of the average air velocity or less is indicated as a low-speed flow region 42.

Figure 13:
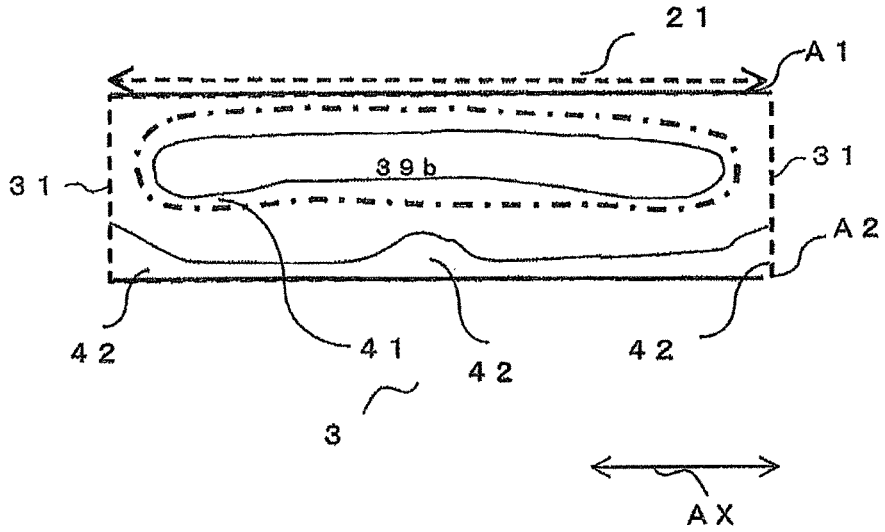
FIG. 13 is an illustrative diagram showing the air velocity distribution of an airflow at an air outlet according to a comparative example of Embodiment 1 of the present invention.

As a comparative example, FIG. 13 illustrates the distribution of the airflow at the air outlet 3 in the case where the impeller element 14 includes only one type of blade having a single chord length, that is, a blade having the same width in the rotational axis direction AX, for example, only the short-chord blade section 21, according to a conventional technique. In the case where only the short-chord blade section 21 is provided, the air velocity distribution of the airflow is shifted toward the A1 side, that is, toward the upper side of the center between A1 and A2. Further, in the outlet region E2, the airflow in the direction in which the air easily flows is concentrated between the blades in accordance with the direction of the blade inner-circumferential edge 21*a* of the short-chord blade section 21. Further, the high-speed flow region 41 is limited to the vicinity of the airflow 39*b* and is not very large. On the other hand, the low-speed flow region 42 is large. This indicates that the airflow is locally concentrated at the air outlet 3. If the airflow in a predetermined flow direction is concentrated between the blades as described above, the maximum air velocity is increased. Then, the energy loss increases with the square of the air velocity, and the noise level increases with the sixth power of the air velocity. Similarly, in the case where the blade including only the long-chord blade sections 20 is used, the airflow is shifted toward the lower side of the center between A1 and A2, and is concentrated in that area. Thus, the maximum air velocity is increased.

On the other hand, in Embodiment 1, since the blade includes the long-chord blade section 20 and the short-chord blade sections 21 of two different chord lengths, the airflow flowing from the inlet region E1 to the outlet region E2 can be vertically dispersed in the outlet flow path 11. The long-chord blade section 20 blows out the air toward the lower side, and the short-chord blade section 21 blows the air toward the upper side, so that the outlet area between A1 and A2 is increased. Thus, the high-speed flow region 41 is expanded into a substantially V shape as illustrated in FIG. 12(*c*), and hence the air velocity distribution is made uniform. Further, the flow in the expanded high-speed flow region 41 flows while drawing in the low-speed flow therearound, so that the area of the low-speed flow region 42 is reduced. Accordingly, in the case of sending the same volume of air, it is possible to reduce the value of the maximum air velocity at the air outlet 3, to reduce the overall workload of the fan, and to reduce the noise level that is proportional to a power of the air velocity.

FIG. 14 is a characteristic graph in which the horizontal axis represents the air velocity and the vertical axis represents the positions of the upper side (A1) and the lower side (A2) of the air outlet 3. As reference data, the graph in the case where only a short-chord blade section 21 is provided is indicated by a solid curve 43, in which the air velocity is locally greatly concentrated at the A1 side. In the cross flow fan according to Embodiment 1, the air velocity distribution of the airflow generated by the long-chord blade section 20 is indicated by a dotted curve 45, and the air velocity distribution of the airflow generated by the short-chord blade section 21 is indicated by a dotted curve 44. A solid curve 46 includes the dotted curve 44 indicating the air velocity by the short-chord blade section 21 and the dotted curve 45 indicating the air velocity by the long-chord blade section 20, and is the plot of the value of the maximum air velocity in each position in the rotational axis direction AX when the air outlet 3 of the impeller element 14 is viewed from the side. If the maximum air velocity distribution (solid curve 46) at the air outlet 3 according to Embodiment 1 is compared with the maximum air velocity distribution (solid curve 43) in the case where only the short-chord blade sections 21 are provided, the solid curve 46 is wider than the solid curve 43 between A1 and A2, which indicates that the air velocity distribution is made uniform and the value of the maximum air velocity is reduced.

Figure 15:
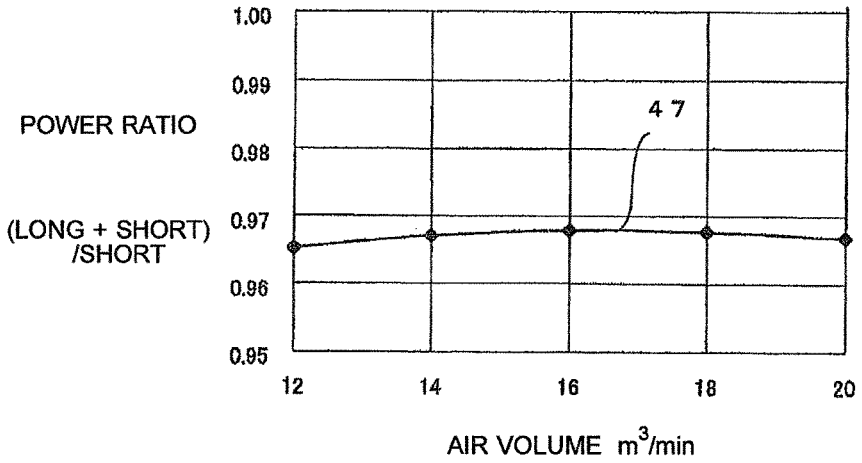
FIG. 15 is a characteristic graph showing the power ratio with respect to the air volume according to Embodiment 1 of the present invention, in which the horizontal axis represents an air volume ($m^3$/min) and the vertical axis represents the power ratio, which is "{power of the configuration of (long-chord blade section+short-chord blade section)}/{power of the configuration of short-chord blade section only}".
Figure 16:
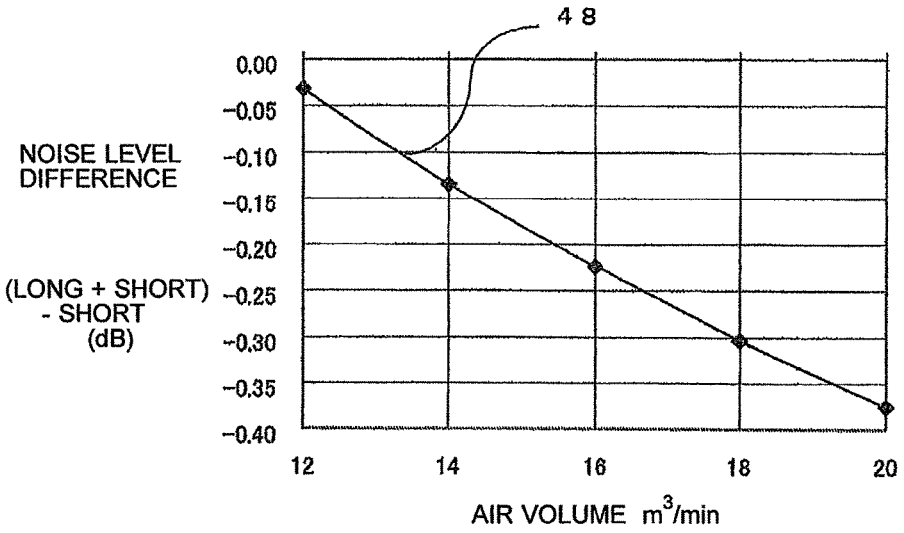
FIG. 16 is a characteristic graph showing the noise level difference with respect to the air volume according to Embodiment 1 of the present invention, in which the horizontal axis represents an air volume ($m^3$/min) and the vertical axis represents the noise level difference, which is "{noise level of the configuration of (long-chord blade section+short-chord blade section)}−{noise level of the configuration of short-chord blade section only}".

FIGS. 15 and 16 are characteristic graphs each indicating the experiment results of an air-sending device in which the fan of Embodiment 1 is used at a rated air volume (18 $m^3$/min) of the indoor unit of the air-conditioning apparatus. In FIG. 15, the horizontal axis represents the air volume ($m^3$/min) and the vertical axis represents the power ratio, which is "{power of the configuration of (long-chord blade section+short-chord blade section)}/{power of the configuration of short-chord blade section only}". As indicated by a solid curve 47, the results showed that the torque load of the cross flow fan was reduced by approximately 3%. In FIG. 16, the horizontal axis represents the air volume ($m^3$/min) and the vertical axis represents the noise level difference, which is "{noise level of the configuration of (long-chord blade section+short-chord blade section)}−{noise level of the configuration of short-chord blade section only}". As indicated by a solid curve 48, the results showed that the noise level at the rated air volume (18 $m^3$/min) was reduced by about 0.3 dB. In FIGS. 15 and 16, the comparisons were made with one including only a short-chord blade section. However, the same applies to the case where a comparison is made with one including only a long-chord blade.

As described above, in Embodiment 1, the impeller 8*a* is provided that includes the plurality of impeller elements 14 each including the plurality of blades 13 disposed along an outer circumference of the circular support plate 12. The plurality of impeller elements 14 are fixed to each other in the direction AX of the rotational axis 17 passing through the center of the support plate 12. Each of the blades 13 is divided into a plurality of blade sections in the rotational axis direction AX. At least one of the divided blade sections as the long-chord blade section 20 is configured such that the chord 28*a* as a line segment connecting the blade outer-circumferential edge 20*b* and the blade inner-circumferential edge 20*a* of the blade 13 in a cross section perpendicular to the rotational axis 17 of the blade 13 has a greater length than the chord 28*b* of another one of the blade sections as the short-chord blade section 21. The blade inner-circumferential edge 20*a* of the blade section 20 having the longer chord 28*a* protrudes toward the inner circumferential side, relative to the blade inner-circumferential edge 21*a* of the blade section 21 having the shorter chord 28*b*. Thus, airflows are formed by the plurality of blade sections 20 and 21 in accordance with the shape of the blade inner-circumferential edges 20*a* and 21*a*, respectively. It is therefore possible to increase the area of the airflow toward the rear side and the front side mainly in the circumferential direction in the outlet region E2. Thus, the area of the high-speed flow region 41 of the airflow is expanded between the front guide 9*c* and the rear guide 10 at the air outlet 3, which makes the air velocity distribution uniform and reduces the maximum air velocity. Accordingly, it is possible to obtain a cross flow fan capable of reducing the energy loss and the noise level.

Especially, in Embodiment 1, since the long-chord blade section 20 is formed by extending the camber line of the short-chord blade section 21 so as to protrude toward the inner circumferential side, even if each blade 13 includes three blade sections 20 and 21 having at least two different chord lengths, the difference in the shape between the long-chord blade section 20 and the short-chord blade sections 21 can be made small. Accordingly, the airflow smoothly flows between the blades, and therefore the energy loss can be reduced.

That is, in Embodiment 1, in the cross section perpendicular to the rotational axis 17 of the blade 13, the center line between the blade pressure surface 26 as the front surface and the blade pressure suction surface 27 as the rear surface in the rotational direction of the blade 13 is defined as the camber lines 23*a* and 23*b*. The camber line 23*a* of the long-chord blade section 20 is formed by extending the camber line 23*b* of the short-chord blade section 21 at the blade inner-circumferential edge 19*a* toward the inner circumferential side so as to have an arcuate shape. Accordingly, the airflow is smoothly guided to between the blades in the inlet region E1, and the airflow is smoothly blown out from between the blades in the outlet region E2. Therefore, the energy loss is reduced, and the dispersion effect can be reliably obtained.

In the above description, the chord 28*a* of the long-chord blade section 20 is longer than the chord 28*b* of the short-chord blade section 21, and the difference in the chord length is DL=2 mm. However, the present invention is not limited thereto. The chord 28*a* of the long-chord blade section 20 may be longer by ⅛ through ⅓ of the length of the chord 28*b* of the short-chord blade section 21. For example, when the chord 28*b* of the short-chord blade section 21 is 12 mm, the chord 28*a* of the long-chord blade section 20 is 13.5 mm through 16 mm. If the chord 28*a* of the long-chord blade section 20 is shorter than 13.5 mm, the effect of the provision of the long-chord blade section 20 cannot be obtained. If the chord 28*a* is longer than 16 mm, the airflow does not smoothly flow inside the impeller 8*a*.

Figure 17:
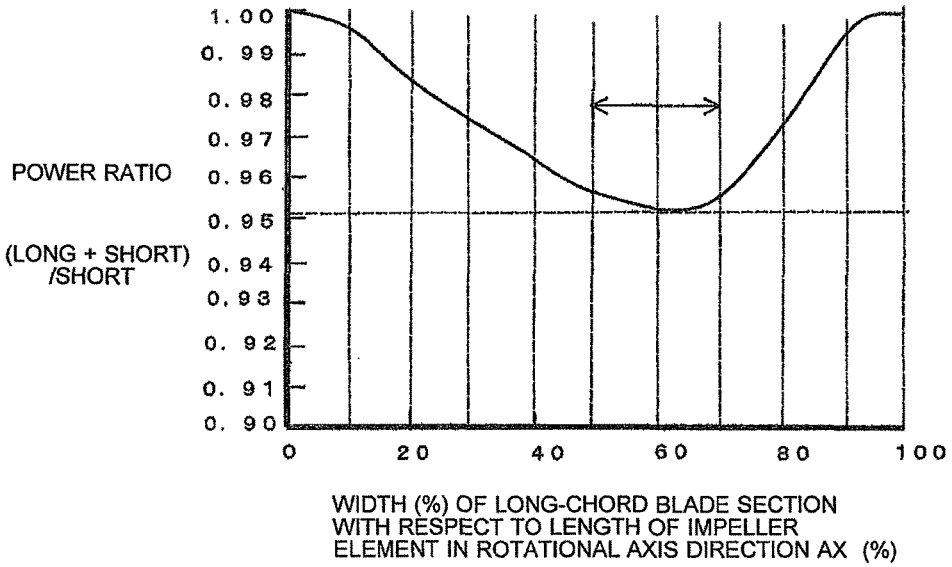
FIG. 17 is a characteristic graph showing the power ratio with respect to the length of a long-chord blade section in the rotational axis direction according to Embodiment 1 of the present invention, in which the horizontal axis represents the width (%) of the long-chord blade section with respect to the length of an impeller element in the rotational axis direction, and the vertical axis represents the power ratio "{power of the configuration of (long-chord blade section+short-chord blade section)}/{power of the configuration of short-chord blade section only}".

FIG. 17 is a characteristic graph according to Embodiment 1, in which the horizontal axis represents the width (%) of the long-chord blade section with respect to the length of the impeller element in the rotational axis direction AX, and the vertical axis represents the power ratio "{power of the configuration of (long-chord blade section+short-chord blade section)}/{power of the configuration of short-chord blade section only}". In this graph, the width is 0% when the entire blade 13 includes only a single short-chord blade section 21, and the width is 100% when the entire blade 13 includes only a single long-chord blade section 20. Further, the graph shows the power ratio obtained by varying a length L1 of a long-chord blade section 20 disposed at the center in the rotational axis direction AX. For example, in the case where the width L1 of the long-chord blade section 20 is 20% of the entire length L of the impeller element 14 (a length L2 of the short-chord blade section 21 is 80% of the total), the power usage is reduced by 2% compared with the case where the entire blade 13 includes only a single short-chord blade section 21. When the length L1 of the long-chord blade section 20 is 60% (the length L2 of the short-chord blade section 21 is 40%), the power usage is reduced by the greatest amount, which is about 5%. However, FIG. 17 shows the characteristics obtained by varying the length of the long-chord blade section 20 with respect to the length of the short-chord blade section 21, the characteristics may slightly vary in accordance with the difference between the chord lengths of the long-chord blade section 20 and the short-chord blade section 21 and in accordance with the difference in the chord length. It is found from FIG. 17 that, in the case where the blade 13 includes blade sections having two different chord lengths, the length of the blade section having one of the chord lengths is approximately 20% of the total or greater, the effect of reducing the power usage can be obtained. In this case, since the blade section having the other chord length is approximately 80% or less, the power usage can be reduced when the length of the blade section having one of the chord lengths is approximately 20% or greater but less than or equal to approximately 80%. Further, it is preferable that the length L1 of the long-chord blade section 20 be 50% through 70% of the total such that the power usage can be greatly reduced.

According to the configuration of Embodiment 1 illustrated in FIG. 5, in the impeller element 14, the length of the long-chord blade section 20 in the rotational axis direction AX is about ⅓ of the total, and the length of the two blade sections as the short-chord blade sections 21 is about ⅔ of the total. However, the present invention is not limited thereto. The length of one of the two may be approximately 20% or greater but less than or equal to approximately 80%. The experiment showed that when one of the two has a length of less than 20%, that is, when the other one has a length of greater than 80%, there was little effect of the configuration of different chord lengths, and the results were almost the same as the results obtained in the case of the configuration of a single chord length. In the case where two or more blade sections, such as the short-chord blade sections 21, having the same chord length are provided, the sum, which is L2×2, of the lengths L2 of the short-chord blade sections 21 may be in the range of approximately 20% through 80% of the entire length L.

As described above, when the length of one blade section in the rotational axis direction AX which has a predetermined chord length, or the sum of the lengths of a plurality of blade sections in the rotational axis direction AX which have the same chord length is approximately 20% or greater but less than or equal to approximately 80% of the entire length L of the blade 13 of the impeller 8*a*, the effect of dispersing the airflow in different directions can be reliably obtained. Thus, the area of the airflow is expanded between the front guide 9*c* and the rear guide 10 of the outlet flow path 11. Accordingly, the value of the maximum air velocity is reduced, and hence the energy loss and the noise level are reduced.

Especially, it is preferable that a long-chord blade section be provided at the center in the rotational axis direction AX and a longitudinal length thereof be approximately 50% through 70% of the total such that the effect of reducing the power usage can be reliably obtained. For example, if a short-chord blade section 21 constituting 25% of the total, a long-chord blade section 20 constituting 50% of the total, and another short-chord blade section 21 constituting 25% of the total are disposed in this order from an end connected to a support plate 12 so as to be connected to another support plate 12 at the other end, dispersion of the airflow generated by the blade sections having different chord lengths can be effectively utilized. Thus, it is possible to expand the distribution of the high-speed flow region 41 at the air outlet 3, and to reduce the area of the low-speed flow region 42.

Further, although there may be any number of the long-chord blade sections 20 and the short-chord blade sections 21 in the rotational axis direction AX in each impeller element 14, it is preferable that each of the lengths L1 and L2 of the respective blade sections be approximately 10% of the entire length L or greater. If the lengths L1 and L2 of the respective blade sections are less than approximately 10% of the entire length L, the air volume of the airflow having passed through between the blades of the blade sections in the inlet region E1 is small, and therefore the airflow is affected by the airflow over the adjacent blade sections. This prevents the area of the airflow from being sufficiently extended to the rear side and front side in the outlet region E2.

That is, when the length of each blade section 13 in the rotational axis direction AX is approximately 10% of the entire length L of the blade 13 of the impeller element 14 or greater, the dispersion effect can be reliably obtained. Thus, the airflow is dispersed and the area thereof is expanded between the front guide 9*c* and the rear guide 10 of the outlet flow path 11, so that the air velocity distribution of the airflow flowing at the air outlet 3 is made further uniform.

In the case where the impeller 14 includes blades of a single width in the rotational axis direction AX, as illustrated in FIG. 13, the width of the high-speed flow region 41 is increased vertically between A1 and A2 at portions close to the support plates 12, and the vertical width of the high-speed flow region 41 is reduced at the center. Thus, the airflow blown out from the outlet region E2 becomes a local high-speed flow. This is because although the leakage flow flowing in the rotational axis direction AX is blocked by the support plates 12 at portions close to the support plates 12, the airflow at the center flows toward the opposite sides as a leakage flow, so that the air volume is reduced. In the case where the long-chord blade section 20 is disposed in the portion where the width of the high-speed flow region 41 is reduced between the front guide 9*c* and the rear guide 10, as illustrated in FIG. 12(*c*), the high-speed flow region 41 extends at the lower side, so that the velocity distribution of the airflow is made uniform across the air outlet 3. On the blade section adjacent to the support plate 12, since the amount of leakage flow is less than that at the center, there is no significant reduction in the air volume. Therefore, the high-speed flow region 41 has a certain degree of width between the front guide 9*c* and the rear guide 10. Accordingly, the short-chord blade section 21 is disposed in this portion such that the airflow is effectively dispersed in accordance with the position in the rotational axis direction AX.

As described above, since the blade section located near the center in the rotational axis direction AX has a chord longer than chords of the blade sections located at the opposite ends, the airflow is effectively dispersed in accordance with the position in the rotational axis direction AX of the position of the impeller element 14. Thus, the air velocity distribution of the airflow flowing at the air outlet 3 is made further uniform.

Further, the length of the blade section in the rotational axis direction AX which is located at the center where there is a great amount of the leakage flow may be greater than the length of the blade section in the rotational axis direction AX which is adjacent to the support plate 12 so as to ensure the air volume.

In reality, the characteristics of the airflow flowing in the impeller 8*a* vary in accordance with the configuration of the flow path at the front and rear side of the location of the cross flow fan 8. With regard to the arrangement of the long-chord blade section 20 and the short-chord blade sections 21 in the rotational axis direction AX, since the airflow is made to flow at the lower side of the air outlet 3 by the long-chord blade section 20, and the airflow is made to flow at the upper side of the air outlet 3 by the short-chord blade sections 21, an arrangement that can effectively exert this effect may be selected. For example, in the impeller element 14, on the basis of the results of an observation of an airflow blown out of the air outlet 3 in the case of a single blade configuration having the same width, the arrangement of the long-chord blade section 20 and the short-chord blade sections 21 may be determined. For example, the short-chord blade section 21 may be disposed in a portion where the airflow tends to be blown out from the lower side of the air outlet 3 in the case of the blade configuration having the same width, while the long-chord blade section 20 may be arranged in a portion where the airflow tends to be blown out from the upper side of the air outlet 3.

Embodiment 2

Figure 18:
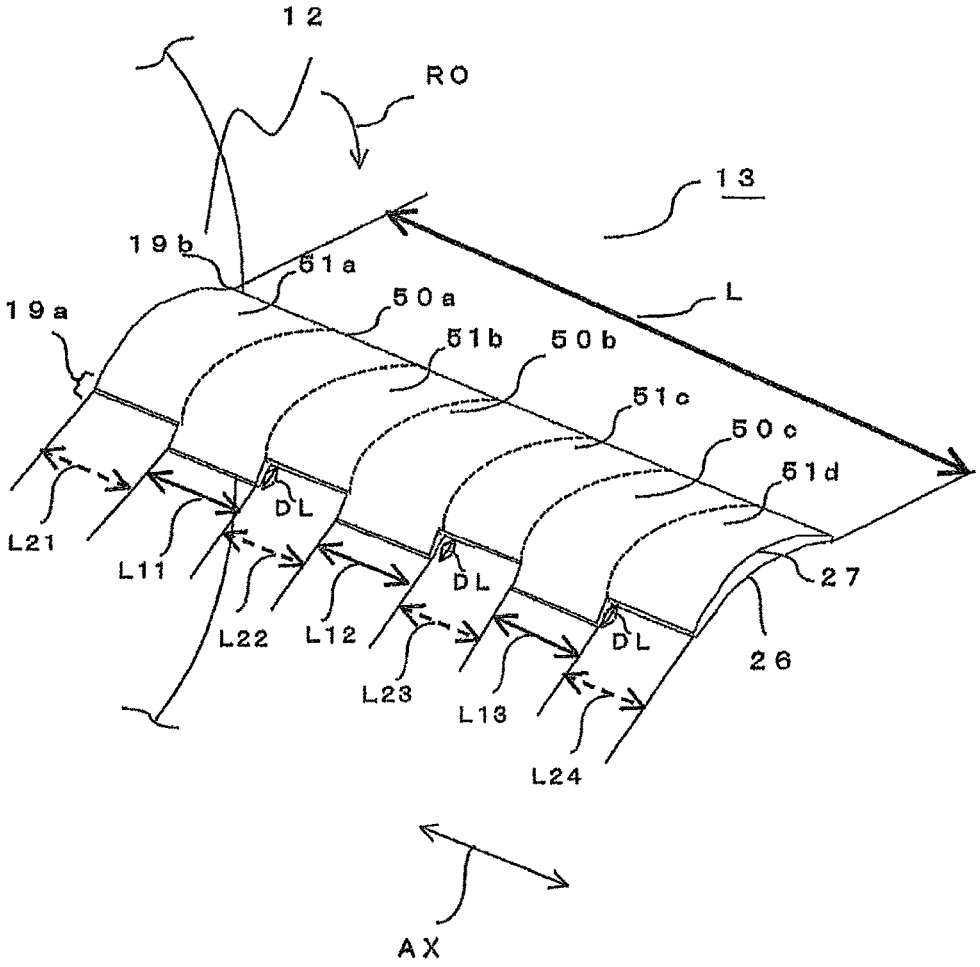
FIG. 18 is a perspective view illustrating a blade of a cross flow fan according to Embodiment 2 of the present invention.

FIG. 18 is a perspective view illustrating a blade of a cross flow fan according to Embodiment 2 of the present invention. In Embodiment 2, each blade 13 is divided into seven blade sections in the rotational axis direction AX (longitudinal direction) such that three long-chord blade sections 50*a*, 50*b*, and 50*c* and four short-chord blade sections 51*a*, 51*b*, 51*c*, and 51*d* are alternately arranged. The cross-sectional shapes of the long-chord blade section 50 and the short-chord blade section 51 are the same as those of Embodiment 1, and a chord of the long-chord blade section 50 is longer than a chord of the short-chord blade section 51 by DL (for example, 2 mm). For example, the shape of the long-chord blade section 50 may be determined such that a camber line of the long-chord blade section 50 is determined by extending the camber line of the short-chord blade section 51 while maintaining the arcuate shape thereof, and such that the blade thicknesses Wmax are equal to each other. Lengths L11, L12, and L13 of the long-chord blade sections 50 in the rotational axis direction AX (longitudinal direction) of the blade sections are equal to each other, for example. The long-chord blade section 50*b* at the center is disposed at the center in the rotational axis direction AX. Further, lengths L21, L22, L23, and L24 of the short-chord blade sections 51*a*, 51*b*, 51*c*, and 51*d* in the rotational axis direction AX (longitudinal direction) are equal to each other, for example, and are also equal to the lengths L11, L12, and L13.

In Embodiment 2, each blade includes two types of blade sections having different chord lengths, that is, three long-chord blade sections 50*a*, 50*b*, and 50*c* and four short-chord blade sections 51*a*, 51*b*, 51*c*, and 51*d*. As shown in FIGS. 8 and 9, when the air flows into the inside of the impeller 8*a* from between the blades in the inlet region E1, the direction in which the airflow heads toward the blades 13 in the outlet region E2 is determined by the shape of the blade inner-circumferential edge 19*a*. More specifically, the airflow flowing through between the blades is directed toward the lower right by the short-chord blade sections 51*a*, 51*b*, 51*c*, and 51*d*, and is directed toward the upper right by the long-chord blade sections 50*a*, 50*b*, and 50*c*. In this way, the direction of the airflow generated by the long-chord blade sections 50*a*, 50*b*, and 50*c* and the direction of the airflow generated by the short-chord blade sections 51*a*, 51*b*, 51*c*, and 51*d* are different from each other. Therefore, the air flows into between the blades in a wide range in the circumferential direction in the outlet region E2, is blown out into the outlet flow path 11, and flows in a wide area between the front guide 9*c* (A1) and the rear guide 10 (A2).

In Embodiment 2, dispersion of airflow occurs in seven locations in the rotational axis direction AX of the impeller element 14. More specifically, the airflow is made to become an airflow close to the rear guide 10 at the rear side by the three long-chord blade sections 50, and is also made to become an airflow close to the front guide 9*c* at the front side by the four short-chord blade sections 51. In the outlet flow path 11 and the air outlet 3, dispersion into an upward airflow and a downward airflow is repeated at short intervals by the plurality of long-chord blade sections 50 and short-chord blade sections 51 that are divided in the rotational axis direction AX.

Figure 19:
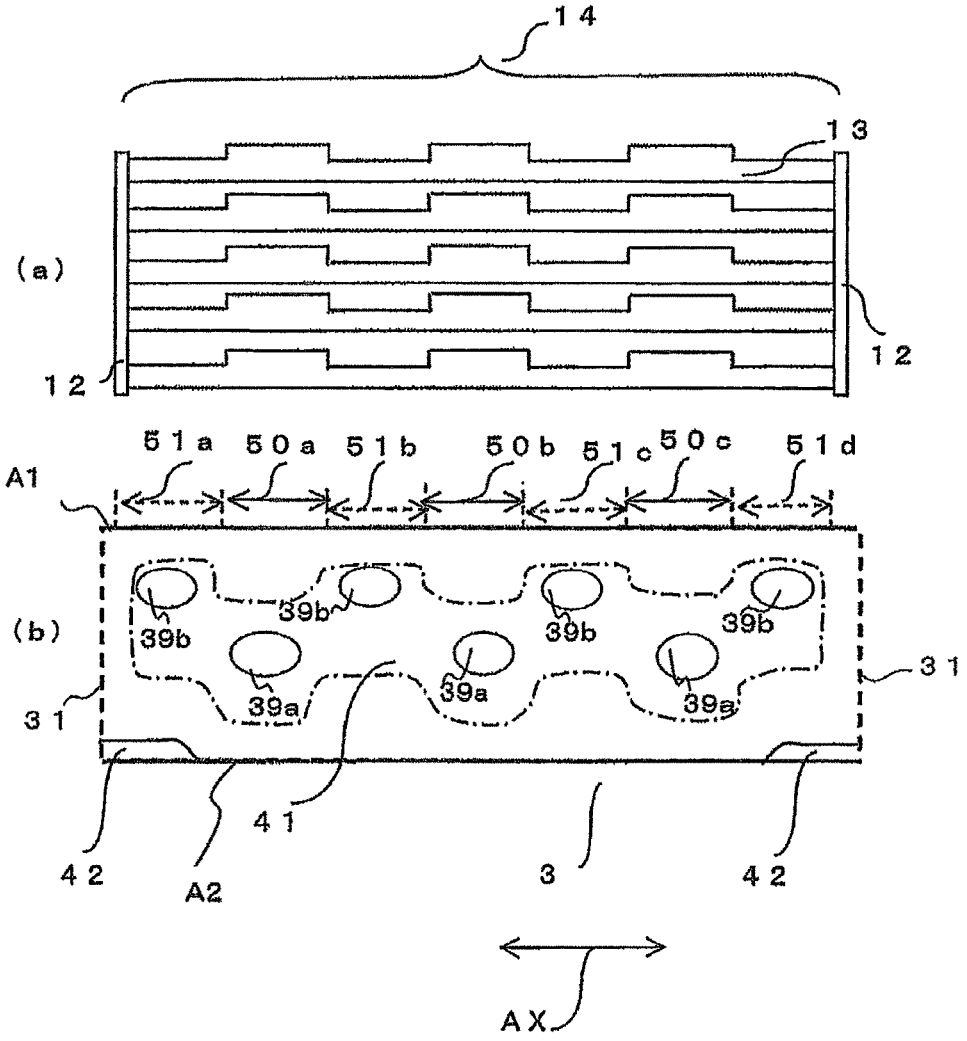
FIG. 19 illustrates Embodiment 2 of the present invention, in which an illustrative diagram (FIG. 19(*a*)) schematically shows the configuration of blades of an impeller element, and an illustrative diagram (FIG. 19 (*b*)) shows the air velocity distribution of an airflow at an air outlet in accordance with the shape of blade sections thereof.

FIG. 19 shows an illustrative diagram (FIG. 19(*a*)) schematically showing the configuration of the blades of the impeller element 14, and an illustrative diagram (FIG. 19 (*b*)) showing the air velocity distribution of the airflow at the air outlet 3 in accordance with the shape of blade sections thereof. Airflows 39*a* and 39*b* illustrated in FIG. 19(*b*) indicate the area of the airflow with a velocity close to the maximum velocity of the airflow that is blown out of the impeller 8*a*, for example, with a velocity of (the maximum velocity −5%). The region indicated by the one-dot chain line indicates the area of the airflow with a velocity higher than the average air velocity of the airflow blown out from the impeller 8*a* as a high-speed flow region 41. Dispersion of the airflow is repeated at short intervals in the rotational axis direction AX. In the vicinity of the boundary thereof, the area of the high-speed flow region 41 is greater than the area of that of Embodiment 1 due to the effect of the respective airflows. Further, the low-speed flow region 42 is smaller than that of Embodiment 1. With respect to the airflow passing through the air outlet 3, compared with Embodiment 1, the air velocity distribution is made uniform across the air outlet 3, and the maximum air velocity is further reduced in the case where a comparison is made at the same air volume. Accordingly, it is possible to reduce the level of noise and the energy loss due to a local high-speed airflow.

It is to be noted that in the case where the blade 13 includes two types of long-chord blade sections 50 and short-chord blade sections 51 having camber lines of different lengths, which are a plurality of long-chord blade sections 50*a*, 50*b* and 50*c*, and short-chord blade sections 51*a*, 51*b*, 51*c*, and 51*d*, the arrangement is not limited to that of Embodiment 2. The blade sections may be arranged in a desired manner in the rotational axis direction AX.

Further, in Embodiment 2, three long-chord blade sections 50*a*, 50*b*, and 50*c*, and four short-chord blade sections 51*a*, 51*b*, 51*c*, and 51*d* are provided. However, the present invention is not limited thereto. Two, three, or more long-chord blade sections may be provided. As the number of long-chord blade sections is increased from one to two, three, or more by division, dispersion of the airflow is repeated at short intervals, so that the air velocity distribution of the airflow at the air outlet 3 is made further uniform. However, if the number of divisions is excessively increased, the longitudinal length of each blade section becomes short, so that the airflows flowing over the adjacent blade sections affect each other. Thus, the dispersion action due to the difference in the chord length becomes unstable, and hence it is not possible to achieve a great effect. The longitudinal length of each of the blade sections is preferably at least approximately 10% of the entire longitudinal length in the impeller element 14 or greater. For example, when the longitudinal length L=90 mm, each of the lengths L11 through L13 and L21 through L24 of the long-chord blade sections 50 and the short-chord blade sections 51 is preferably 9 mm, which is 10% of the total, or greater.

Further, each of the sum L11+L12+L13 of the lengths of the long-chord blade sections 50*a*, 50*b*, and 50*c* and the sum L21+L22+L23+L24 of the lengths of the short-chord blade sections 51*a*, 51*b*, 51*c*, and 51*d* is in the range of approximately 20% through 80% of the entire length L of the blade, for example. Since each of the lengths L11 through L13 and L21 through L24 of the long-chord blade sections 50 and the short-chord blade sections 51 is at least approximately 10% of the entire length of the blade, in the case where three long-chord blade sections 50*a*, 50*b*, and 50*c*, and four short-chord blade sections 51*a*, 51*b*, 51*c*, and 51*d* are provided as in Embodiment 2, the sum L11+L12+L13 of the lengths of the long-chord blade sections 50*a*, 50*b*, and 50*c* is at least approximately 30% of the entire length L of the blade or greater, and the sum L21+L22+L23+L24 of the lengths of the short-chord blade sections 51*a*, 51*b*, 51*c*, and 51*d* is at least approximately 40% of the entire length L of the blade or greater.

Embodiment 3

Figure 20:
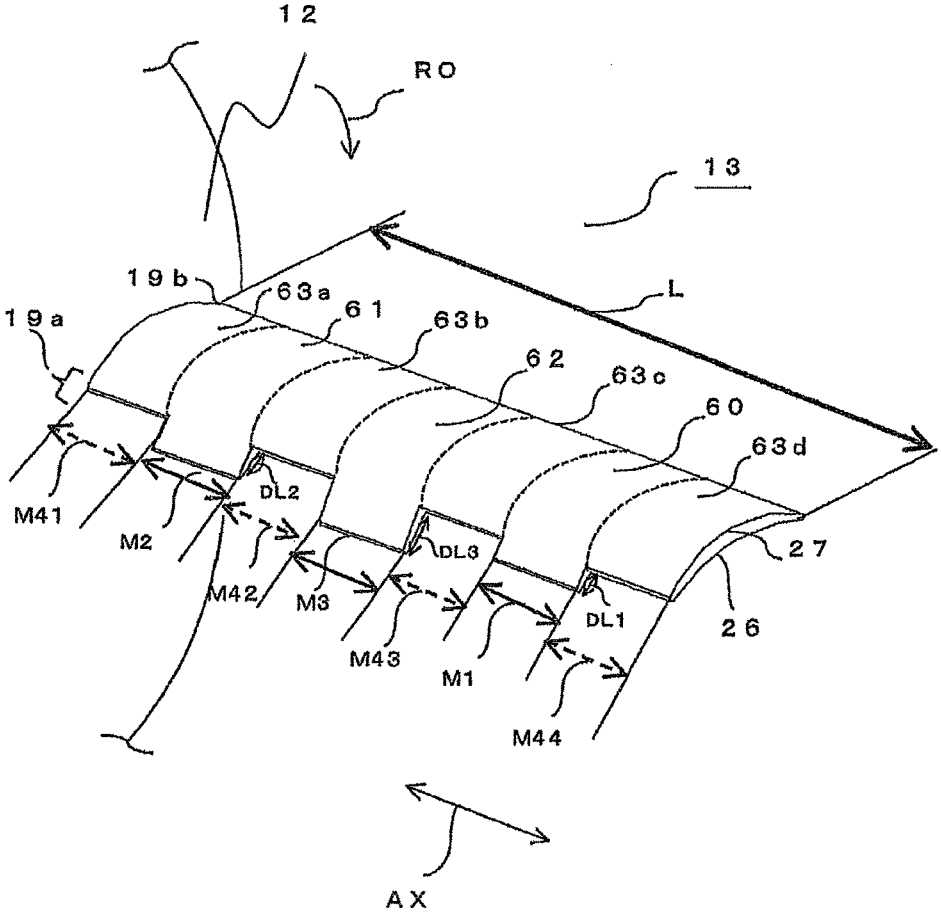
FIG. 20 is a perspective view illustrating a blade of a cross flow fan according to Embodiment 3 of the present invention.

FIG. 20 is a perspective view illustrating a blade 13 of a cross flow fan according to Embodiment 3 of the present invention. In Embodiment 3, each blade 13 is divided into seven blade sections in the rotational axis direction AX (longitudinal direction), namely, a first long-chord blade section 60, a second long-chord blade section 61, a third long-chord blade section 62, and short-chord blade sections 63*a*, 63*b*, 63*c*, and 63*d*, which have four types of chords. The cross-sectional shapes of the first, second, third long-chord blade sections 60, 61, and 62, and the short-chord blade section 63 are the same as those of Embodiment 1. The chord of the first long-chord blade section 60 is longer than the chord of the short-chord blade section 63*d* by DL1; the chord of the second long-chord blade section 61 is longer than the chord of the short-chord blade section 63*b* by DL2; and the chord of the third long-chord blade section 62 is longer than the chord of the short-chord blade section 63*c* by DL3. Further, DL1<DL2<DL3 is satisfied. The third long-chord blade section 62 having the greatest chord length is disposed at the center in the rotational axis direction AX; the short-chord blade sections 63*b* and 63*c* are disposed on both sides thereof, respectively; and the first and second long-chord blade sections 60 and 61 are disposed adjacent thereto, respectively; and the short-chord blade sections 63*a* and 63*b* are disposed at the opposite ends.

Further, in the rotational axis direction AX (longitudinal direction), a length M1 of the first long-chord blade section 60, a length M2 of the second long-chord blade section 61, and a length M3 of the third long-chord blade section 62 are substantially equal to each other, and M1=M2=M3=L×0.2 is satisfied. Lengths M41, M42, M43, and M44 of the short-chord blade sections 63*a*, 63*b*, 63*c*, and 63*d* are substantially equal to each other, and M41=M42=M43=M44=L×0.1 is satisfied. Further, with regard to the chord length, the chord length of the short-chord blade sections 63*a*, 63*b*, 63*c*, and 63*d* is 12 mm; and the chord length of the first long-chord blade section 60 is 14 mm; the chord length of the second long-chord blade section 61 is 15 mm; and the chord length of the third long-chord blade section 62 is 16 mm, for example. That is, DL1=2 mm, DL2=3 mm, and DL3=4 mm.

In Embodiment 3, each blade includes four types of blade sections having different chord lengths, that is, three first, second, and third long-chord blade sections 60, 61, and 62 having different chord lengths and four short-chord blade sections 63*a*, 63*b*, 63*c*, and 63*d* having a chord length different from the long-chord blade sections 60, 61, and 62. As in the case of Embodiment 1 and Embodiment 2, with regard to the airflow dispersion action due to the different shapes of the blade inner-circumferential edges 19*a* of the respective blade sections, the airflow is dispersed in four directions in Embodiment 3. That is, the air blown out from between blades in the inlet region E1 flows into the inside of the impeller 8*a* in accordance with the shape of the blade inner-circumferential edges 19*a* of the blade sections having different chord lengths, and flows into between the blades in a wide range in the circumferential direction in the outlet region E2. Further, since the airflow is blown out from between the blades in a wide area into the outlet flow path 11, the airflow flows across the outlet flow path 11. Thus, the airflow has a uniformly distribute air velocity at the air outlet 3.

Figure 21:
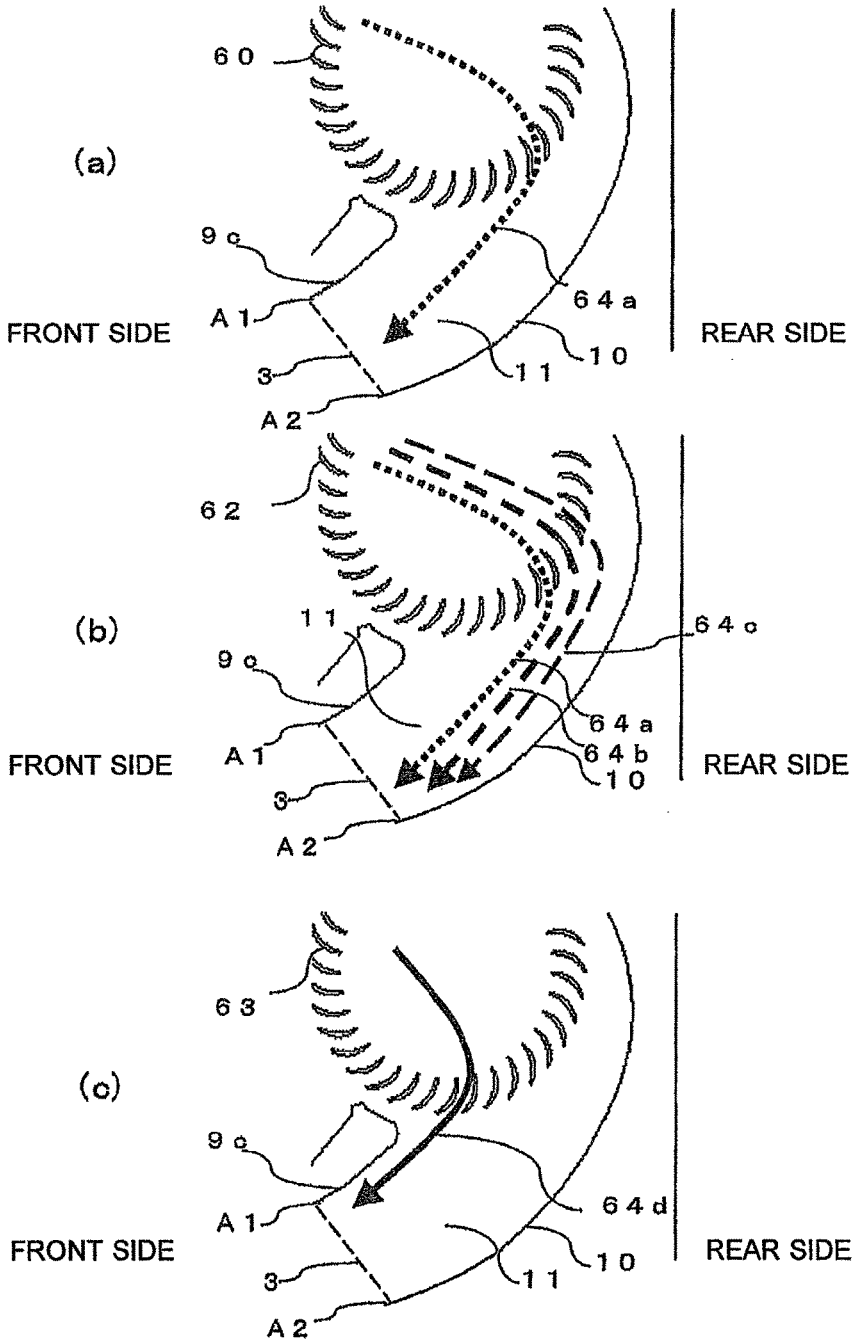
FIG. 21 is an illustrative diagram showing an airflow flowing over blade sections according to Embodiment 3 of the present invention.

The airflow at the air outlet 3 in the impeller element 14 will be described with reference to FIG. 21. FIG. 21(*a*) illustrates an airflow passing over the first long-chord blade sections 60. An airflow 64*a* flows at a side slightly close to the rear guide 10 between the front guide 9*c* and the rear guide 10 of the outlet flow path 11, and is blown out from a portion close to A2 of the air outlet 3. FIG. 21(*b*) illustrates an airflow flowing passing over the third long-chord blade section 62. The third long-chord blade section 62 has the greatest chord length, and therefore provides the greatest effect of directing upward the airflow having been suctioned into the impeller element 14 in the inlet region E1. Thus, the airflow flows into between the blades at the rearmost side in the outlet region E2. Then, an airflow 64*c* flowing through the outlet flow path 11 flows near the rear guide 10 between the front guide 9*c* and the rear guide 10, and is blown out from the portion of the air outlet 3 closest to A2. An airflow 64*b* is the airflow passing between the second long-chord blade sections 61. The position where the airflow flows between A1 and A2 in the outlet flow path 11 varies in accordance with the chord length. That is, the airflow is made to become the airflow 64*c* at the rearmost side by the third long-chord blade section 62 having the greatest chord length, the airflow 64*b* at the front side of the airflow 64*c* by the second long-chord blade section 61 having a shorter chord than the third long-chord blade section 62, and the airflow 64*a* at the front side of the airflow 64*b* by the first long-chord blade section 60 having a shorter chord than the second long-chord blade section 61. Further, FIG. 21(*c*) illustrates an airflow passing over the short-chord blade sections 63*a* through 63*d*. An airflow 64*d* flows near the front guide 9*c* between the front guide 9*c* and the rear guide 10 of the outlet flow path 11, and is blown out from a portion of the air outlet 3 closest to A1.

Figure 22:
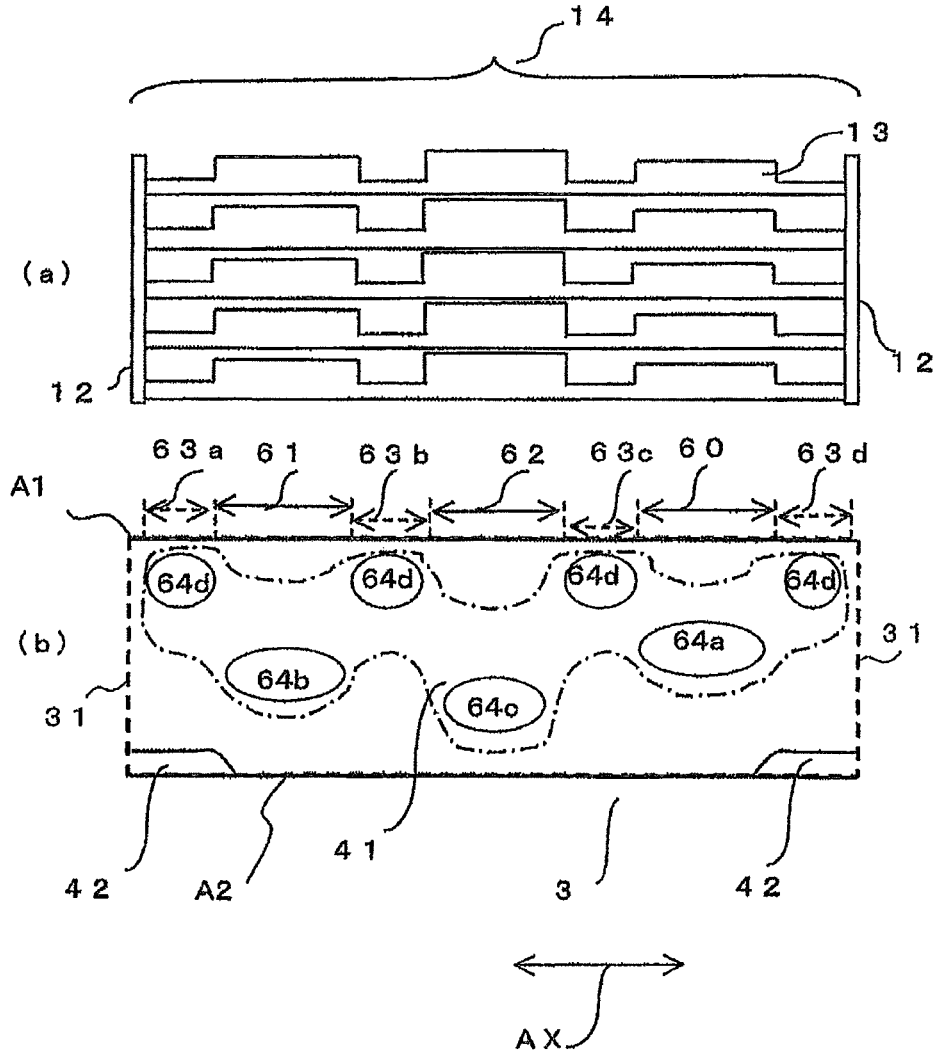
FIG. 22 illustrates Embodiment 3 of the present invention, in which an illustrative diagram (FIG. 22(*a*)) schematically shows the configuration of blades of an impeller element, and an illustrative diagram (FIG. 22 (*b*)) shows the air velocity distribution of an airflow at an air outlet in accordance with the shape of blade sections thereof.

FIG. 22 shows an illustrative diagram (FIG. 22(*a*)) schematically showing the configuration of the blades of the impeller element 14, and an illustrative diagram (FIG. 22 (*b*)) showing the air velocity distribution of the airflow at the air outlet 3 in accordance with the shape of blade sections thereof. Dispersion of the airflow is repeated at short intervals in the rotational axis direction AX. In the vicinity of the boundary thereof, the area of the high-speed flow region 41 is greater than the area of those of Embodiment 1 and Embodiment 2 due to the effect of the respective airflows. Especially, since the blade 13 includes chords of four different lengths, the high-speed flow region 41 extends between A1 and A2, so that the airflow is blown out to the entire area of the air outlet 3. With this dispersion, the air velocity distribution is made uniform at the air outlet 3. Thus, it is possible to reduce the level of noise and the energy loss due to a local high-speed airflow.

It is to be noted that in the case where the blade 13 includes four types of blade sections 60, 61, 62, 63*a*, 63*b*, 63*c*, and 63*d* having four different chord lengths, the arrangement is not limited to that of Embodiment 3. The first long-chord blade section 60, the second long-chord blade section 61, and the third long-chord blade section 62 may be arranged adjacent to one another.

Although the long-chord blade sections 60, 61, and 62, and the short-chord blade sections 63*a*, 63*b*, 63*c*, and 63*d* have the substantially the same length in the rotational axis direction AX, these blade sections may have significantly different lengths, or some of the blade sections may have different lengths. However, the length of each of the blade sections 60, 61, 62, 63*a*, 63*b*, 63*c*, and 63*d* in the rotational axis direction AX is approximately 10% of the entire length L or greater. If the length is less than approximately 10%, in the case of the long-chord blade sections 60, 61, and 62, for example, the airflow directed upward in the inlet region E1 does not have enough width and is affected by the airflow generated by the adjacent blade section. Accordingly, the airflows do not reach the respective positions in the outlet area E2 shown in FIGS. 8 and 9, so that it is not possible to obtain a sufficient effect of dispersing the airflow toward the front side A1 and the rear side A2 of the outlet flow path 11.

As in the case of Embodiment 2, among a plurality of blade sections, when the chord length of the blade section at the center is greater than that of the blade sections adjacent to the support plates 12, the effect is further increased. When the chord length of the blade section is greater at the center where a leakage flow is easily generated and the air volume decreases, even if a certain amount of airflow flows toward the airflows generated by the adjacent blade sections, it is possible to generate an airflow that flows near the rear guide 10. Accordingly, dispersed airflow can be reliably obtained, and the effect of making uniform the air velocity distribution of the airflow blown out from the air outlet 3.

Further, in view of leakage of the airflow from the blade section at the center to the adjacent blade sections, the longitudinal length of the blade section 62 at the center may be greater than the lengths of the other blade sections. As in the case described above, when the longitudinal length of the blade section 62 at the center is greater, even if a certain amount of airflow flows toward the airflows generated by the adjacent blade sections, it is possible to generate an airflow that flows near the rear guide 10.

Further, the size of the support plates 12 is determined in accordance with the blade sections disposed at the opposite ends of the impeller element 14. That is, in the case where the short-chord blade sections 63*a* and 63*d* are arranged at the opposite ends of the impeller element 14, the circular hollow support plates 12 may have a greater inner diameter than in the case where the long-chord blade sections are arranged at the opposite ends. Thus, the weight of the rotor may be reduced, and therefore this arrangement is preferable.

Figure 23:
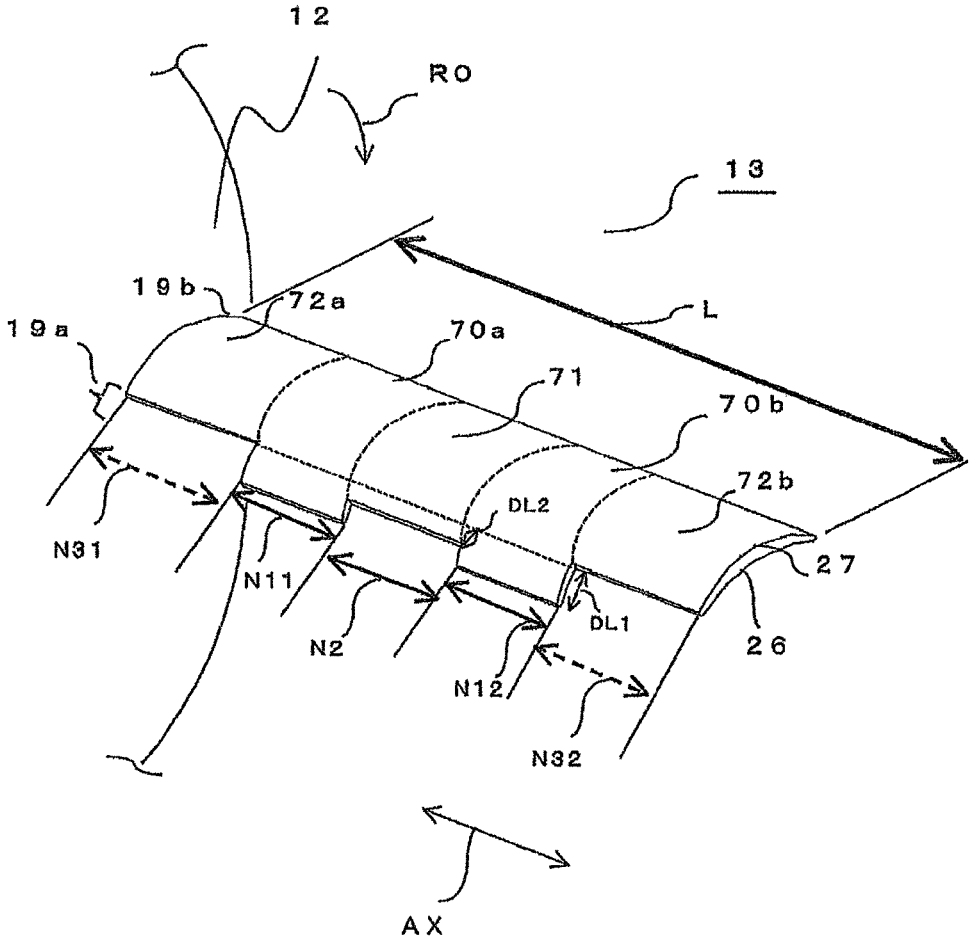
FIG. 23 is a perspective view illustrating a blade of a cross flow fan according to Embodiment 3 of the present invention.

Another configuration example according to Embodiment 3 will be described. FIG. 23 illustrates a configuration in which each blade 13 includes three types of blade sections having different chord lengths, namely, first long-chord blade sections 70*a* and 70*b*, second long-chord blade section 71, and short-chord blade sections 72*a* and 72*b*; the short-chord blade sections 72*a* and 72*b* having the least chord length are disposed at the opposite ends in the rotational axis direction AX; the first long-chord blade sections 70*a* and 70*b* having the greatest chord length are disposed adjacent thereto, respectively; and the second long-chord blade section 71 is disposed at the center. The difference in the chord length between the short-chord blade sections 72*a* and 72*b* and the first long-chord blade sections 70*a* and 70*b* is DL1, the difference in the chord length between the short-chord blade sections 72*a* and 72*b* and the second long-chord blade section 71 is DL2. Further, DL1>DL2 is satisfied.

With this configuration, the airflow having passed over the respective blade sections is dispersed between the front guide 9*c* (A1) and the rear guide 10 (A2) of the outlet flow path 11 due to the difference in the chord length. That is, the first long-chord blade sections 70*a* and 70*b* have the greatest chord length, and therefore provide the greatest effect of directing upward the airflow having been suctioned into the impeller element 14 in the inlet region E1. Thus, the airflow flows into between the blades at the rearmost side in the outlet region E2. Then, the airflow flows near the rear guide 10, and is blown out from the portion of the air outlet 3 closest to A2. Then, the airflow having passed over the short-chord blade sections 72*a* and 72*b* flows near the front guide 9*c*, and is blown out from the portion of the air outlet 3 closest to A1. Further, the airflow having passed over the second long-chord blade section 71 flows at the front side of the airflow generated by the first long-chord blade sections 70*a* and 70*b* and at the rear side of the airflow generated by the short-chord blade sections 72*a* and 72*b*.

Figure 24:
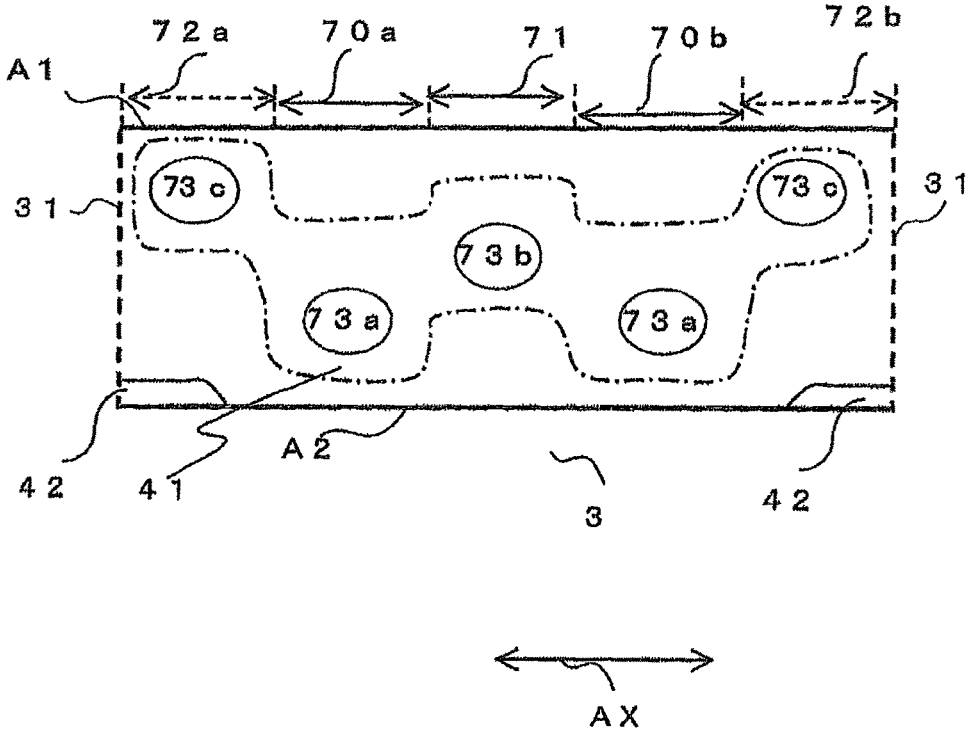
FIG. 24 is an illustrative diagram showing the air velocity distribution of an airflow at an air outlet in accordance with the shape of the blades of the impeller element according to Embodiment 3 of the present invention.

FIG. 24 is an illustrative diagram showing the air velocity distribution of the airflow at the air outlet 3 in accordance with the shape of blade sections of the blade of the impeller element 14. Dispersion of the airflow is repeated at short intervals in the rotational axis direction AX. In the vicinity of the boundary thereof, the area of the high-speed flow region 41 is greater than the area of those of Embodiment 1 and Embodiment 2 due to the effect of the respective airflows. Especially, since the blade 13 includes chords of three different lengths, the high-speed flow region 41 extends between A1 and A2. Thus, the air velocity distribution of the airflow is made uniform, so that the airflow is blown out to the entire area of the air outlet 3. Accordingly, it is possible to reduce the energy loss and the level of noise due to collision of a local high-speed airflow with the airflow control vanes 4 and a rapid expansion of the flow path at the air outlet 3.

Embodiment 4

Figure 25:
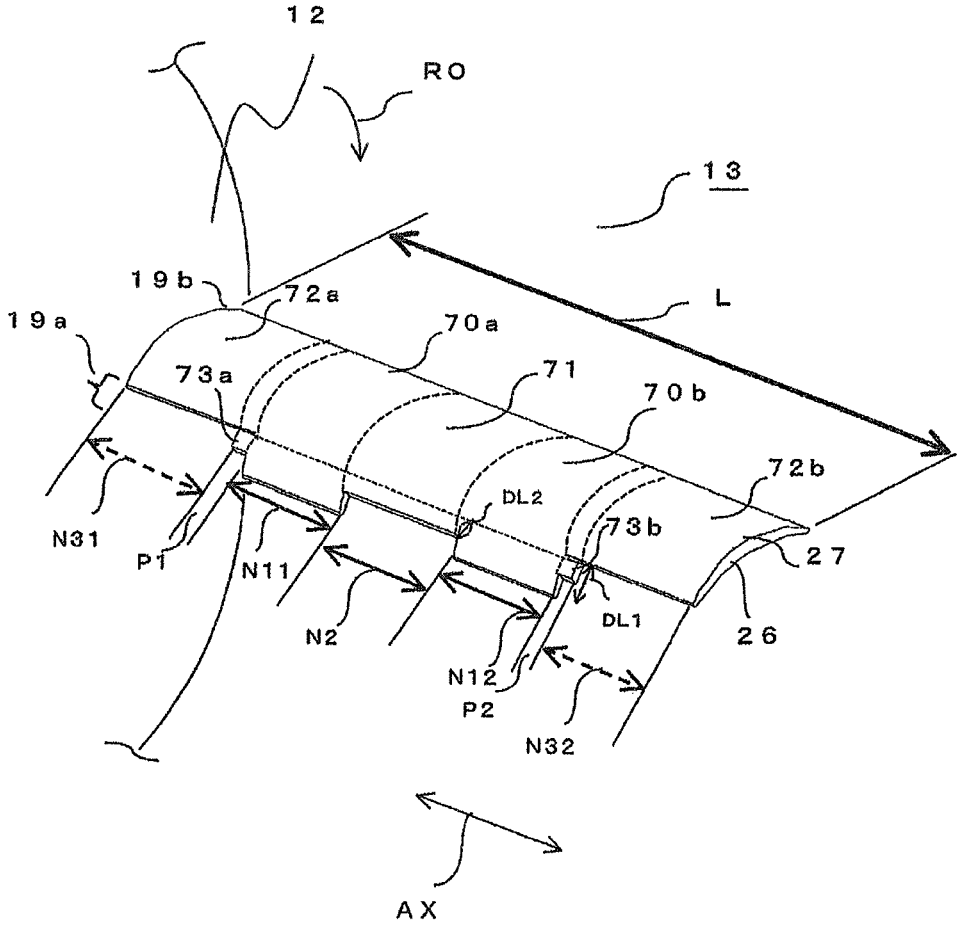
FIG. 25 is a perspective view illustrating a blade of a cross flow fan according to Embodiment 4 of the present invention.

FIG. 25 is a perspective view illustrating a blade 13 of a cross flow fan according to Embodiment 4 of the present invention. The same reference numerals denote the same or equivalent elements as those in FIG. 23. In Embodiment 4, inter-blade-section smoothening sections 73*a* and 73*b* having a step shape are provided at the portions where the adjacent blade sections have a great difference in the chord length, which are, for example, stepped portions between a first long-chord blade section 70*a* and a short-chord blade section 72*a*, and a first long-chord blade section 70*b* and a short-chord blade section 72*b*, and have chords of an intermediate length between the lengths of respective chords of the first long-chord blade section 70*b* and the short-chord blade length 72*b* so as to reduce the effect of the difference in the chord length.

At a portion where the adjacent blade sections have a great difference in the chord length, such as a portion between the first long-chord blade section 70*a* and the short-chord blade section 72*a*, which forms a stepped portion, the directions of the airflows differ greatly from each other, and therefore the airflows generated by the two blade sections affect each other in the vicinity of the boundary. Thus, a turbulence or a vortex is generated, so that the energy loss is increased. In order to solve this problem, the inter-blade-section smoothing section 73*a* having a chord length that is less than the chord length of the first long-chord blade section 70*a* and is greater than the chord length of the short-chord blade section 72*a* is provided between the first long-chord blade section 70*a* and the short-chord blade section 72*a*. Similarly, the inter-blade-section smoothening section 73*b* is provided between the first long-chord blade section 70*b* and the short-chord blade section 72*b*. In the case where the inter-blade-section smoothening sections 73*a* and 73*b* do not have an arcuate shape at the blade inner-circumferential edge 19*a*, the chords thereof are line segments connecting the blade inner-circumferential edge 19*a* and the blade outer-circumferential edge 19*b*. Widths P1 and P2 of the inter-blade-section smoothening sections 73*a* and 73*b* in the rotational axis direction AX are less than 10% of the entire length L.

In the inlet region E1, the airflows flowing through between the blades of the first long-chord blade sections 70*a* and the short-chord blade sections 72*a* flow in the different flow directions at the front side and the rear side, the airflows generated by the inter-blade-section smoothening sections 73*a* and 73*b* flow in the middle direction between these two airflows. Since the widths P1 and P2 of the inter-blade-section smoothening sections 73*a* and 73*b* in the rotational axis direction AX are less than approximately 10% of the total, the air volume of the airflows flowing over the inter-blade-section smoothening sections 73*a* and 73*b* is small. Therefore, the airflows are affected by and mixed with the airflows by the adjacent first long-chord blade section 70*a* and short-chord blade section 72*a* and the adjacent first long-chord blade section 70*b* and short-chord blade section 72*b*, respectively, and flow to the outlet region E2.

Figure 26:
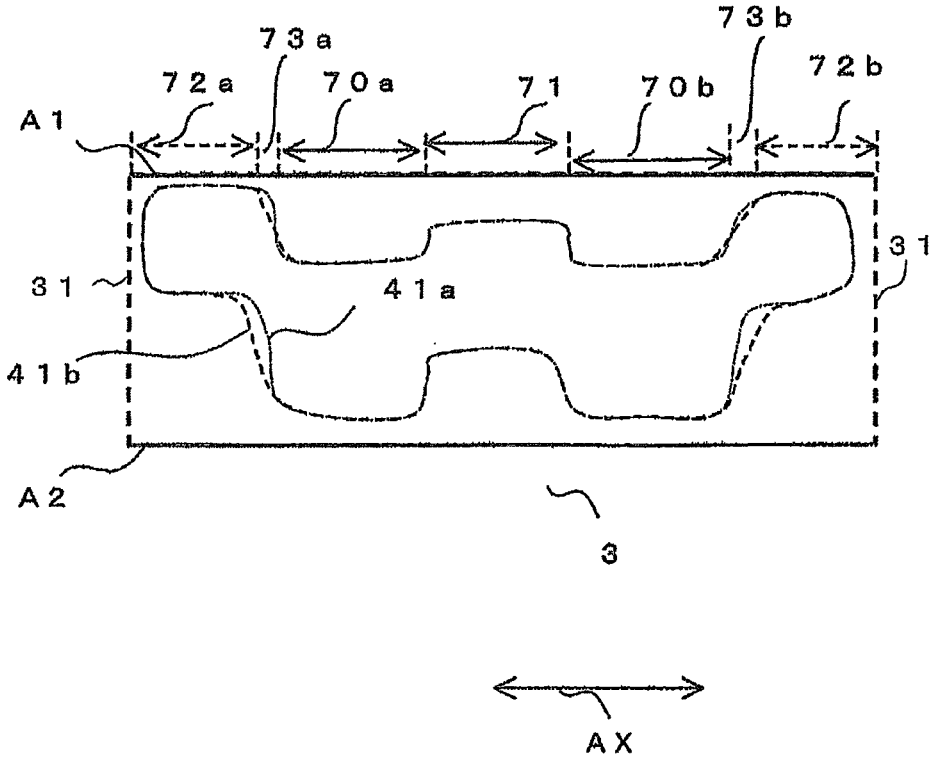
FIG. 26 is an illustrative diagram showing the air velocity distribution of an airflow at an air outlet according to Embodiment 4 of the present invention.

That is, between two airflows in two greatly different directions, an airflow heading to a direction in the middle therebetween is generated so as to prevent generation of a turbulence and vortex of the airflow. FIG. 26 is an illustrative diagram showing the air velocity distribution of the airflow at the air outlet 3 in accordance with the shape of blade sections. A high-speed flow region 41*a* shown in FIG. 24 is indicated by the one-dot chain line, and a high-speed flow region 41*b* according to Embodiment 4 is indicated by the dotted line. As indicated by the high-speed flow region 41*b*, the effects of the differences between the first long-chord blade section 70*a* and the short-chord blade section 72*a*, and between the first long-chord blade section 70*b* and the short-chord blade section 72*b* are reduced. That is, compared with the high-speed flow region 41*a*, in the high-speed flow region 41*b*, the degree of variation is reduced at the inter-blade-section smoothening sections 73*a* and 73*b*. In this way, since the airflow at portions with a great difference in the chord length smoothly flows from the inlet region E2 through the outlet flow path 11 to the air outlet 3, it is possible to prevent the energy loss from increasing due to generation of a turbulence and a vortex, and therefore the air speed distribution at the air outlet 3 can be made uniform.

As described above, in Embodiment 4, the inter-blade-section smoothening sections 73*a* and 73*b* are provided at a stepped portion between the two adjacent blade sections 70*a* and 72*a* having chords of different lengths, and a stepped portion between the two adjacent blade sections 70*b* and 72*b*, respectively, at the blade inner-circumferential edge 19*a*. The inter-blade-section smoothening sections 73*a* and 73*b* have chords of intermediate lengths between lengths of chords of the two blade sections 70*a* and 72*a* and between lengths of chords of the two blade sections 70*b* and 72*b*, respectively. Therefore, it is possible to prevent a large vortex from being generated at portions where the flow directions of airflows flowing between blades of two blade sections, to smoothly change the flow direction of the airflow, and to reduce the energy loss.

In Embodiment 4, the inter-blade-section smoothening sections 73*a* and 73*b* are provided in the blade 13 having the configuration of FIG. 23. However, the present invention is not limited thereto. In the configuration of FIG. 23, inter-blade-section smoothening sections 73 may also be provided between the first long-chord blade section 70*a* and the second long-chord blade section 71 and between the first long-chord blade section 70*b* and the second long-chord blade section 71. For example, in the blades 13 having the configurations of FIG. 5, FIG. 18, and FIG. 20, inter-blade-section smoothening sections 73 may also be provided at portions with a great difference in the chord length.

Further, the blade inner-circumferential edges 19*a* of the inter-blade-section smoothening sections 73*a* and 73*b* may have the same shape as the long-chord blade sections 70*a* and 70*b* with the blade inner-circumferential edges 19*a* thereof removed. Further, the end portions thereof with the blade inner-circumferential edges 19*a* removed may have the same arcuate shape as the other blade sections 70, 71, and 72. If the end portions have an arcuate shape, the airflow smoothly flows to the inter-blade-section smoothening sections 73*a* and 73*b* in the outlet region E2.

Figure 27:
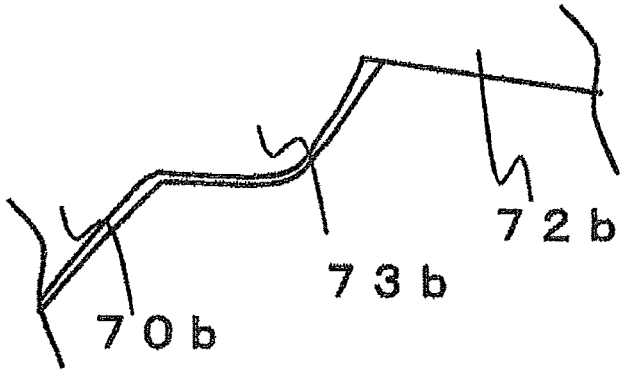
FIG. 27 is an illustrative diagram showing other examples of the shape of an inter-blade-section smoothening section according to Embodiment 4 of the present invention.
Figure 27:
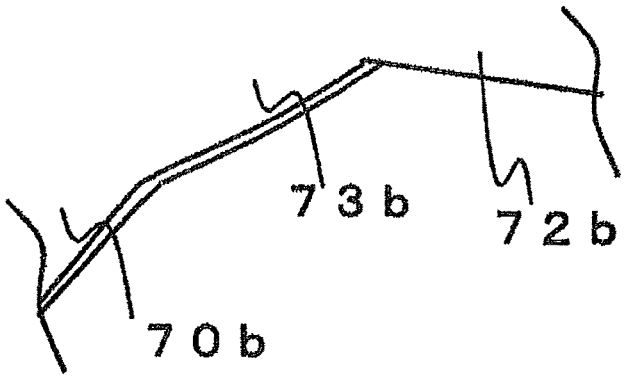

Further, although the step-shaped inter-blade-section smoothening sections 73 are provided at stepped portions between the blade sections having different chord lengths so as to form a step shape, the present invention is not limited thereto. The step-shaped end portions may have a rounded shape as shown in FIG. 27(*a*), or may form an inclined straight line as shown in FIG. 27(*b*). Alternatively, a plurality of step portions may be provided. The inter-blade-section smoothening section 73 may have a chord which has an intermediate length between the lengths of respective chords of the first long-chord blade section 70*b* and the short-chord blade section 72*b*, and the chord may be shorter than the chord of the first long-chord blade section 70*b* and be longer than the chord of the short-chord blade section 72*b*.

Embodiment 5

Figure 28:
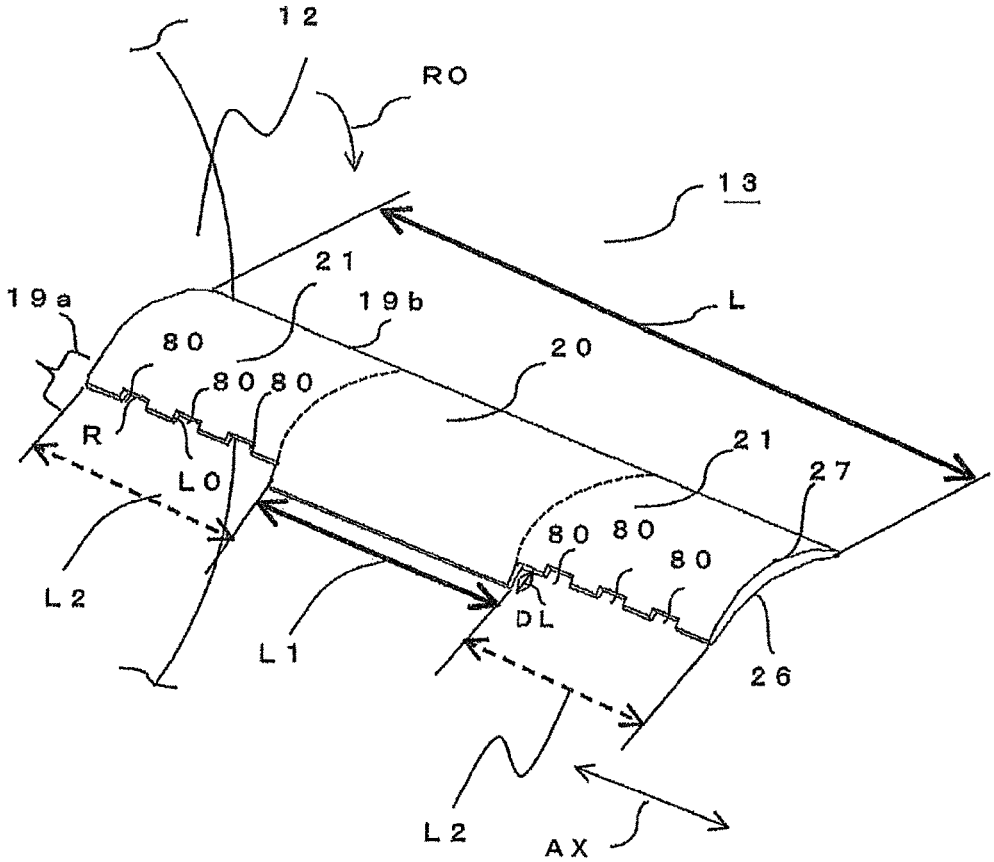
FIG. 28 illustrates Embodiment 5 of the present invention, in which a perspective view (FIG. 28(*a*)) illustrates a blade of a cross flow fan, and an illustrative diagram (FIG. 28(*b*)) shows an enlarged view of a recess.
Figure 28:
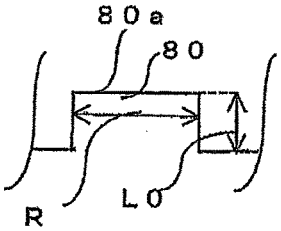

FIG. 28(*a*) is a perspective view illustrating a blade 13 of a cross flow fan according to Embodiment 5 of the present invention. FIG. 28(*b*) is an illustrative diagram showing an enlarged view of a recess 80. The blade 13 includes a long-chord blade section 20 at the center and short-chord blade sections 21 at the opposite ends in the longitudinal direction. Further, a plurality of recesses 80 are provided at a blade inner-circumferential edge 21*a* of each of the two short-chord blade sections 21. For example, three recesses 80 are provided in each of the two short-chord blade sections 21. For example, with regard to the shape of the recess 80, when a length of one blade in the rotational axis direction AX is 100 mm, a longitudinal length R≤5 mm, and a length LO in the camber line direction≤1 mm. The recesses 80 are provided at equal intervals in the short-chord blade section 21. The recesses 80 are open at distal ends of the blade inner-circumferential edges 21*a*.

Figure 29:
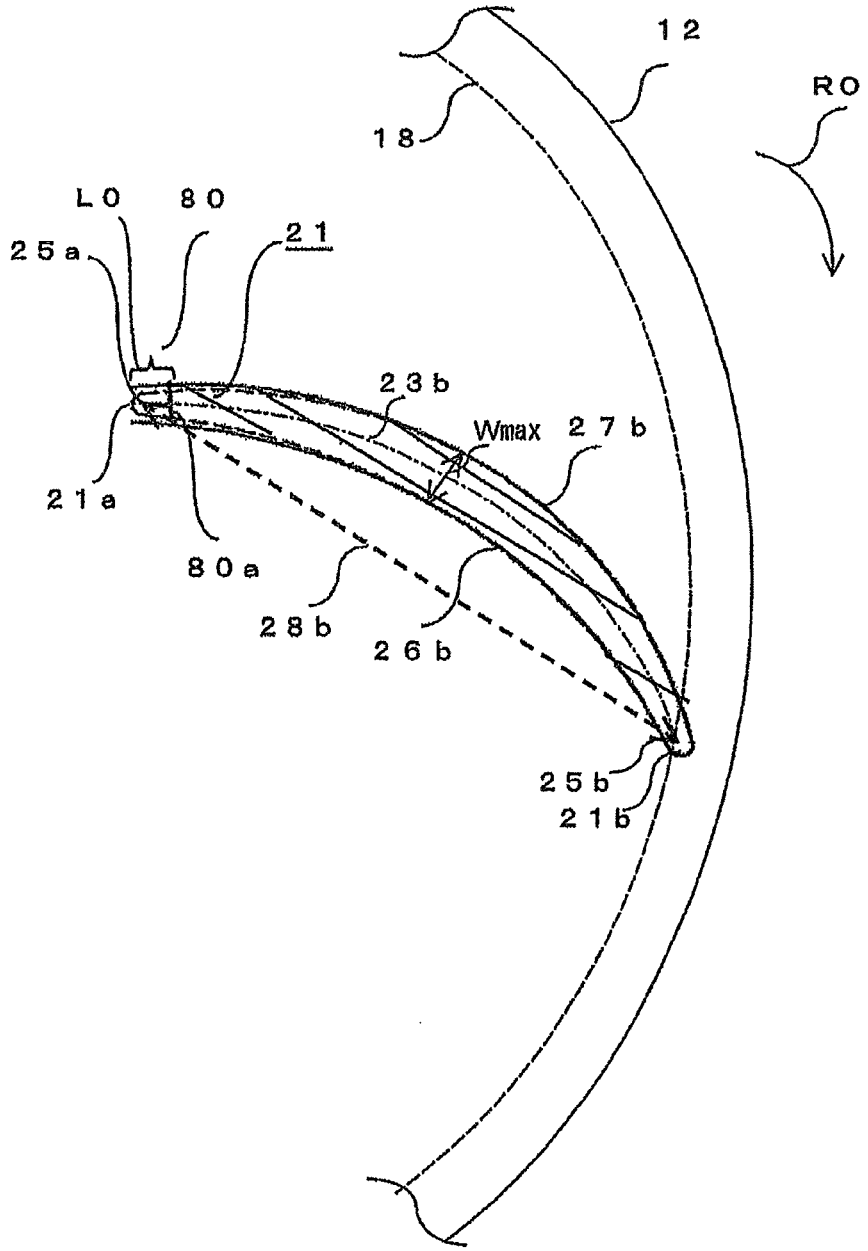
FIG. 29 is a cross-sectional view of a short-chord blade section in a plane perpendicular to a rotational axis according to Embodiment 5 of the present invention.

FIG. 29 is a cross-sectional view of the short-chord blade section 21 of FIG. 28 in a plane perpendicular to the rotational axis. The recess 80 is formed by cutting from the blade inner-circumferential edge 21*a* of the short-chord blade section 21 so as to form a recessed shape. Therefore, unlike the blade inner-circumferential edge 21*a*, a most recessed portion 80*a* of the recess 80 does not have a rounded shape when viewed from the blade inner-circumferential edge 21*a*. However, the most recessed portion 80*a* may be formed to have a rounded shape. The blade inner-circumferential edge 21*a* of the short-chord blade section 21 at portions where the recesses 80 are not provided has the shape of an arc having the center at a point 25*a* on a camber line 23*b*. In the short-chord blade section 21, the blade inner-circumferential edge 21*a* has an indented shape defined by the recesses 80 and the other portions. However, in the cross-sectional view of the short-chord blade section 21 in a plane perpendicular to the rotational axis, the shapes of a blade pressure surface 26*b* and a blade pressure suction surface 27*b* are exactly the same at the portions where the recesses 80 are provided and at the portions where the recesses 80 are not provided, except for the recesses 80. Further, since the width R of the recess 80 in the longitudinal direction (rotational axis direction) is small, the directions in which the airflow is dispersed in the case where the recesses 80 are provided are the same as those provided by a short-chord blade section 21 having no recess 80. Accordingly, L2 can be identified as a single short-chord blade section 21. Compared with the case of the long-chord blade section 20, the airflow flowing between the blades of the short-chord blade sections 21 in the inlet region E1 is directed only slightly upward, flows through the inside of the impeller 8*a*, and is blown out to the portion of the outlet flow path 11 close to the front guide 9*c*.

Figure 30:
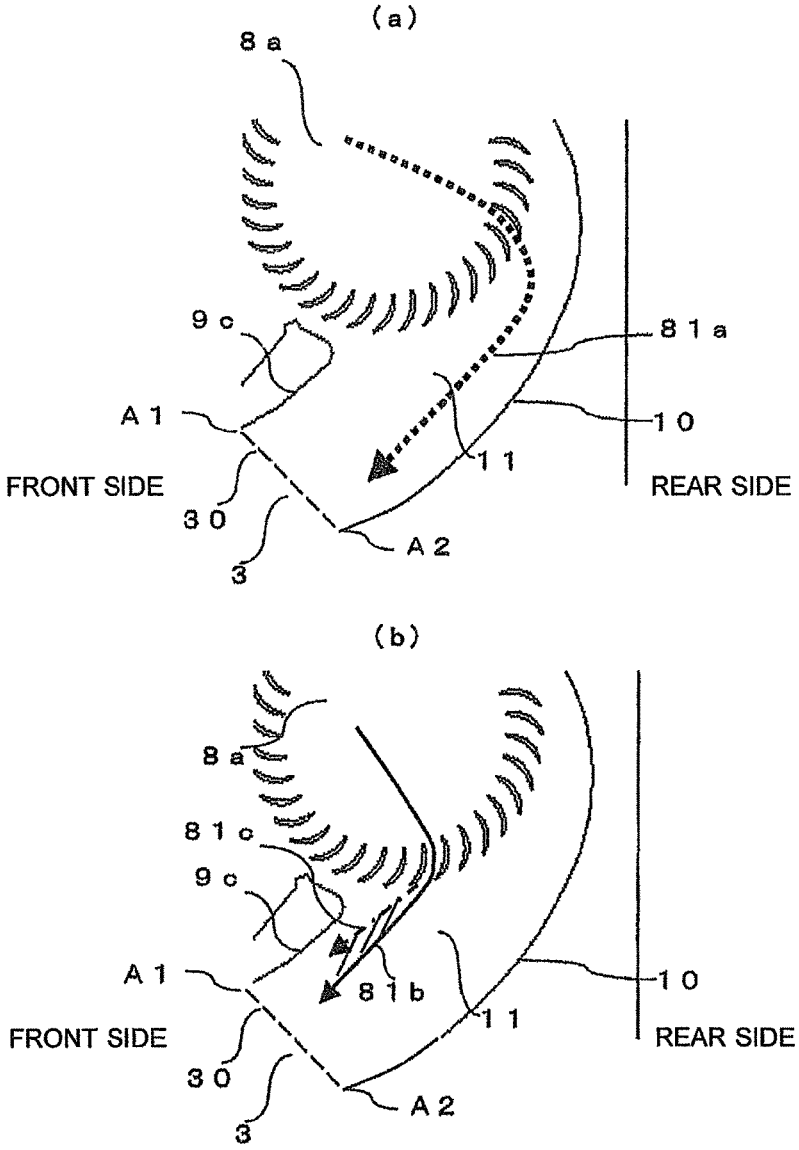
FIG. 30 is an illustrative diagram showing an airflow flowing between blades according to Embodiment 5 of the present invention.

FIG. 30 is an illustrative diagram showing the airflow flowing between the blades, and schematically illustrates a cross section perpendicular to the rotational axis 17. FIG. 30(*a*) illustrates an airflow generated by the long-chord blade section 20, and FIG. 30(*b*) illustrates an airflow generated by the short-chord blade section 21. The airflow flowing between the blades is made to become an airflow 81*a* that flows near the rear guide 10 by the long-chord blade section 20, and is also made to become an airflow 81*b* that flows near the front guide 9*c* by the short-chord blade section 21. Accordingly, at the air outlet 3, the unevenness in the distribution of the airflow is reduced, and the air velocity distribution is made uniform at the air outlet 3.

Further, in the short-chord blade section 21, the length of the plurality of recesses 80 in the chord direction is less than the length of the chord of the portions of the short-chord blade section 21 where the recesses 80 are not provided. Therefore, the airflow flowing over the recesses 80 becomes an airflow 81*c* that flows through an area slightly closer to a front guide 9*c* side (front side) than an airflow having flowed over the portions of the short-chord blade section 21 where the recesses 80 are not provided. However, the longitudinal length R of the recess 80 is less than 10% of the entire length L, and the volume of air that passes over this portion is small. Therefore, the length in the chord direction that is reduced due to the recess 80 has little effect in dispersing the airflow, and part of the airflow is drawn to and held by or dispersed by the blade suction surface in the vicinity of a most recessed portion 80*a* of the recess 80. In the case of a short-chord blade section 21 having no recess 80, air is blown out mainly in a direction of the airflow 81*b*. On the other hand, the recess 80 disperses an airflow flowing into the blade inner-circumferential edge 21*a* of the short-chord blade section 21. Therefore, the area of the airflow generated by the short-chord blade section 21 extends at the front side as indicated by the area with the diagonal lines of FIG. 30(*b*).

Figure 31:
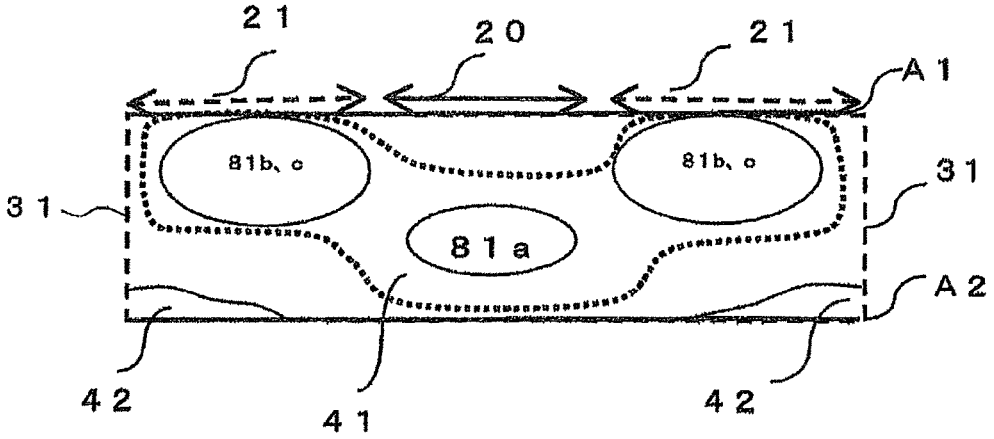
FIG. 31 is an illustrative diagram showing the air velocity distribution of an airflow at an air outlet according to Embodiment 5 of the present invention.

FIG. 31 is a diagram showing the air velocity distribution at the air outlet 3 according to Embodiment 5. The area of the airflows 81*b* and 81*c* flowing between the blades of the short-chord blade sections 21 is dispersed and increased toward the front side by the recesses 80 of the short-chord blade sections 21. Thus, on the whole, the air velocity distribution of the airflow blown out from the air outlet 3 can be made uniform. Since the width in the A1-A2 direction is increased due to the expansion of the high-speed flow region 41, the low-air-velocity region 42 is reduced.

As described above, in Embodiment 5, since the plurality of recesses 80 that are open at the distal end of the blade inner-circumferential edge 21*a* are provided at the blade inner-circumferential edge 21*a* of the short-chord blade section 21 of the blade 13, the direction of an airflow blown out from the blade section 21 having the recesses 80 is expanded to the area of the airflows 81*b* and 81*c*. Thus, the area of the high-speed flow region 41 is expanded between the front guide 9*c* and the rear guide 10, which provides an effect of making uniform the air velocity of the airflow flowing through the air outlet 3. Accordingly, compared with Embodiment 1 at a predetermined air volume, the value of the maximum air velocity is reduced, and therefore effects of significantly reducing the energy loss and the noise level are obtained.

Figure 32:
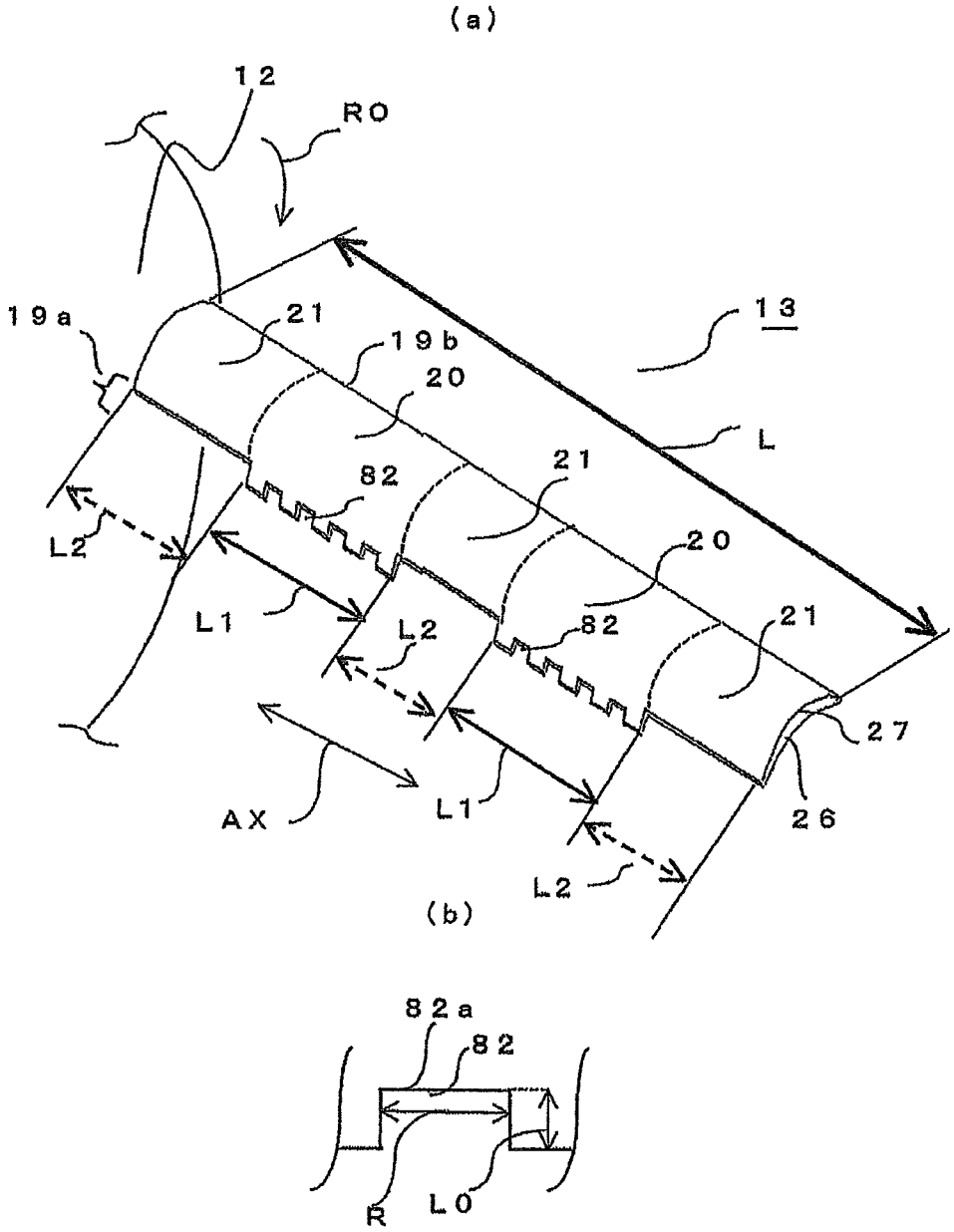
FIG. 32 illustrates Embodiment 5 of the present invention, in which a perspective view (FIG. 32(*a*)) illustrates a blade of a cross flow fan, and an illustrative diagram (FIG. 32(*b*)) shows an enlarged view of a recess.

FIG. 32(*a*) is a perspective view illustrating a blade 13 of a cross flow fan in another configuration example according to Embodiment 5. FIG. 32(*b*) is an enlarged illustrative view showing a recess 82. The blade 13 includes short-chord blade sections 21 at the center and the opposite ends in the longitudinal direction, two long-chord blade sections 20 between the short-chord blade sections 21. Further, a plurality of, for example, four, recesses 82 are provided at a blade inner-circumferential edge 19*a* of each long-chord blade section 20. For example, the recess 82 is recessed to a similar level as that of the above-described recess 80 and is configured such that a longitudinal length R 5 mm, and a length LO in the camber line direction≤1 mm. The recesses 82 are provided at equal intervals in each of the two long-chord blade sections 20. The recesses 82 are open at distal ends of the blade inner-circumferential edges 19*a*.

Figure 33:
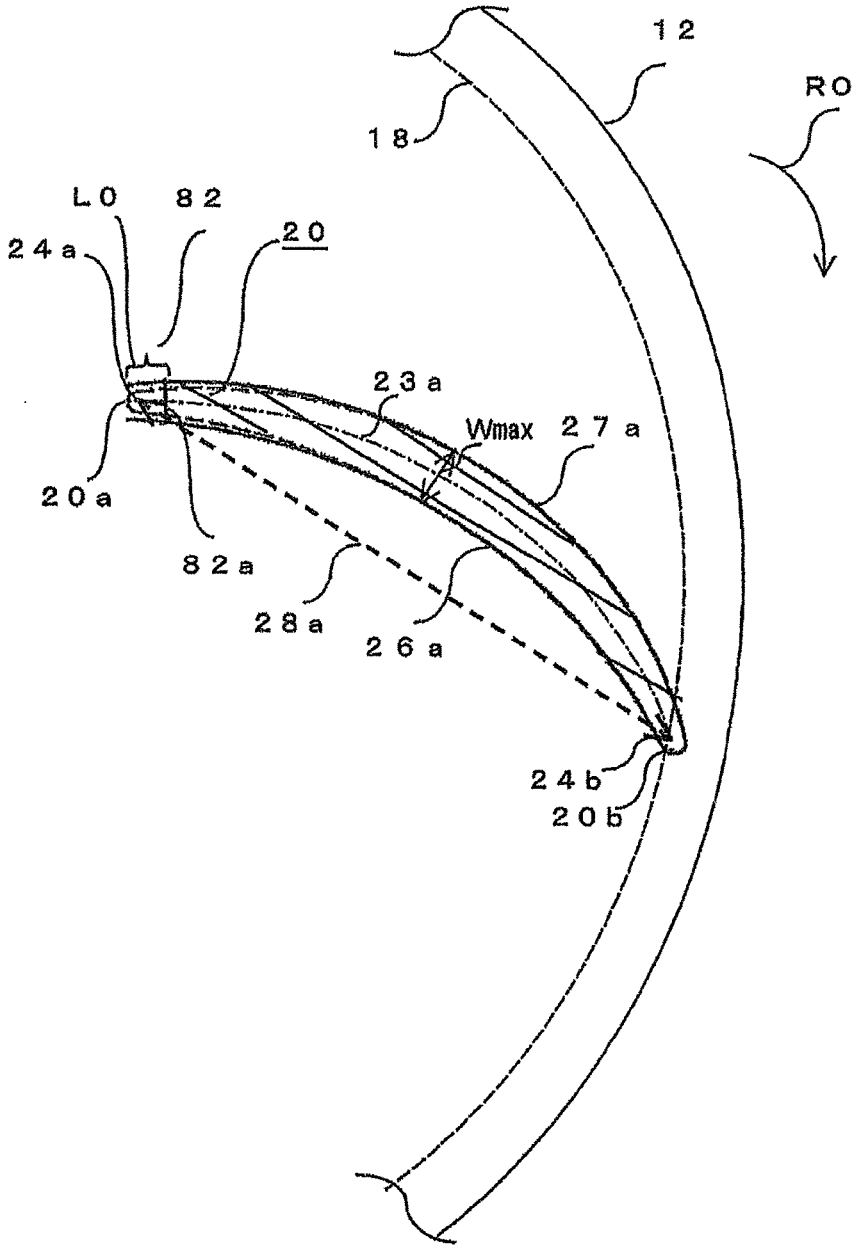
FIG. 33 is a cross-sectional view of a long-chord blade section in a plane perpendicular to a rotational axis according to Embodiment 5 of the present invention.

FIG. 33 is a cross-sectional view of the long-chord blade section 20 of FIG. 32 in a plane perpendicular to the rotational axis. The recess 82 is formed by cutting from the blade inner-circumferential edge 20*a* of the long-chord blade section 20 so as to form a recessed shape. Therefore, unlike the blade inner-circumferential edge 20*a*, a most recessed portion 82*a* of the recess 82 does not have a rounded shape when viewed from the blade inner-circumferential edge 20*a*. However, the most recessed portion 82*a* may be formed to have a rounded shape. The blade inner-circumferential edge 20*a* of the long-chord blade section 20 at portions where the recesses 82 are not provided has the shape of an arc having the center at a point 24*a* on a camber line 23*a*. In the long-chord blade section 20, the blade inner-circumferential edge 20*a* has an indented shape defined by the recesses 82 and the other portions. However, in the cross-sectional view of the blade, the shapes of a blade pressure surface 26*a* and a blade pressure suction surface 27*a* are exactly the same at the portions of the long-chord blade section 20 where the recesses 82 are provided and at the portions where the recesses 82 are not provided, except for the recesses 82. Further, since the width R of the recess 82 in the longitudinal direction is small, the directions in which the airflow is dispersed in the case where the recesses 82 are provided are the same as those provided by a long-chord blade section 20 having no recess 82. Accordingly, L1 can be identified as a single long-chord blade section 20. Compared with the case of the short-chord blade section 21, the airflow flowing between the blades of the long-chord blade sections 20 in the inlet region E1 is directed upward, flows through the inside of the impeller 8*a*, and is blown out to the portion of the outlet flow path 11 close to the rear guide 10.

Figure 34:
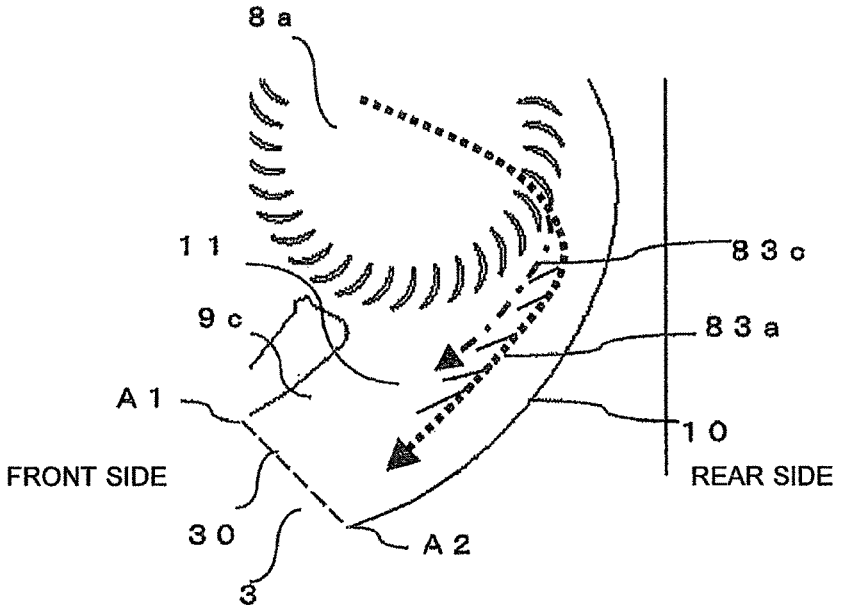
FIG. 34 is an illustrative diagram showing an airflow flowing between blades according to Embodiment 5 of the present invention.
Figure 34:
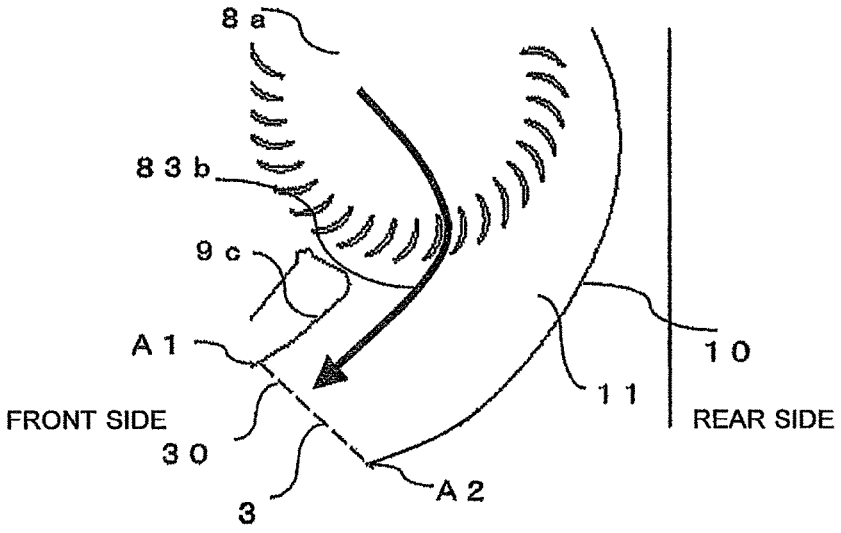

FIG. 34 is an illustrative diagram showing the airflow flowing between the blades, and schematically illustrates a cross section perpendicular to the rotational axis 17. FIG. 34(*a*) illustrates the flow of an airflow generated by the long-chord blade section 20, and FIG. 34(*b*) illustrates the flow of an airflow generated by the short-chord blade section 21. The airflow flowing between the blades is made to become an airflow 83*a* that flows near the rear guide 10 by the long-chord blade section 20, and is also made to become an airflow 83*b* that flows near the front guide 9*c* by the short-chord blade section 21. Accordingly, the unevenness in the distribution of the airflow is reduced, and the air velocity distribution is made uniform at the air outlet 3.

Further, in the long-chord blade section 20, the length of the plurality of recesses 82 in the chord direction is less than the length of the chord of the portions of the long-chord blade section 20 where the recesses 82 are not provided. Therefore, the airflow flowing over the recesses 82 becomes an airflow 83*c* that flows through an area slightly closer to a front guide 9*c* side (front side) than an airflow having flowed over the portions of the long-chord blade section 20 where the recesses 82 are not provided. However, the longitudinal length R of the recess 82 is less than approximately 10% of the entire length L, and the volume of air that passes over this portion is small. Therefore, the length in the chord direction that is reduced due to the recess 82 has little effect in dispersing the airflow, and part of the airflow is drawn to and held by or dispersed by the blade suction surface in the vicinity of a most recessed portion 82*a* of the recess 82. In the case of a long-chord blade section 20 having no recess 82, air is blown out mainly in a direction of the airflow 83*a*. On the other hand, the recess 82 disperses an airflow flowing into the blade inner-circumferential edge 20*a* of the long-chord blade section 20. Therefore, the area of the airflow generated by the long-chord blade section 20 extends in the area between the airflow 83*a* and the airflow 83*c* as indicated by the area with the diagonal lines of FIG. 34(*a*). The airflow flowing between the blades of the short-chord blade sections 21 flows through a portion of the outlet flow path 11 close to the front guide 9*c* as illustrated in FIG. 34(*b*).

Figure 35:
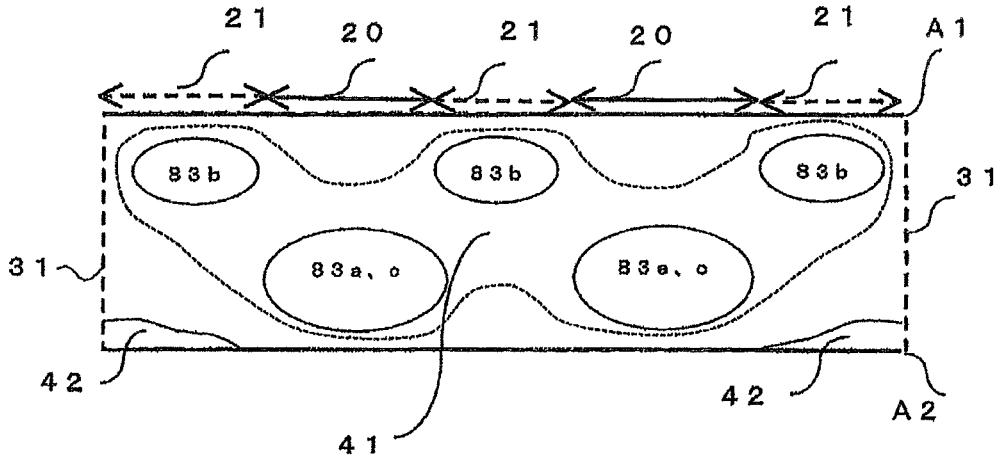
FIG. 35 is an illustrative diagram showing the air velocity distribution of an airflow at an air outlet according to Embodiment 5 of the present invention.

FIG. 35 is a diagram showing the air velocity distribution at the air outlet 3 according to Embodiment 5. The area of the airflow 83*a* and 83*c* flowing over the long-chord blade section 20 is dispersed and increased toward the front side by the recesses 82 of the long-chord blade section 20. Thus, on the whole, the air velocity distribution of the airflow blown out from the air outlet 3 can be made uniform. Since the width in the A1-A2 direction is increased due to the expansion of the high-speed flow region 41, the low-air-velocity region 42 is reduced.

As described above, in Embodiment 5, since the plurality of recesses 82 that are open at the distal end of the blade inner-circumferential edge 20*a* are provided at the blade inner-circumferential edge 20*a* of the long-chord blade section 20 of the blade 13, the direction of an airflow blown out from the blade section 20 having the recesses 82 is expanded to the area of the airflows 83*a* and 83*c*. Thus, the area of the high-speed flow region 41 is expanded between the front guide 9*c* and the rear guide 10, which provides an effect of making uniform the air velocity of the airflow flowing through the air outlet 3. Accordingly, compared with Embodiment 1 at a predetermined air volume, the value of the maximum air velocity is reduced, and therefore effects of significantly reducing the energy loss and the noise level are obtained.

Figure 36:
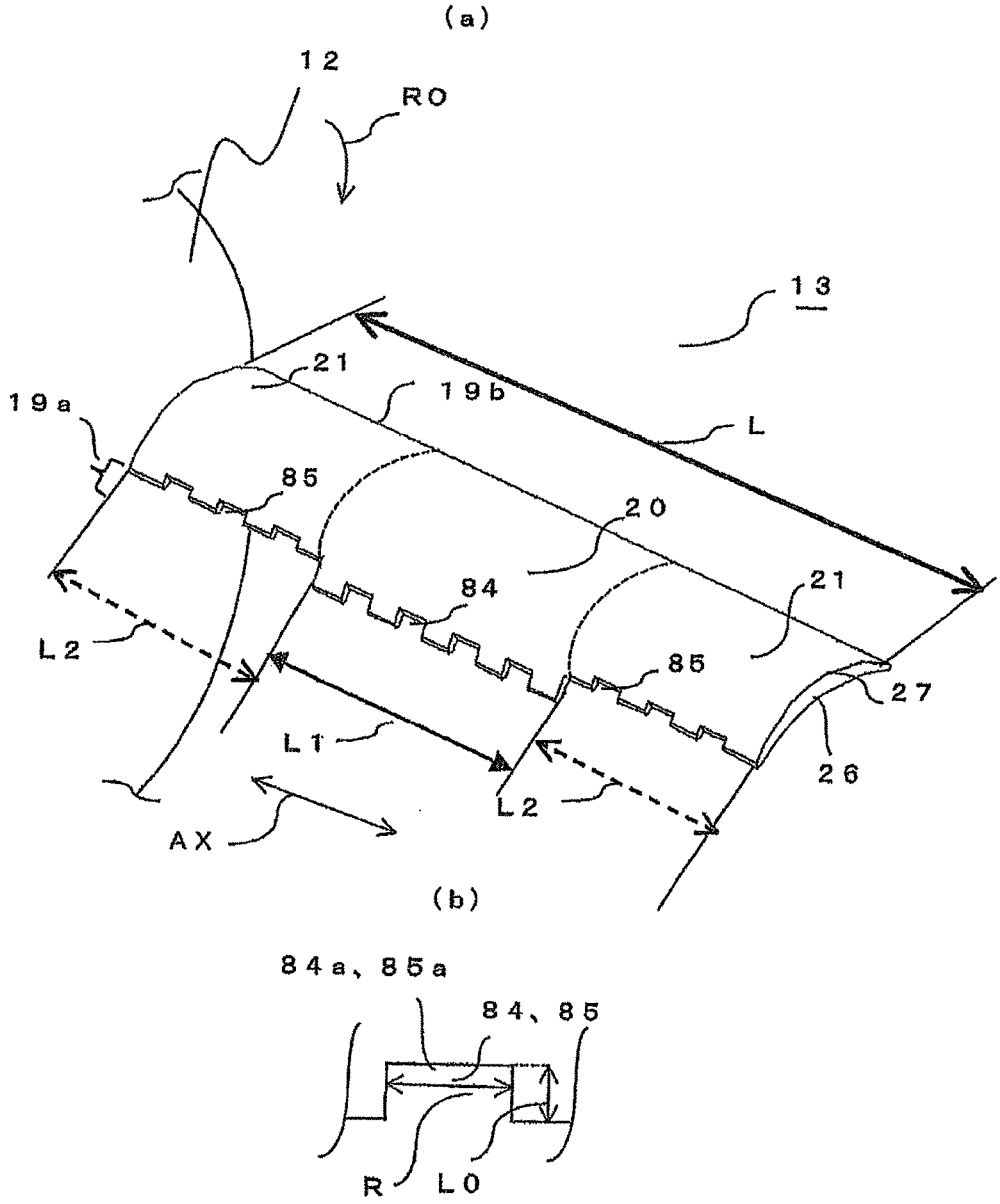
FIG. 36 illustrates Embodiment 5 of the present invention, in which a perspective view (FIG. 36(*a*)) illustrates a blade of a cross flow fan, and an illustrative diagram (FIG. 36(*b*)) shows an enlarged view of a recess.

A configuration example will be described in which recesses are provided in both the long-chord blade section 20 and the short-chord blade section 21. FIG. 36 is a perspective view illustrating a blade 13 of a cross flow fan in another configuration example according to Embodiment 5 of the present invention. The blade 13 includes a long-chord blade section 20 at the center and short-chord blade sections 21 at the opposite ends in the longitudinal direction. Further, a plurality of recesses, for example, four recesses 84, are provided at a blade inner-circumferential edge 19*a* of the long-chord blade section 20, and a plurality of recesses, for example three recesses 85, are provided at a blade inner-circumferential edge 19*a* of each short-chord blade section 21. For example, the recesses 84 and 85 have a similar shape, for example, and each is configured such that a longitudinal length N≤5 mm, and a length LO in the camber line direction≤1 mm. The recesses 84 are provided at equal intervals in the long-chord blade section 20, and recesses 85 are provided at equal intervals in each short-chord blade section 21.

Each recess 84 and each recess 85 may be recessed notches formed by cutting the blade inner-circumferential edge 20*a* of the long-chord blade section 20 and the blade inner-circumferential edge 21*a* of the short-chord blade section 21 so as to be open at distal ends of the blade inner-circumferential edges 20*a* and 21*a*, respectively. The blade sections where the recesses 84 and 85 are provided have a shape such that the length in the chord direction is less than that of the portions of the blade sections where the recesses 84 and 85 are not provided. In both the long-chord blade section 20 and the short-chord blade section 21, the shapes of a blade pressure surface 26 and a blade pressure suction surface 27 are exactly the same at the portions where the recesses 84 and 85 are provided and at the portions where the recesses 84 and 85 are not provided, except for the recesses 84 and 85, respectively. Further, since the widths of the recesses 84 and 85 in the longitudinal direction are small, the directions in which the airflow is dispersed in the case where the recesses 84 and 85 are provided are the same as those provided by a long-chord blade section 20 and a short-chord blade section 21 having no recess 84 and no recess 85, respectively. Accordingly, L1 and L2 can be identified as a single long-chord blade section 20 and a single short-chord blade section 21. In the long-chord blade section 20 and the short-chord blade section 21, the blade inner-circumferential edge 20*a* and the blade inner-circumferential edge 21*a* have an indented shape defined by the recesses 84 and the other portions, and the recesses 85 and the other portions, respectively, and the airflow is mainly determined by the shapes and chords 28*a* and 28*b* of the blade inner-circumferential edges 20*a* and 21*a*.

Figure 37:
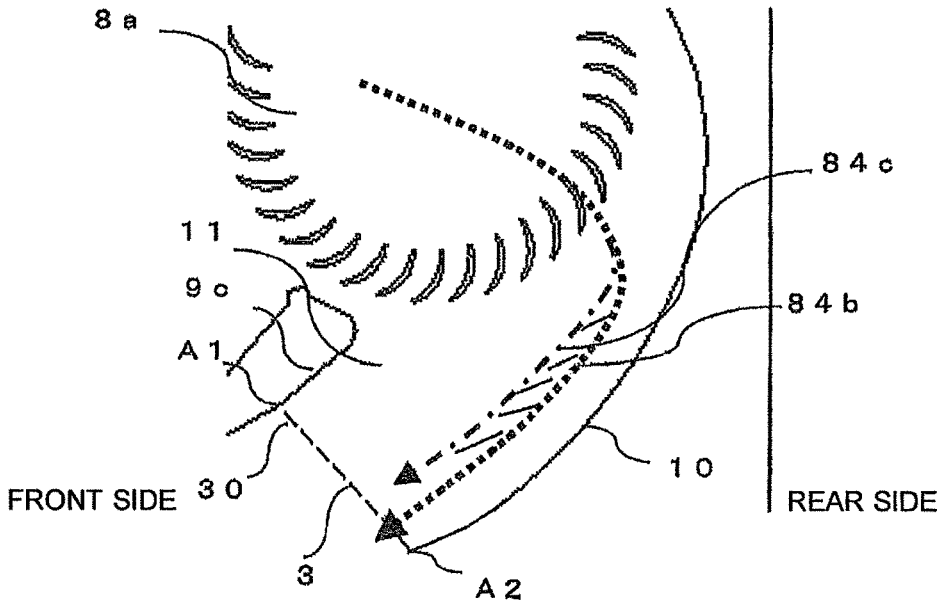
FIG. 37 is an illustrative diagram showing an airflow flowing between blades according to Embodiment 5 of the present invention.
Figure 37:
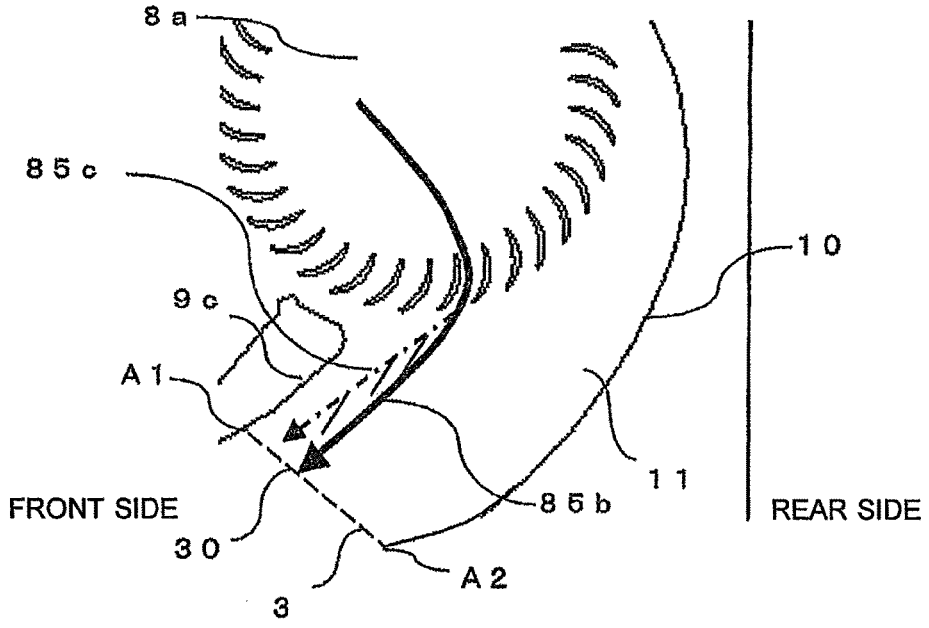

FIG. 37 is an illustrative diagram showing the airflow flowing between the blades, and schematically illustrates a cross section perpendicular to the rotational axis 17. FIG. 37(*a*) illustrates the flow of an airflow generated by the long-chord blade section 20, and FIG. 37(*b*) illustrates the flow of an airflow generated by the short-chord blade section 21. That is, the airflow flowing between the blades is made to become an airflow 84*b* that flows near the rear guide 10 (rear side) by the long-chord blade section 20, and is also made to become an airflow 85*b* that flows near the front guide 9*c* (front side) by the short-chord blade section 21. Accordingly, the unevenness in the distribution of the airflow is reduced, and the air velocity distribution is made uniform at the air outlet 3.

Further, in the long-chord blade section 20, the portions where the plurality of recesses 84 are provided have a function of dispersing the airflow flowing into between the blades of the long-chord blade sections 20. The dispersed airflow is indicated by the one-dot chain line 84*c* of FIG. 37(*a*). As indicated by the diagonal lines, the main airflow 84*b* over the long-chord blade section 20 is dispersed toward the front side.

Similarly, in the short-chord blade section 21, the portions where the plurality of recesses 85 are provided have a function of dispersing the airflow flowing into between the blades of the short-chord blade sections 21. The dispersed airflow is indicated by the one-dot chain line 85*c* of FIG. 37(*b*). As indicated by the diagonal lines, the main airflow 85*b* over the short-chord blade section 21 is dispersed toward the front side.

Figure 38:
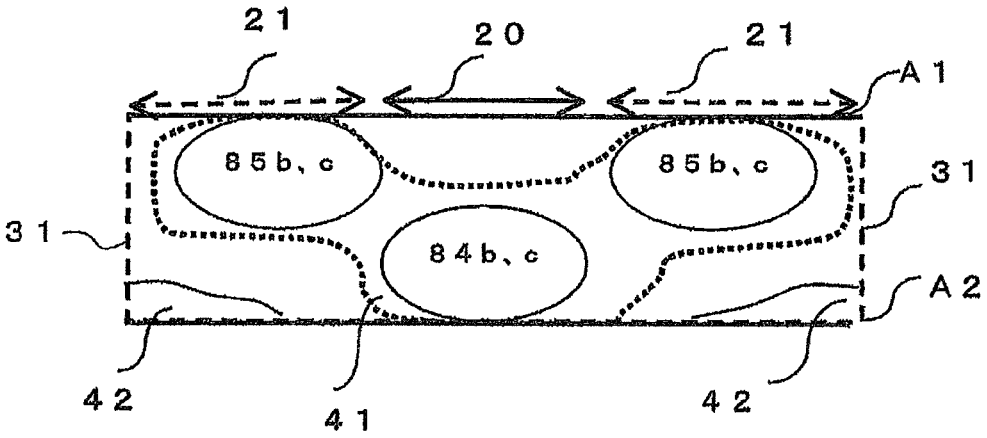
FIG. 38 is an illustrative diagram showing the air velocity distribution of an airflow at an air outlet according to Embodiment 5 of the present invention.

FIG. 38 is a diagram showing the air velocity distribution at the air outlet 3 according to Embodiment 5. The area of the airflows 84*b* and 84*c* flowing over the long-chord blade section 20 is increased by the recesses 84 of the long-chord blade section 20. At the same time, the area of the airflows 85*b* and 85*c* flowing over the short-chord blade section 21 is increased by the recesses 85 of the short-chord blade section 21. Thus, on the whole, the air velocity distribution of the airflow blown out from the air outlet 3 can be made uniform. Since the width in the A1-A2 direction is increased due to the expansion of the high-speed flow region 41, the low-air-velocity region 42 is reduced.

As described above, in Embodiment 5, since the plurality of recesses 84 and 85 that are open at the distal ends of the blade inner-circumferential edges 20*a* and 21*a* are provided at the blade inner-circumferential edges 20*a* and 21*a*, respectively, of all the blade sections 20 and 21 of the blade 13, the directions of airflows blown out from the blade sections 20 and 21 having the recesses 84 and 85 are expanded to the area of the airflows 84*b* and 84*c* and the area of the airflows 85*b* and 85*c*, respectively. Thus, the area of the high-speed flow region 41 is expanded between the front guide 9*c* and the rear guide 10, which provides an effect of making uniform the air velocity of the airflow flowing through the air outlet 3. Accordingly, compared with Embodiment 1 at a predetermined air volume, the value of the maximum air velocity is reduced, and therefore effects of significantly reducing the energy loss and the noise level are obtained.

It is obvious that, since the blade includes the plurality of blade sections, and the plurality of recesses that are open at a distal end of the blade inner-circumferential edge 19*a* are provided at the blade inner-circumferential edge 19*a* of at least one blade section, the width of the airflow blown out from the blade section is increased, and therefore the area of the high-speed flow region 41 is expanded between the front guide 9*c* and the rear guide 10, which provides an effect of making uniform the air velocity of the airflow flowing through the air outlet 3. Accordingly, it is possible to obtain a cross flow fan that significantly reduces the energy loss and the noise level.

In FIGS. 28, 32, and 36, rectangular recesses are provided in the long-chord blade section 20, the short-chord blade section 21, or both the long-chord blade section 20 and the short-chord blade section 21, the shape is not limited to a rectangular shape. A V-shaped or a U-shaped recess that is open at the distal end of the blade inner-circumferential edge 19*a* provides the same effect.

Embodiment 6

In Embodiments 1 through 5, the configurations of the embodiments are described in which each blade 13 of the impeller element 14 is divided into a plurality of blade sections in the rotational axis direction AX, and one or more of the blade sections protrude toward the inner circumferential side at the blade inner-circumferential edge 19*a* so as to have different chord lengths. In Embodiment 6, as a configuration for further increasing the effect of widely dispersing the airflow between the front guide 9*c* and the rear guide 10 in the outlet flow path 11, an outlet angle of a blade section having a longer chord is greater than an outlet angle of a blade section having a shorter chord.

Figure 39:
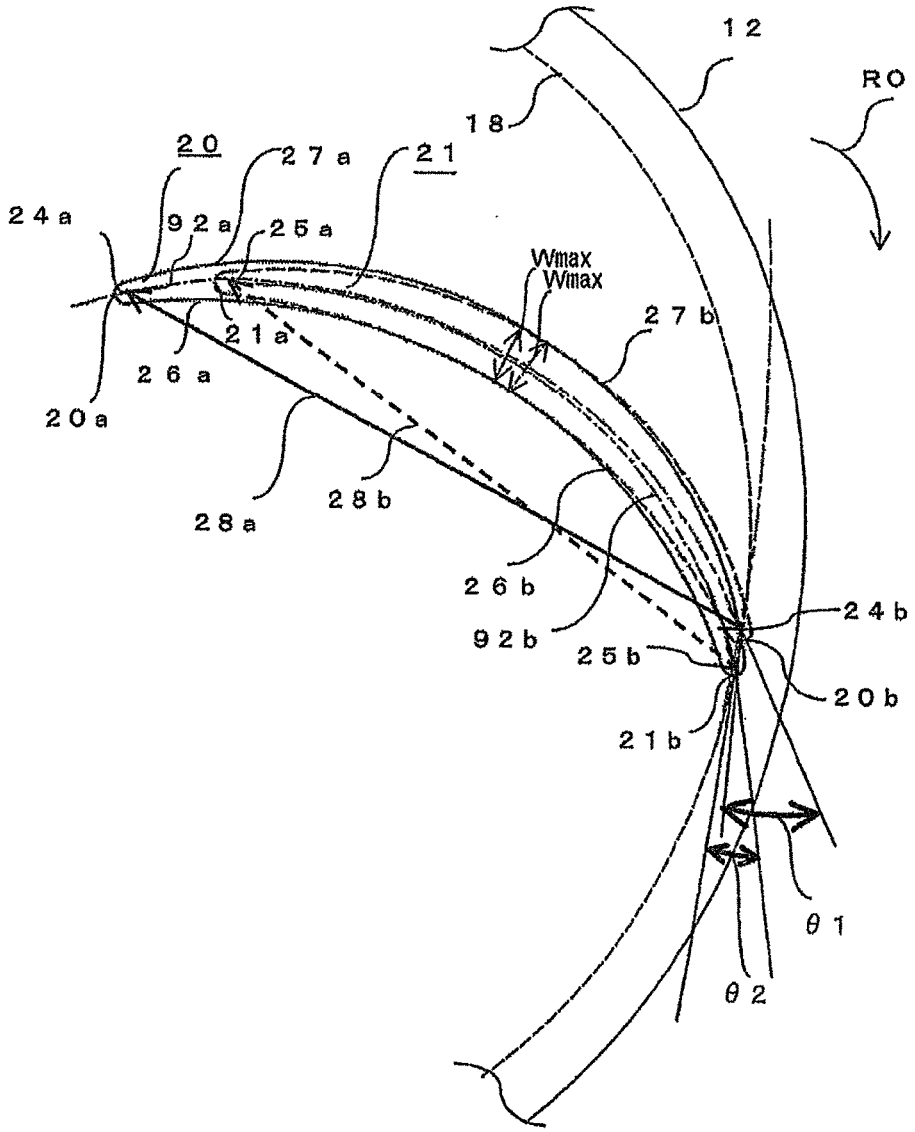
FIG. 39 is an illustrative diagram showing the cross sections of a long-chord blade section and a short-chord blade section perpendicular to a rotational axis in a superimposed manner according to Embodiment 6 of the present invention.

FIG. 39 is an illustrative diagram showing the cross sections of a long-chord blade section 20 and a short-chord blade section 21 perpendicular to a rotational axis 17 in a superimposed manner according to Embodiment 6 of the present invention. In Embodiment 6, each of the cross flow fans according to Embodiments 1 through 5 is modified such that the blade outer-circumferential edges 20*b* and 21*b* of the blade sections 20 and 21 having the chords 28 of different lengths have different shapes. In Embodiment 6, since the blade outer-circumferential edges 20*b* and 21*b* have different shapes, chamber lines 92 (a camber line 92*a* of the long-chord blade section 20 and a camber line 92*b* of the short-chord blade section 21) defined by the center lines between blade pressure surfaces 26*a* and 27*a* and blade pressure suction surfaces 26*b* and 27*b* of the long-chord blade section 20 and the short-chord blade section 21 do not match and are shifted from each other. In the cross sections of the long-chord blade section 20 and the short-chord blade section 21, the blade outer-circumferential edges 20*b* and 21*b* of the long-chord blade section 20 and the short-chord blade section 21 have the shape of arcs of circles having centers at points 24*b* and 25*b* on the camber lines 92*a* and 92*b*. Since the plurality of blades 13 fixed to the support plates 12 form a rotor as the impeller element 14, the points 24*b* and 25*b* are located on the trajectory of a circle, which is an outer diameter line 18, having the center at the rotational center O.

An angle formed by the tangent lines to the both curves (the camber line and the outer diameter line) at the intersection between the camber line 92 of the blade and the outer diameter line 18 is referred to as an outlet angle. In Embodiment 6, an outlet angle θ1 of the long-chord blade section 20>an outlet angle θ2 of the short-chord blade section 21. For example, the angle θ1 of the long-chord blade section 20 is 28 degrees, and the angle θ2 of the short-chord blade section 21 is 25 degrees. The outlet angles θ1 and θ2 relate to the directions of the airflows blown out from the blade outer-circumferential edges 20*b* and 21*b* in the outlet region E2 into the outlet flow path 11.

Figure 40:
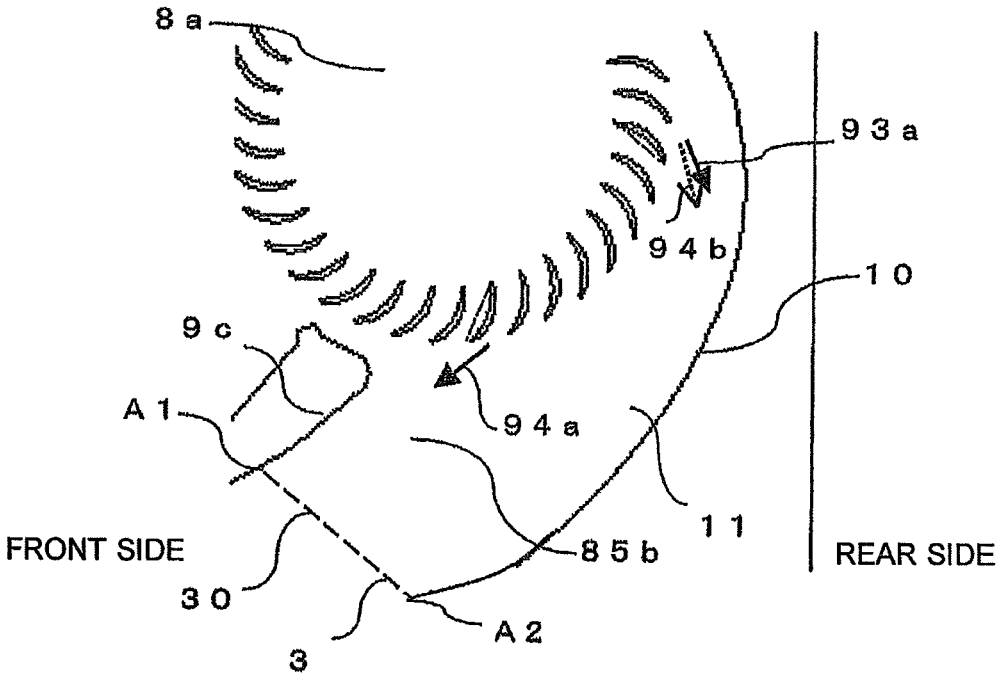
FIG. 40 is an illustrative diagram showing the direction of an airflow blown out from an impeller according to Embodiment 6 of the present invention.

FIG. 40 is an illustrative diagram showing the direction of the airflow blown out from the impeller 8*a*. Since the outlet angle θ1 of the long-chord blade section 20 is great, the camber line 92*a* is directed toward the outer side of the radius, an airflow is blown out radially rearward in the rotational direction RO as shown by an arrow 93*a*. Therefore, the airflow blown out between the blades of the long-chord blade sections 20 passes a rear guide 10 side (rear side) in the outlet flow path 11, and is blown out to a lower side (a portion close to A2) at the air outlet 3. On the other hand, since the outlet angle θ1 of the short-chord blade section 21 is less than the outlet angle θ2 of the long-chord blade section 20, the camber line 92*b* of the long-chord blade section 20 is directed toward the inner side of the radius compared with the camber line 92*a* of the short-chord blade section 21, an airflow is blown out radially forward in the rotational direction RO as shown by an arrow 94*a*. Accordingly, the airflow passes a front guide 9*c* side (front side) in the outlet flow path 11, and is blown out to an upper side (a portion close to A1) at the air outlet 3. In FIG. 40, the direction in which an airflow is blown out when the outlet angle θ1 of the long-chord blade section 20 is equal to the outlet angle θ2 of the short-chord blade section 21 indicated by a dotted arrow 94*b* is shown just for reference. The solid arrow 93*a* indicates that the airflow is blown out to the rear guide 10 side, compared with the dotted arrow 94*b*.

The outlet angle θ1 of the long-chord blade section 20 is greater than the outlet angle θ2 of the short-chord blade section 21 by a few degrees, for example, 2 through 5 degrees. Since the outlet angle θ1 is greater by a few degrees, it is possible to further increase the width of the airflow to be blown out. Thus, the air velocity distribution of the airflow is made uniform at the air outlet 3. Accordingly, it is possible to obtain a cross flow fan capable of reducing the energy loss and the noise level.

More specifically, with regard to the shape of the blade section of the configuration of Embodiment 1, for example, the camber line 92*b* is determined on the basis of a point that is moved rearward on the outer diameter line 18 in the rotational direction RO as the blade outer-circumferential edge 24*b* of the long-chord blade section 20. With regard to the distance by which the point is moved rearward, a sufficient effect can be obtained even if the outlet angle is increased by about 1 to 2 degrees. Since the long-chord blade section 20 and the short-chord blade section 21 form a single continuous blade 13, the outlet angle of the long-chord blade section 20 is preferably greater by a few degrees such that the airflow flows smoothly between the blades.

As described above, in Embodiment 6, in the cross section perpendicular to the rotational axis 17 of the blade 13, the center line between the blade pressure surface 26 as the front surface and the blade pressure suction surface 27 as the rear surface in the rotational direction of the blade 13 is defined as the camber lines 92; angles formed by the outer diameter line 18 passing the blade outer-circumferential edges 20*b* and 21*b* of the all the blades 13 of the impeller element 14 and having the center at the rotational center O and the camber lines 92 are defined as outlet angles θ1 and θ2; and the outlet angle θ1 of the long-chord blade section 20 having the longer chord 28*a* is greater than the outlet angle θ2 of the short-chord blade section 21 having the shorter chord 28*b*. Thus, the airflow passing between the blades of the long-chord blade sections 20 is blown out to a portion closer to portion closer to the rear guide 10. Accordingly, with respect to the airflow flowing through the outlet flow path 11, the area of the high-speed flow region 41 is expanded between the front guide 9*c* and the rear guide 10, which provides an effect of making uniform the air velocity of the airflow flowing through the air outlet 3. Thus, compared with Embodiment 1, the value of the maximum air velocity upon obtaining a predetermined air volume is reduced. Accordingly, it is possible to obtain a cross flow fan capable of reducing the energy loss and the noise level.

It is to be noted that, as described in Embodiments 1 through 6, it is possible to obtain a cross flow fan capable of blowing an airflow out from between blades in a wide range in the circumferential direction in an outlet region of the cross flow ran. When this cross flow fan is installed in an indoor unit of an air-conditioning apparatus, the area of a high-speed flow region of an airflow flowing through an outlet flow path formed downstream of the cross flow fan is expanded. Thus, the air velocity distribution is made uniform, and the value of the maximum air velocity is reduced. Accordingly, it is possible to obtain an indoor unit of an air-conditioning apparatus that reduces the energy loss and the level of noise.

In Embodiments 1 through 6, an indoor unit of an air-conditioning apparatus has been described as an apparatus equipped with a cross flow fan. However, the present invention is not limited thereto. For example, the present invention may be implemented as a cross flow fan for use in a vertical air-sending device and the like.

REFERENCE SIGNS LIST

1 indoor unit of air-conditioning apparatus; 3 air outlet; 4*a* vertical wind direction vane; 4*b* horizontal wind direction vane; 8 cross flow fan; 8*a* impeller; 9 stabilizer; 9*a* drain pan; 9*b* tongue portion; 9*c* front guide; 10 rear guide; 11 outlet flow path; 12 support plate; 13 blade; 14 impeller element; 17 rotational axis; 18 outer diameter line; 19*a* blade inner-circumferential edge; 19*b* blade outer-circumferential edge; 20 long-chord blade section; 20*a* blade inner-circumferential edge; 20*b* blade outer-circumferential edge; 21 short-chord blade section; 21*a* blade inner-circumferential edge; 21*b* blade outer-circumferential edge; 23*a*, 23*b* camber line; 24*a*, 25*a* center of arc of blade inner-circumferential edge; 24*b*, 25*b* center of arc of blade outer-circumferential edge; 26*a*, 26*b* blade pressure surface; 27*a*, 27*b* blade pressure suction surface; 28*a*, 28*b* chord; 32, 34 region; 41 high-speed flow region; 42 low-speed flow region; 50*a*, 50*b*, 50*c* long-chord blade section; 51*a*, 51*b*, 51*c*, 51*d* short-chord blade section; 60 first long-chord blade section; 61 second long-chord blade section; 62 third long-chord blade section; 63*a*, 63*b*, 63*c*, 63*d* short-chord blade section; 70*a*, 70*b* first long-chord blade section; 71 second long-chord blade section; 72*a*, 72*b* short-chord blade section 73*a*, 73*b* inter-blade-section smoothening section; 80, 82, 84, 85 recess; and 92*a*, 92*b* camber line.

The invention claimed is:

1. A cross flow fan comprising:

an impeller that includes a plurality of impeller elements each including a plurality of blades disposed along an outer circumference of a circular support plate, the plurality of impeller elements being fixed to each other in a direction of a rotational axis passing through a center of the support plate;

wherein each of the blades is divided into a plurality of blade sections in the rotational axis direction;

wherein at least one of the divided blade sections is a long-chord blade section whose chord has a length greater than a length of a chord of at least another one of the blade sections, the chord being a line segment connecting a blade outer-circumferential edge and a blade inner-circumferential edge of each of the blades in a cross section perpendicular to the rotational axis of the blades;

wherein at least two of the divided blade sections are short-chord blade sections whose chords have lengths less than a length of the chord of the long-chord blade section, the at least two blade sections being located at opposite ends of each of the blades in the direction of the rotational axis;

wherein the blade inner-circumferential edge of the long-chord blade section protrudes toward an inner circumferential side, relative to the blade inner-circumferential edges of the short-chord blade sections, and wherein a long-chord length of the long-chord blade section at an interface between the long-chord blade section and the short-chord blade section is longer than a short-chord length of the short-chord blade section at the interface between the long-chord blade section and the short-chord blade section.

2. The cross flow fan of claim 1, wherein the long-chord blade section is located at least near a center of each of the blades in the rotational axis direction.

3. The cross flow fan of claim 1, wherein a plurality of recesses are provided at the blade inner-circumferential edge of at least one of the blade sections.

4. The cross flow fan of claim 1, wherein, at the blade inner-circumferential edge, an inter-blade-section smoothening section is provided at a stepped portion between two adjacent blade sections having chords of different lengths, the inter-blade-section smoothing section having a chord of a length between lengths of the respective chords of the two blade sections.

5. The cross flow fan of claim 1, wherein: in a cross section perpendicular to the rotational axis of the blades, blade outer-circumferential edges of all the blades of each of the impeller elements are located on an outer diameter line of a same diameter having a center at a position of the rotational axis; a center line between a blade pressure surface as a front surface and a blade pressure suction surface as a rear surface in a rotational direction of the blades is defined as a camber line; and, when an angle formed by the outer diameter line and the camber line is defined as an outlet angle, the long-chord blade section has the outlet angle greater than that of each of the short-chord blade sections.

6. An air-conditioning apparatus comprising the cross flow fan of claim 1.

7. The cross flow fan of claim 1, wherein the blade inner-circumferential edge is formed of first line segments in the short-chord blade sections, and a second line segment in the long-chord blade section; and wherein the first line segments are discontinuous with respect to the second line segments.

8. The cross flow fan of claim 7, wherein the first line segment is a straight line.

9. The cross flow fan of claim 7, wherein the second line segments are straight lines.

10. A cross flow fan comprising:

an impeller that includes a plurality of impeller elements each including a plurality of blades disposed along an outer circumference of a support plate, the plurality of impeller elements being fixed to each other in a direction of a rotational axis passing through a center of the support plate;

wherein each of the blades is divided into a plurality of blade sections in the rotational axis direction;

wherein at least one of the divided blade sections is a long-chord blade section whose chord has a length greater than a length of a chord of at least another one of the blade sections, the chord being a line segment connecting a blade outer-circumferential edge and a blade inner-circumferential edge of each of the blades in a cross section perpendicular to the rotational axis of the blades;

wherein the blade inner-circumferential edge of the long-chord blade section protrudes toward an inner circumferential side, relative to the blade inner-circumferential edge of the at least another one of the blade sections as a short-chord blade section having a shorter chord;

wherein a plurality of recesses are provided at the blade inner-circumferential edge of at least one of the blade sections, and wherein a long-chord length of the long-chord blade section at an interface between the long-chord blade section and the short-chord blade section is longer than a short-chord length of the short-chord blade section at the interface between the long-chord blade section and the short-chord blade section.

11. A cross flow fan comprising:

an impeller that includes a plurality of impeller elements each including a plurality of blades disposed along an outer circumference of a support plate, the plurality of impeller elements being fixed to each other in a direction of a rotational axis passing through a center of the support plate;

wherein each of the blades is divided into a plurality of blade sections in the rotational axis direction;

wherein at least one of the divided blade sections is a long-chord blade section whose chord has a length greater than a length of a chord of at least another one of the blade sections, the chord being a line segment connecting a blade outer-circumferential edge and a blade inner-circumferential edge of each of the blades in a cross section perpendicular to the rotational axis of the blades;

wherein the blade inner-circumferential edge of the long-chord blade section protrudes toward an inner circumferential side, relative to the blade inner-circumferential edge of the at least another one of the blade sections as a short-chord blade section having a shorter chord;

wherein, in a cross section perpendicular to the rotational axis of the blades, the blade outer-circumferential edges of all the blades of the impeller element are located on an outer diameter line of a same diameter having a center at a position of the rotational axis; a center line between a blade pressure surface as a front surface and a blade pressure suction surface as a rear surface in a rotational direction of the blade is defined as a camber line; and, when an angle formed by the outer diameter line and the camber line is defined as an outlet angle, the long-chord blade section has the outlet angle greater than that of the short-chord blade sections, and wherein a long-chord length of the long-chord blade section at an interface between the long-chord blade section and the short-chord blade section is longer than a short-chord length of the short-chord blade section at the interface between the long-chord blade section and the short-chord blade section.

12. An air-conditioning apparatus comprising:

an air inlet that suctions indoor air;

an air outlet that blows the indoor air suctioned through the air inlet into a room; and a cross flow fan that blows the indoor air from the air inlet to the air outlet; wherein the cross flow fan includes an impeller that includes a plurality of impeller elements each including a plurality of blades disposed along an outer circumference of a support plate, the plurality of impeller elements being fixed to each other in a direction of a rotational axis passing through a center of the support plate;

wherein each of the blades has a first section through which an airflow flows out from an inner part of the air outlet, the first section being included at a position in the direction of the rotational axis, and has a second section through which an airflow flows out from an outer part, which is greater than the inner part in distance from the rotational axis, of the air outlet, the second section being included at other position in the direction of the rotational axis, and wherein a long-chord length of the long-chord blade section at an interface between the long-chord blade section and the short-chord blade section is longer than a short-chord length of the short-chord blade section at the interface between the long-chord blade section and the short-chord blade section.

13. The air-conditioning apparatus of claim 12, wherein the air outlet is disposed lower than the air inlet, and wherein the outer part is located lower than the inner part.

14. The air-conditioning apparatus of claim 12, wherein, when parts corresponding to the respective impeller elements in the air outlet are defined as a plurality of partial air outlets into which the air outlet is divided in a width direction, an air velocity of the airflow that flows out the inner part becomes higher than an air velocity of the airflow that flows out the outer part, at ends of each of the partial air outlets in width direction, and the air velocity of the airflow that flows out the outer part becomes higher than the air velocity of the airflow that flows out the inner part, at the middle section of each of the partial air outlets in the width direction.

* * * * *